US007793741B2

(12) United States Patent
Harder et al.

(10) Patent No.: US 7,793,741 B2
(45) Date of Patent: Sep. 14, 2010

(54) IMPACT EXCAVATION SYSTEM AND METHOD WITH INJECTION SYSTEM

(75) Inventors: Nathan J. Harder, Houston, TX (US); Harry B. Curlett, Cody, WY (US); Paul O. Padgett, Cody, WY (US); Butch Hazel, Cody, WY (US)

(73) Assignee: PDTI Holdings, LLC, Houston, TX (US)

( * ) Notice: Subject to any disclaimer, the term of this patent is extended or adjusted under 35 U.S.C. 154(b) by 732 days.

(21) Appl. No.: 11/205,006

(22) Filed: Aug. 16, 2005
(Under 37 CFR 1.47)

(65) Prior Publication Data

US 2006/0191718 A1 Aug. 31, 2006

Related U.S. Application Data

(63) Continuation-in-part of application No. 10/897,196, filed on Jul. 22, 2004, now Pat. No. 7,503,407, which is a continuation-in-part of application No. 10/825,338, filed on Apr. 15, 2004, now Pat. No. 7,258,176.

(60) Provisional application No. 60/463,903, filed on Apr. 16, 2003.

(51) Int. Cl.
*E21B 7/16* (2006.01)

(52) U.S. Cl. ..... 175/67; 175/206; 175/207

(58) Field of Classification Search ..... 175/67, 175/54, 424, 206, 207, 218; 406/146
See application file for complete search history.

(56) References Cited

U.S. PATENT DOCUMENTS

| | | | | |
|---|---|---|---|---|
| 2,626,779 | A | 1/1953 | Armentrout | |
| 2,724,574 | A | 11/1955 | Ledgerwood, Jr. | |
| 2,727,727 | A | 12/1955 | Williams | |
| 2,728,557 | A | 12/1955 | McNatt | |
| 2,761,651 | A | 9/1956 | Ledgerwood, Jr. | |
| 2,771,141 | A | 11/1956 | Lewis | |
| 2,779,571 | A | 1/1957 | Ortloff | |
| 2,807,442 | A | 9/1957 | Ledgerwood, Jr. | |
| 2,809,013 | A | 10/1957 | Ledgerwood, Jr. et al. | |
| 2,815,931 | A | 12/1957 | Williams | |
| 2,841,365 | A | 7/1958 | Ramsey et al. | |
| 2,868,509 | A | 1/1959 | Williams | |
| 2,954,122 | A | 9/1960 | Colburn | |
| 3,001,652 | A * | 9/1961 | Schroeder et. al. | 414/217 |

(Continued)

FOREIGN PATENT DOCUMENTS

CA 2522568 A1 11/2004

(Continued)

OTHER PUBLICATIONS

Anderson, Arthur, "Global E&P Trends," Jul. 1999.

(Continued)

*Primary Examiner*—William P Neuder
*Assistant Examiner*—Nicole A Coy
(74) *Attorney, Agent, or Firm*—Arnold & Knoblock, L.L.P.

(57) ABSTRACT

A system and method according to which at least one vessel injects a suspension of liquid and a plurality of impactors into a formation to remove at least a portion of the formation.

19 Claims, 24 Drawing Sheets

U.S. PATENT DOCUMENTS 3,055,442 A 9/1962 Prince
3,084,752 A 4/1963 Tiraspolsky
3,093,420 A * 6/1963 Stephenson et. al. ..... 406/125
3,112,800 A 12/1963 Bobo
3,123,159 A 3/1964 Buck
3,132,852 A 5/1964 Dolbear
3,322,214 A 5/1967 Buck
3,374,341 A 3/1968 Klotz
3,380,475 A 4/1968 Armstrong
3,385,386 A 5/1968 Goodwin et al.
3,389,759 A 6/1968 Mori et al.
3,416,614 A 12/1968 Goodwin et al.
3,424,255 A 1/1969 Mori et al.
3,469,642 A 9/1969 Goodwin et al.
3,542,142 A 11/1970 Hasiba et al.
3,548,959 A 12/1970 Hasiba et al.
3,576,221 A 4/1971 Hasiba
3,645,346 A 2/1972 Miller et al.
3,667,557 A 6/1972 Todd et al.
3,688,852 A 9/1972 Gaylord et al.
3,688,859 A 9/1972 Maurer
3,704,966 A 12/1972 Beck, Jr.
3,831,753 A 8/1974 Gaylord et al.
3,838,742 A 10/1974 Juvkam-Wold
3,852,200 A 12/1974 Meyer
3,865,202 A 2/1975 Takahashi et al.
3,924,698 A 12/1975 Juvkam-Wold
4,042,048 A 8/1977 Schwabe
4,067,617 A 1/1978 Bunnelle
4,141,592 A 2/1979 Lavon
4,266,621 A 5/1981 Brock
4,304,609 A 12/1981 Morris
4,361,193 A 11/1982 Gravley
4,391,339 A 7/1983 Johnson, Jr. et al.
4,444,277 A 4/1984 Lewis
4,476,027 A 10/1984 Fox
4,490,078 A * 12/1984 Armstrong ..... 406/114
4,492,276 A 1/1985 Kamp
4,497,598 A * 2/1985 Blanton ..... 406/114
4,534,427 A 8/1985 Wang et al.
4,624,327 A 11/1986 Reichman
4,627,502 A 12/1986 Dismukes
4,681,264 A 7/1987 Johnson
4,699,548 A * 10/1987 Bergstrom ..... 406/109
4,768,709 A 9/1988 Yie
4,809,791 A 3/1989 Hayatdavoudi
4,825,963 A 5/1989 Ruhle
4,852,668 A 8/1989 Dickinson, III et al.
5,199,512 A 4/1993 Curlett
5,291,957 A 3/1994 Curlett
5,355,967 A 10/1994 Mueller et al.
5,421,420 A 6/1995 Malone et al.
5,542,486 A 8/1996 Curlett
5,718,298 A 2/1998 Rusnak
5,862,871 A 1/1999 Curlett
5,881,830 A 3/1999 Cooley
5,897,062 A 4/1999 Enomoto et al.
5,944,123 A 8/1999 Johnson
6,003,623 A 12/1999 Miess
6,142,248 A 11/2000 Thigpen et al.
6,152,356 A 11/2000 Minden
6,345,672 B1 2/2002 Dietzen
6,347,675 B1 2/2002 Kolle
6,386,300 B1 5/2002 Curlett et al.
6,474,418 B2 11/2002 Miramon
6,506,310 B2 1/2003 Kulbeth
6,530,437 B2 3/2003 Maurer et al.
6,533,946 B2 3/2003 Pullman
6,571,700 B2 6/2003 Nakamura et al.
6,581,700 B2 6/2003 Curlett et al.
6,601,650 B2 8/2003 Sundararajan
6,651,822 B2 11/2003 Alanis
6,904,982 B2 * 6/2005 Judge et al. ..... 175/213
6,920,945 B1 7/2005 Belew et al.
7,090,017 B2 8/2006 Justus et al.
7,172,038 B2 2/2007 Terry et al.
7,258,176 B2 8/2007 Tibbitts et al.
7,343,987 B2 3/2008 Tibbitts
7,383,896 B2 6/2008 Tibbitts
7,398,838 B2 7/2008 Harder et al.
7,398,839 B2 7/2008 Harder et al.
7,503,407 B2 3/2009 Tibbitts
2002/0011338 A1 1/2002 Maurer et al.
2002/0134550 A1 9/2002 Leeson et al.
2006/0011386 A1 1/2006 Tibbitts
2006/0016622 A1 1/2006 Tibbitts
2006/0016624 A1 1/2006 Tibbitts
2006/0021798 A1 2/2006 Tibbitts
2006/0027398 A1 2/2006 Tibbitts et al.
2006/0124304 A1 6/2006 Bloess et al.
2006/0180350 A1 8/2006 Harder
2006/0191717 A1 8/2006 Harder et al.
2006/0191718 A1 8/2006 Harder et al.
2008/0017417 A1 1/2008 Tibbits
2008/0156545 A1 7/2008 Tibbitts
2008/0210472 A1 9/2008 Tibbitts
2008/0230275 A1 9/2008 Harder
2009/0038856 A1 2/2009 Vuyk
2009/0200080 A1 8/2009 Tibbitts
2009/0200084 A1 8/2009 Vuyk
2009/0205871 A1 8/2009 Tibbitts
2009/0223718 A1 9/2009 Tibbits

FOREIGN PATENT DOCUMENTS

CA 2588170 A1 5/2007
EP 0192016 A1 8/1986
GB 2385346 A 8/2003
GB 2385346 B 9/2004
IQ 20055376 11/2005
WO 0225053 A 3/2002
WO WO 02/25053 A1 3/2002
WO 0234653 A 5/2002
WO 0292956 A 11/2002
WO WO 2004/094734 A2 11/2004
WO WO 2004/106693 12/2004
WO 2006001997 A3 2/2006
WO 2009009792 1/2009
WO 2009049076 A1 4/2009
WO 2009065107 A1 5/2009
WO 2009099945 A2 8/2009

OTHER PUBLICATIONS

Cohen et al., "High-Pressure Jet Kerf Drilling Shows Significant Potential to Increase ROP," SPE 96557, Oct. 2005, 1-8.
Deep Drilling Basic Research Final Report, Jun. 1990.
Eckel et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling," Journal of Petroleum Technology, Aug. 1981, 1379-1388.
Galecki et al., "Steel Shot Entrained Ultra High Pressure Waterjet for Cutting and Drilling in Hard Rocks," 371-388.
Killalea, Mike, "High Pressure Drilling System Triples ROPS, Stymies Bit Wear," Drilling, Mar./Apr. 1989, 10-12.
Kolle et al., "Laboratory and Field Testing of an Ultra-High-Pressure, Jet-Assisted Drilling System," SPE/IADC 22000, 1991, 847-856.
Ledgerwood, L., "Efforts to Devlop Improved Oilwell Drilling Methods," Petroleum Transactions, Aime, 1960, 61-74, vol. 219.
Maurer, William, "Advanced Drilling Techniques," Chapter 5, 19-27, Petroleum Publishing Co., Tulsa, OK.
Maurer, William, "Impact Crater Formation in Rock," Journal of Applied Physics, Jul. 1960, 1247-1252, vol. 31, No. 7.
Peterson et al., "A New Look at Bit-Flushing,".
Review of Mechanical Bit/Rock Interactions, vol. 3, 3-1-3-68.

Ripkin et al., "A Study of the Fragmentation of Rock by Impingement with Water and Solid Impactors," University of Minnesota St. Anthony Falls Hydraulic Laboratory, Feb. 1972.
Security DBS, 1995.
Singh, Madan, "Rock Breakage by Pellet Impact," IIT Research Institute, Dec. 24, 1969.
Summers et al., "A Further Investigation of DIAjet Cutting," Jet Cutting Technology-Proceedings of the 10th International Conference, 1991, pp. 181-192; Elsevier Science Publishers Ltd, USA.
Summers, David, "Waterjetting Technology," Abrasive Waterjet Drilling, 557-598.
Veenhuizen, et al., "Ultra-High Pressure Jet Assist of Mechanical Drilling," SPE/IADC 37579, 79-90, 1997.
Co-pending U.S. Appl. No. 10/558,181, filed Nov. 22, 2005, Titled "System for Cutting Earthen Formations".
Co-pending U.S. Appl. No. 10/825,338, filed Apr. 15, 2004, Titled "Drill Bit".
Co-pending U.S. Appl. No. 10/897,196, filed Jul. 22, 2004, Titled "Impact Excavation System and Method".
Co-pending U.S. Appl. No. 11/204,436, filed Aug. 16, 2005, Titled "Internal Subs with Flow Control of Shot".
Co-pending U.S. Appl. No. 11/204,442, filed Aug. 16, 2005, Titled "Impact Excavation System and Method with Particle Trap".
Co-pending U.S. Appl. No. 11/204,722, filed Aug. 16, 2005, Titled "Shot Trap".
Co-pending U.S. Appl. No. 11/204,862, filed Aug. 16, 2005, Titled "PID Nozzles".
Co-pending U.S. Appl. No. 11/204,981, filed Aug. 16, 2005, Titled "Injector Systems".
International Search Report PCT/US04/11578; Dated Dec. 28, 2004.
International Preliminary Report of Patentability PCT/US04/11578; Dated Oct. 21, 2005.
Written Opinion PCT/US04/11578; Dated Dec. 28, 2004.
*Curlett Family Limited Partnership, Ltd., Plaintiff* V. *Particle Drilling Technologies, Inc., a Delaware Corporation; and Particle Drilling Technologies, Inc., a Nevada Corporation Defendant*; Civil Action No. 4:06-CV-01012; Affidavit of Harry (Hal) B. Curlett, May 3, 2006.
Geddes et al., "Leveraging a New Energy Source to Enhance Heavy-Oil and Oil-Sands Production," Society of Petroleum Engineers, SPE/PS-CIM/CHOA 97781, 2005.
www.particledrilling.com, May 4, 2006.
Co-pending U.S. Appl. No. 12/172,760, filed Jul. 14, 2008, Titled "Injection System and Method".
Co-pending U.S. Appl. No. 12/122,374, filed May 16, 2008, Titled "Impact Excavation System and Method With Injection System".
Co-pending U.S. Appl. No. 12/120,763, filed May 15, 2008, Titled "Impact Excavation System and Method With Particle Separation".
Co-pending U.S. Appl. No. 12/033,829, filed Feb. 19, 2008, Titled "Impact Excavation System and Method With Particle Separation".
Cohen et al, "High-Pressure Jet Kerf Drilling Shows Significant Potential to Increase ROP", SPE 96557, Oct. 2005, pp. 1-8.
Eckel, et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling", Journal of Petroleum Technology, Aug. 1981, pp. 1379-1388.
Galecki et al., "Steel Shot Entrained Ultra High Pressure Waterjet for Cutting and Drilling in Hard Rocks", pp. 371-388.
Killalea, Mike, High Pressure Drilling System Triples ROPS, Stymies Bit Wear, Drilling Technology, Mar.-Apr. 1989, pp. 10-12.
Kolle et al., "Laboratory and Field Testing of an Ultra-High-Pressure, Jet-Assisted Drilling System," SPE/IADC 22000, 1991, pp. 847-856.
Ledgerwood, L., "Efforts to Devlop Improved Oilwell Drilling Methods," Petroleum Transactions, Aime, 1960, 61-74, vol. 219. cited by other.
Maurer, William, "Advanced Drilling Techniques," Chapter 5, pp. 19-27, Petroleum Publishing Co., Tulsa, OK. 1980.
Maurer, William, "Impact Crater Formation in Rock," Journal of Applied Physics, Jul. 1960, pp. 1247-1252, vol. 31, No. 7.
Maurer et al., "Deep Drilling Basic Research vol. 1—Summary Report," Gas Research Institute, GRI 90/0265.1, Jun. 1990.
Peterson et al., "A New Look at Bit-Flushing or The Importance of the Crushed Zone in Rock Drilling and Cutting," (20 pages).
Ripken et al., "A Study of the Fragmentation of Rock by Impingement with Water and Solid Impactors," University of Minnesota St. Anthony Falls Hydraulic Laboratory, Feb. 1972, 114 pages.
Review of Mechanical Bit/Rock Interactions, vol. 3, pp. 3-1 to 3-68. Security DBS, 1995, (62 pages).
Singh, Madan, "Rock Breakage By Pellet Impact," IIT Research Institute, Dec. 24, 1969 (92 pages).
Summers et al., "A Further Investigation of DIAjet Cutting," Jet Cutting Technology-Proceedings of the 10th International Conference, 1991, pp. 181-192; Elsevier Science Publishers Ltd, USA.
Summers, David, "Waterjetting Technology," Abrasive Waterjet Drilling, pp. 557-598, Curators' Professor of Mining Engineering and Director High Pressure Waterjet Laboratory University of Missouri-Rolla Missouri, E & FN SPON, London, UK, First Edition 1995 (ISBN 0 419 19660 9).
Veenhuizen, et al., "Ultra-High Pressure Jet Assist of Mechanical Drilling," SPE/IADC 37579, pp. 79-90, 1997.
International Search Report PCT/US04/11578; dated Dec. 28, 2004 (4 pages).
International Preliminary Report of Patentability PCT/US04/11578; dated Oct. 21, 2005 (5 pages).
Written Opinion PCT/US04/11578; dated Dec. 28, 2004 (4 pages).
Examination Report dated May 8, 2007 on GCC Patent No. GCC/P/2004/3505 (4 pages).
Anderson, Arthur, "Global E&P Trends" Jul. 1999, (2 pages).
Office action from co-pending U.S. Appl. No. 11/204,862 dated Feb. 23, 2009 (9 pages).
U.S. Appl. No. 11/344,805, filed Feb. 1, 2006, Tibbits, co-pending application.
U.S. Appl. No. 11/801,268, filed May 9, 2007, Tibbits, co-pending application.
U.S. Appl. No. 11/773,355, filed Jul. 3, 2007, Vuyk, co-pending application.
U.S. Appl. No. 12/388,289, filed Feb. 18, 2009, Tibbits, co-pending application.
U.S. Appl. No. 12/271,514, filed Nov. 14, 2008, Tibbitts, co-pending application.
U.S. Appl. No. 12/363,022, filed Jan. 20, 2008, Tibbitts, co-pending application.
U.S. Appl. No. 12/248,649, filed Oct. 9, 2008, Vuyk, Jr., co-pending application.
International Search Report PCT/US05/25092; Dated Mar. 6, 2006.
Written Opinion PCT/US05/25092; Dated Mar. 6, 2006.
Examination Report dated Mar. 26, 2009 on EPO Application No. 04759869.3, 5 pages.
Behavior of Suspensions and Emulsion in Drilling Fluids, Nordic Rheology Society,Jun. 14-15, 2007.
Colby, R.H., Viscoelasticity of Structured Fluids, Corporate Research Laboratories, Eastman Kodak Company, Rochester, New York.
Rheo-Plex Product Information Sheet, Scomi Oiltools, 2 pages.
Gelplex Product Information Sheet, Miswaco, 2 pages.
Drilplex Product Information Sheet, Miswaco, 2 pages.
Drilplex System Successfully Mills Casing Windows Offshore Egypt Performance Report. Miswaco, 2 pages.
Drilplex The Versatile Water-Base System With Exceptional Rheological Properties Designed To Lower Costs In A Wide Range of Wells Product Information Sheet, Miswaco, 6 pages.
File history of European Patent Application No. 04759869.3.
File history of European Patent Application No. 5771403.2.
File history of GCC Patent Application No. 2005/5376.
File history of Iraq Patent Application No. 98/2005.
File history of Norwegian Patent Application No. 20070997.
File history of Venezuelan Patent Application No. 1484-05.
File history of Canadian Patent Application No. 2,588,170.
File history of Canadian Patent Application No. 2,522,568.
File history of Iraq Patent Application No. 34/2004.
File history of Norwegian Patent Application No. 20055409.
File history of GCC Patent Application No. 2004/3659.
International Preliminary Report on Patentability dated Nov. 19, 2009 on PCT/US08/05955, 5 pages.
International Preliminary Report on Patentability dated Jan. 12, 2010 on PCT/US08/69972, 5 pages.

* cited by examiner

| OPERATION OF INJECTOR VESSELS | | | |
|---|---|---|---|
| TIME PERIOD | INJECTOR VESSEL 324 | INJECTOR VESSEL 350 | INJECTOR VESSEL 374 |
| TIME 1 | CHARGING | | |
| TIME 2 | PRESSURIZING | CHARGING | |
| TIME 3 | INJECTING | PRESSURIZING | CHARGING |
| TIME 4 | CHARGING | INJECTING | PRESSURIZING |
| TIME 5 | PRESSURIZING | CHARGING | INJECTING |
| TIME 6 | INJECTING | PRESSURIZING | CHARGING |
| TIME 7 | CHARGING | INJECTING | PRESSURIZING |
| TIME 8 | PRESSURIZING | CHARGING | INJECTING |
| | ⋮ | ⋮ | ⋮ |

*Fig. 22*

IMPACT EXCAVATION SYSTEM AND METHOD WITH INJECTION SYSTEM

CROSS-REFERENCE TO RELATED APPLICATIONS

This application is a continuation-in-part of pending application Ser. No. 10/897,196, filed Jul. 22, 2004 which, in turn, is a continuation-in-part of pending application Ser. No. 10/825,338, filed Apr. 15, 2004, which, in turn, claims the benefit of 35 U.S.C. 111(b) provisional application Ser. No. 60/463,903, filed Apr. 16, 2003, the disclosures of which are incorporated herein by reference.

BACKGROUND

This disclosure relates to a system and method for excavating a formation, such as to form a well bore for the purpose of oil and gas recovery, to construct a tunnel, or to form other excavations in which the formation is cut, milled, pulverized, scraped, sheared, indented, and/or fractured, (hereinafter referred to collectively as "cutting"). The cutting process is a very interdependent process that preferably integrates and considers many variables to ensure that a usable bore is constructed. As is commonly known in the art, many variables have an interactive and cumulative effect of increasing cutting costs. These variables may include formation hardness, abrasiveness, pore pressures, and formation elastic properties. In drilling wellbores, formation hardness and a corresponding degree of drilling difficulty may increase exponentially as a function of increasing depth. A high percentage of the costs to drill a well are derived from interdependent operations that are time sensitive, i.e., the longer it takes to penetrate the formation being drilled, the more it costs. One of the most important factors affecting the cost of drilling a wellbore is the rate at which the formation can be penetrated by the drill bit, which typically decreases with harder and tougher formation materials and formation depth.

There are generally two categories of modern drill bits that have evolved from over a hundred years of development and untold amounts of dollars spent on the research, testing and iterative development. These are the commonly known as the fixed cutter drill bit and the roller cone drill bit. Within these two primary categories, there are a wide variety of variations, with each variation designed to drill a formation having a general range of formation properties. These two categories of drill bits generally constitute the bulk of the drill bits employed to drill oil and gas wells around the world.

Each type of drill bit is commonly used where its drilling economics are superior to the other. Roller cone drill bits can drill the entire hardness spectrum of rock formations. Thus, roller cone drill bits are generally run when encountering harder rocks where long bit life and reasonable penetration rates are important factors on the drilling economics. Fixed cutter drill bits, on the other hand, are used to drill a wide variety of formations ranging from unconsolidated and weak rocks to medium hard rocks.

In the case of creating a borehole with a roller cone type drill bit, several actions effecting rate of penetration (ROP) and bit efficiency may be occurring. The roller cone bit teeth may be cutting, milling, pulverizing, scraping, shearing, sliding over, indenting, and fracturing the formation the bit is encountering. The desired result is that formation cuttings or chips are generated and circulated to the surface by the drilling fluid. Other factors may also affect ROP, including formation structural or rock properties, pore pressure, temperature, and drilling fluid density. When a typical roller cone rock bit tooth presses upon a very hard, dense, deep formation, the tooth point may only penetrate into the rock a very small distance, while also at least partially, plastically "working" the rock surface.

One attempt to increase the effective rate of penetration (ROP) involved high-pressure circulation of a drilling fluid as a foundation for potentially increasing ROP. It is common knowledge that hydraulic power available at the rig site vastly outweighs the power available to be employed mechanically at the drill bit. For example, modern drilling rigs capable of drilling a deep well typically have in excess of 3000 hydraulic horsepower available and can have in excess of 6000 hydraulic horsepower available while less than one-tenth of that hydraulic horsepower may be available at the drill bit. Mechanically, there may be less than 100 horsepower available at the bit/rock interface with which to mechanically drill the formation.

An additional attempt to increase ROP involved incorporating entrained abrasives in conjunction with high pressure drilling fluid ("mud"). This resulted in an abrasive laden, high velocity jet assisted drilling process. Work done by Gulf Research and Development disclosed the use of abrasive laden jet streams to cut concentric grooves in the bottom of the hole leaving concentric ridges that are then broken by the mechanical contact of the drill bit. Use of entrained abrasives in conjunction with high drilling fluid pressures caused accelerated erosion of surface equipment and an inability to control drilling mud density, among other issues. Generally, the use of entrained abrasives was considered practically and economically unfeasible. This work was summarized in the last published article titled "Development of High Pressure Abrasive-Jet Drilling," authored by John C. Fair, Gulf Research and Development. It was published in the Journal of Petroleum Technology in the May 1981 issue, pages 1379 to 1388.

Another effort to utilize the hydraulic horsepower available at the bit incorporated the use of ultra-high pressure jet assisted drilling. A group known as FlowDril Corporation was formed to develop an ultra-high-pressure liquid jet drilling system in an attempt to increase the rate of penetration. The work was based upon U.S. Pat. No. 4,624,327 and is documented in the published article titled "Laboratory and Field Testing of an Ultra-High Pressure, Jet-Assisted Drilling System" authored by J. J. Kolle, Quest Integrated Inc., and R. Otta and D. L. Stang, FlowDril Corporation; published by SPE/IADC Drilling Conference publications paper number 22000. The cited publication disclosed that the complications of pumping and delivering ultrahigh-pressure fluid from surface pumping equipment to the drill bit proved both operationally and economically unfeasible.

Another effort at increasing rates of penetration by taking advantage of hydraulic horsepower available at the bit is disclosed in U.S. Pat. No. 5,862,871. This development employed the use of a specialized nozzle to excite normally pressured drilling mud at the drill bit. The purpose of this nozzle system was to develop local pressure fluctuations and a high speed, dual jet form of hydraulic jet streams to more effectively scavenge and clean both the drill bit and the formation being drilled. It is believed that these hydraulic jets were able to penetrate the fracture plane generated by the mechanical action of the drill bit in a much more effective manner than conventional jets were able to do. ROP increases from 50% to 400% were field demonstrated and documented in the field reports titled "DualJet Nozzle Field Test Report-Security DBS/Swift Energy Company," and "DualJet Nozzle Equipped M-1LRG Drill Bit Run". The ability of the dual jet ("DualJet") nozzle system to enhance the effectiveness of the drill bit action to increase the ROP required that the drill bits first initiate formation indentations, fractures, or both. These features could then be exploited by the hydraulic action of the DualJet nozzle system.

Due at least partially to the effects of overburden pressure, formations at deeper depths may be inherently tougher to drill due to changes in formation pressures and rock properties, including hardness and abrasiveness. Associated in-situ forces, rock properties, and increased drilling fluid density effects may set up a threshold point at which the drill bit drilling mechanics decrease the drilling efficiency.

Another factor adversely effecting ROP in formation drilling, especially in plastic type rock drilling, such as shale or permeable formations, is a build-up of hydraulically isolated crushed rock material, that can become either mass of reconstituted drill cuttings or a "dynamic filtercake", on the surface being drilled, depending on the formation permeability. In the case of low permeability formations, this occurrence is predominantly a result of repeated impacting and re-compacting of previously drilled particulate material on the bottom of the hole by the bit teeth, thereby forming a false bottom. The substantially continuous process of drilling, re-compacting, removing, re-depositing and re-compacting, and drilling new material may significantly adversely effect drill bit efficiency and ROP. The re-compacted material is at least partially removed by mechanical displacement due to the cone skew of the roller cone type drill bits and partially removed by hydraulics, again emphasizing the importance of good hydraulic action and hydraulic horsepower at the bit. For hard rock bits, build-up removal by cone skew is typically reduced to near zero, which may make build-up removal substantially a function of hydraulics. In permeable formations the continuous deposition and removal of the fine cuttings forms a dynamic filtercake that can reduce the spurt loss and therefore the pore pressure in the working area of the bit. Because the pore pressure is reduced and mechanical load is increased from the pressure drop across the dynamic filtercake, drilling efficiency can be reduced.

There are many variables to consider to ensure a usable well bore is constructed when using cutting systems and processes for the drilling of well bores or the cutting of formations for the construction of tunnels and other subterranean earthen excavations. Many variables, such as formation hardness, abrasiveness, pore pressures, and formation elastic properties affect the effectiveness of a particular drill bit in drilling a well bore. Additionally, in drilling well bores, formation hardness and a corresponding degree of drilling difficulty may increase exponentially as a function of increasing depth. The rate at which a drill bit may penetrate the formation typically decreases with harder and tougher formation materials and formation depth.

When the formation is relatively soft, as with shale, material removed by the drill bit will have a tendency to reconstitute onto the teeth of the drill bit. Build-up of the reconstituted formation on the drill bit is typically referred to as "bit balling" and reduces the depth that the teeth of the drill bit will penetrate the bottom surface of the well bore, thereby reducing the efficiency of the drill bit. Particles of a shale formation also tend to reconstitute back onto the bottom surface of the bore hole. The reconstitution of a formation back onto the bottom surface of the bore hole is typically referred to as "bottom balling". Bottom balling prevents the teeth of a drill bit from engaging virgin formation and spreads the impact of a tooth over a wider area, thereby also reducing the efficiency of a drill bit. Additionally, higher density drilling muds that are required to maintain well bore stability or well bore pressure control exacerbate bit balling and the bottom balling problems.

When the drill bit engages a formation of a harder rock, the teeth of the drill bit press against the formation and densify a small area under the teeth to cause a crack in the formation. When the porosity of the formation is collapsed, or densified, in a hard rock formation below a tooth, conventional drill bit nozzles ejecting drilling fluid are used to remove the crushed material from below the drill bit. As a result, a cushion, or densification pad, of densified material is left on the bottom surface by the prior art drill bits. If the densification pad is left on the bottom surface, force by a tooth of the drill bit will be distributed over a larger area and reduce the effectiveness of a drill bit.

There are generally two main categories of modern drill bits that have evolved over time. These are the commonly known fixed cutter drill bit and the roller cone drill bit. Additional categories of drilling include percussion drilling and mud hammers. However, these methods are not as widely used as the fixed cutter and roller cone drill bits. Within these two primary categories (fixed cutter and roller cone), there are a wide variety of variations, with each variation designed to drill a formation having a general range of formation properties.

The fixed cutter drill bit and the roller cone type drill bit generally constitute the bulk of the drill bits employed to drill oil and gas wells around the world. When a typical roller cone rock bit tooth presses upon a very hard, dense, deep formation, the tooth point may only penetrate into the rock a very small distance, while also at least partially, plastically "working" the rock surface. Under conventional drilling techniques, such working the rock surface may result in the densification as noted above in hard rock formations.

With roller cone type drilling bits, a relationship exists between the number of teeth that impact upon the formation and the drilling RPM of the drill bit. A description of this relationship and an approach to improved drilling technology is set forth and described in U.S. Pat. No. 6,386,300 issued May 14, 2002. The '300 patent discloses the use of solid material impactors introduced into drilling fluid and pumped though a drill string and drill bit to contact the rock formation ahead of the drill bit. The kinetic energy of the impactors leaving the drill bit is given by the following equation: $E_k = \frac{1}{2}\,\text{Mass}(\text{Velocity})^2$. The mass and/or velocity of the impactors may be chosen to satisfy the mass-velocity relationship in order to structurally alter the rock formation.

BRIEF DESCRIPTION OF THE DRAWINGS

FIG. 22 is a diagrammatic view depicting the operational steps of one possible mode of operation of the injection system of FIG. 21;

DETAILED DESCRIPTION

Figure 1:
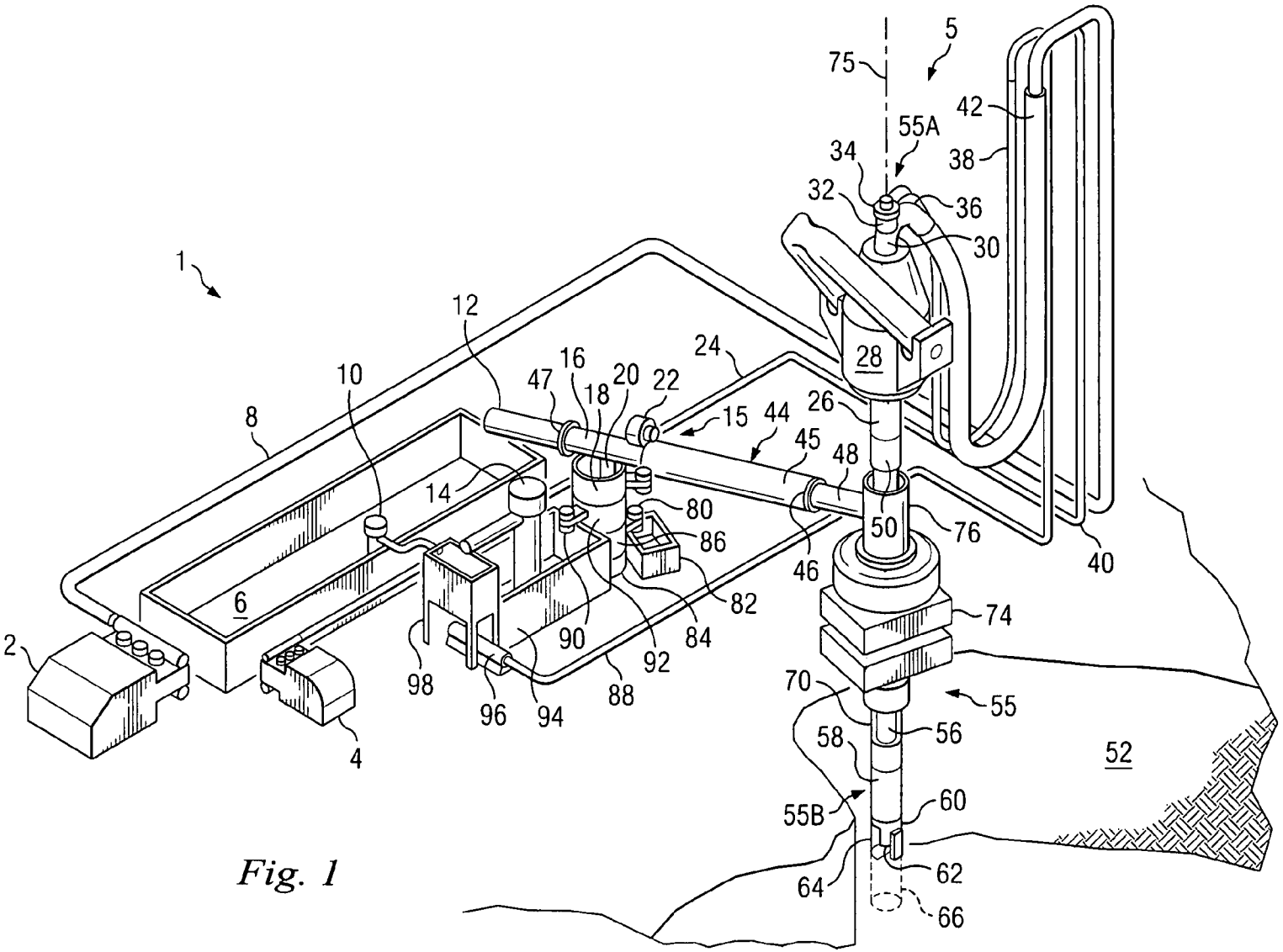
FIG. 1 is an isometric view of an excavation system as used in a preferred embodiment.

In the drawings and description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Figure 2:
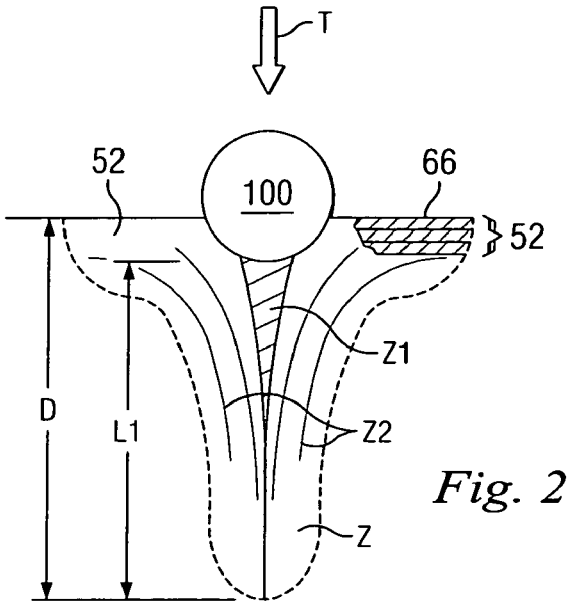
FIG. 2 illustrates an impactor impacted with a formation.

FIGS. 1 and 2 illustrate an embodiment of an excavation system 1 comprising the use of solid material particles, or impactors, 100 to engage and excavate a subterranean formation 52 to create a wellbore 70. The excavation system 1 may comprise a pipe string 55 comprised of collars 58, pipe 56, and a kelly 50. An upper end of the kelly 50 may interconnect with a lower end of a swivel quill 26. An upper end of the swivel quill 26 may be rotatably interconnected with a swivel 28. The swivel 28 may include a top drive assembly (not shown) to rotate the pipe string 55. Alternatively, the excavation system 1 may further comprise a drill bit 60 to cut the formation 52 in cooperation with the solid material impactors 100. The drill bit 60 may be attached to the lower end 55B of the pipe string 55 and may engage a bottom surface 66 of the wellbore 70. The drill bit 60 may be a roller cone bit, a fixed cutter bit, an impact bit, a spade bit, a mill, an impregnated bit, a natural diamond bit, or other suitable implement for cutting rock or earthen formation. Referring to FIG. 1, the pipe string 55 may include a feed, or upper, end 55A located substantially near the excavation rig 5 and a lower end 55B including a nozzle 64 supported thereon. The lower end 55B of the string 55 may include the drill bit 60 supported thereon. The excavation system 1 is not limited to excavating a wellbore 70. The excavation system and method may also be applicable to excavating a tunnel, a pipe chase, a mining operation, or other excavation operation wherein earthen material or formation may be removed.

To excavate the wellbore 70, the swivel 28, the swivel quill 26, the kelly 50, the pipe string 55, and a portion of the drill bit 60, if used, may each include an interior passage that allows circulation fluid to circulate through each of the aforementioned components. The circulation fluid may be withdrawn from a tank 6, pumped by a pump 2, through a through medium pressure capacity line 8, through a medium pressure capacity flexible hose 42, through a gooseneck 36, through the swivel 28, through the swivel quill 26, through the kelly 50, through the pipe string 55, and through the bit 60.

The excavation system 1 further comprises at least one nozzle 64 on the lower 55B of the pipe string 55 for accelerating at least one solid material impactor 100 as they exit the pipe string 100. The nozzle 64 is designed to accommodate the impactors 100, such as an especially hardened nozzle, a shaped nozzle, or an "impactor" nozzle, which may be particularly adapted to a particular application. The nozzle 64 may be a type that is known and commonly available. The nozzle 64 may further be selected to accommodate the impactors 100 in a selected size range or of a selected material composition. Nozzle size, type, material, and quantity may be a function of the formation being cut, fluid properties, impactor properties, and/or desired hydraulic energy expenditure at the nozzle 64. If a drill bit 60 is used, the nozzle or nozzles 64 may be located in the drill bit 60.

The nozzle 64 may alternatively be a conventional dual-discharge nozzle. Such dual discharge nozzles may generate: (1) a radially outer circulation fluid jet substantially encircling a jet axis, and/or (2) an axial circulation fluid jet substantially aligned with and coaxial with the jet axis, with the dual discharge nozzle directing a majority by weight of the plurality of solid material impactors into the axial circulation fluid jet. A dual discharge nozzle 64 may separate a first portion of the circulation fluid flowing through the nozzle 64 into a first circulation fluid stream having a first circulation fluid exit nozzle velocity, and a second portion of the circulation fluid flowing through the nozzle 64 into a second circulation fluid stream having a second circulation fluid exit nozzle velocity lower than the first circulation fluid exit nozzle velocity. The plurality of solid material impactors 100 may be directed into the first circulation fluid stream such that a velocity of the plurality of solid material impactors 100 while exiting the nozzle 64 is substantially greater than a velocity of the circulation fluid while passing through a nominal diameter flow path in the lower end 55B of the pipe string 55, to accelerate the solid material impactors 100.

Each of the individual impactors 100 is structurally independent from the other impactors. For brevity, the plurality of solid material impactors 100 may be interchangeably referred to as simply the impactors 100. The plurality of solid material impactors 100 may be substantially rounded and have either a substantially non-uniform outer diameter or a substantially uniform outer diameter. The solid material impactors 100 may be substantially spherically shaped, non-hollow, formed of rigid metallic material, and having high compressive strength and crush resistance, such as steel shot, ceramics, depleted uranium, and multiple component materials. Although the solid material impactors 100 may be substantially a non-hollow sphere, alternative embodiments may provide for other types of solid material impactors, which may include impactors 100 with a hollow interior. The impactors may be substantially rigid and may possess relatively high compressive strength and resistance to crushing or deformation as compared to physical properties or rock properties of a particular formation or group of formations being penetrated by the wellbore 70.

The impactors may be of a substantially uniform mass, grading, or size. The solid material impactors 100 may have any suitable density for use in the excavation system 1. For example, the solid material impactors 100 may have an average density of at least 470 pounds per cubic foot.

Alternatively, the solid material impactors 100 may include other metallic materials, including tungsten carbide, copper, iron, or various combinations or alloys of these and other metallic compounds. The impactors 100 may also be composed of non-metallic materials, such as ceramics, or other man-made or substantially naturally occurring non-metallic materials. Also, the impactors 100 may be crystalline shaped, angular shaped, sub-angular shaped, selectively shaped, such as like a torpedo, dart, rectangular, or otherwise generally non-spherically shaped.

The impactors 100 may be selectively introduced into a fluid circulation system, such as illustrated in FIG. 1, near an excavation rig 5, circulated with the circulation fluid (or "mud"), and accelerated through at least one nozzle 64. "At the excavation rig" or "near an excavation rig" may also include substantially remote separation, such as a separation process that may be at least partially carried out on the sea floor.

Introducing the impactors 100 into the circulation fluid may be accomplished by any of several known techniques. For example, the impactors 100 may be provided in an impactor storage tank 94 near the rig 5 or in a storage bin 82. A screw elevator 14 may then transfer a portion of the impactors at a selected rate from the storage tank 94, into a slurrification tank 98. A pump 10, such as a progressive cavity pump may transfer a selected portion of the circulation fluid from a mud tank 6, into the slurrification tank 98 to be mixed with the impactors 100 in the tank 98 to form an impactor concentrated slurry. An impactor introducer 96 may be included to pump or introduce a plurality of solid material impactors 100 into the circulation fluid before circulating a plurality of impactors 100 and the circulation fluid to the nozzle 64. The impactor introducer 96 may be a progressive cavity pump capable of pumping the impactor concentrated slurry at a selected rate and pressure through a slurry line 88, through a slurry hose 38, through an impactor slurry injector head 34, and through an injector port 30 located on the gooseneck 36, which may be located atop the swivel 28. The swivel 36, including the through bore for conducting circulation fluid therein, may be substantially supported on the feed, or upper, end of the pipe string 55 for conducting circulation fluid from the gooseneck 36 into the latter end 55*a*. The upper end 55A of the pipe string 55 may also include the kelly 50 to connect the pipe 56 with the swivel quill 26 and/or the swivel 28. The circulation fluid may also be provided with rheological properties sufficient to adequately transport and/or suspend the plurality of solid material impactors 100 within the circulation fluid.

The solid material impactors 100 may also be introduced into the circulation fluid by withdrawing the plurality of solid material impactors 100 from a low pressure impactor source 98 into a high velocity stream of circulation fluid, such as by venturi effect. For example, when introducing impactors 100 into the circulation fluid, the rate of circulation fluid pumped by the mud pump 2 may be reduced to a rate lower than the mud pump 2 is capable of efficiently pumping. In such event, a lower volume mud pump 4 may pump the circulation fluid through a medium pressure capacity line 24 and through the medium pressure capacity flexible hose 40.

The circulation fluid may be circulated from the fluid pump 2 and/or 4, such as a positive displacement type fluid pump, through one or more fluid conduits 8, 24, 40, 42, into the pipe string 55. The circulation fluid may then be circulated through the pipe string 55 and through the nozzle 64. The circulation fluid may be pumped at a selected circulation rate and/or a selected pump pressure to achieve a desired impactor and/or fluid energy at the nozzle 64.

The pump 4 may also serve as a supply pump to drive the introduction of the impactors 100 entrained within an impactor slurry, into the high pressure circulation fluid stream pumped by mud pumps 2 and 4. Pump 4 may pump a percentage of the total rate of fluid being pumped by both pumps 2 and 4, such that the circulation fluid pumped by pump 4 may create a venturi effect and/or vortex within the injector head 34 that inducts the impactor slurry being conducted through the line 42, through the injector head 34, and then into the high pressure circulation fluid stream.

From the swivel 28, the slurry of circulation fluid and impactors may circulate through the interior passage in the pipe string 55 and through the nozzle 64. As described above, the nozzle 64 may alternatively be at least partially located in the drill bit 60. Each nozzle 64 may include a reduced inner diameter as compared to an inner diameter of the interior passage in the pipe string 55 immediately above the nozzle 64. Thereby, each nozzle 64 may accelerate the velocity of the slurry as the slurry passes through the nozzle 64. The nozzle 64 may also direct the slurry into engagement with a selected portion of the bottom surface 66 of wellbore 70. The nozzle 64 may also be rotated relative to the formation 52 depending on the excavation parameters. To rotate the nozzle 64, the entire pipe string 55 may be rotated or only the nozzle 64 on the end of the pipe string 55 may be rotated while the pipe string 55 is not rotated. Rotating the nozzle 64 may also include oscillating the nozzle 64 rotationally back and forth as well as vertically, and may further include rotating the nozzle 64 in discrete increments. The nozzle 64 may also be maintained rotationally substantially stationary.

The circulation fluid may be substantially continuously circulated during excavation operations to circulate at least some of the plurality of solid material impactors 100 and the formation cuttings away from the nozzle 64. The impactors 100 and fluid circulated away from the nozzle 64 may be circulated substantially back to the excavation rig 5, or circulated to a substantially intermediate position between the excavation rig 5 and the nozzle 64.

If a drill bit 60 is used, the drill bit 60 may be rotated relative to the formation 52 and engaged therewith by an axial force (WOB) acting at least partially along the wellbore axis 75 near the drill bit 60. The bit 60 may also comprise a plurality of bit cones 62, which also may rotate relative to the bit 60 to cause bit teeth secured to a respective cone to engage the formation 52, which may generate formation cuttings substantially by crushing, cutting, or pulverizing a portion of the formation 52. The bit 60 may also be comprised of a fixed cutting structure that may be substantially continuously engaged with the formation 52 and create cuttings primarily by shearing and/or axial force concentration to fail the formation, or create cuttings from the formation 52. To rotate the bit 60, the entire pipe string 55 may be rotated or only the bit 60 on the end of the pipe string 55 may be rotated while the pipe string 55 is not rotated. Rotating the drill bit 60 may also include oscillating the drill bit 60 rotationally back and forth as well as vertically, and may further include rotating the drill bit 60 in discrete increments.

Also alternatively, the excavation system 1 may comprise a pump, such as a centrifugal pump, having a resilient lining that is compatible for pumping a solid-material laden slurry. The pump may pressurize the slurry to a pressure greater than the selected mud pump pressure to pump the plurality of solid material impactors 100 into the circulation fluid. The impactors 100 may be introduced through an impactor injection port, such as port 30. Other alternative embodiments for the system 1 may include an impactor injector for introducing the plurality of solid material impactors 100 into the circulation fluid.

As the slurry is pumped through the pipe string 55 and out the nozzles 64, the impactors 100 may engage the formation with sufficient energy to enhance the rate of formation removal or penetration (ROP). The removed portions of the formation may be circulated from within the wellbore 70 near the nozzle 64, and carried suspended in the fluid with at least a portion of the impactors 100, through a wellbore annulus between the OD of the pipe string 55 and the ID of the wellbore 70.

At the excavation rig 5, the returning slurry of circulation fluid, formation fluids (if any), cuttings, and impactors 100 may be diverted at a nipple 76, which may be positioned on a BOP stack 74. The returning slurry may flow from the nipple 76, into a return flow line 15, which may be comprised of tubes 48, 45, 16, 12 and flanges 46, 47. The return line 15 may include an impactor reclamation tube assembly 44, as illustrated in FIG. 1, which may preliminarily separate a majority of the returning impactors 100 from the remaining components of the returning slurry to salvage the circulation fluid for recirculation into the present wellbore 70 or another wellbore. At least a portion of the impactors 100 may be separated from a portion of the cuttings by a series of screening devices, such as the vibrating classifiers 84, to salvage a reusable portion of the impactors 100 for reuse to re-engage the formation 52. A majority of the cuttings and a majority of non-reusable impactors 100 may also be discarded.

The reclamation tube assembly 44 may operate by rotating tube 45 relative to tube 16. An electric motor assembly 22 may rotate tube 44. The reclamation tube assembly 44 comprises an enlarged tubular 45 section to reduce the return flow slurry velocity and allow the slurry to drop below a terminal velocity of the impactors 100, such that the impactors 100 can no longer be suspended in the circulation fluid and may gravitate to a bottom portion of the tube 45. This separation function may be enhanced by placement of magnets near and along a lower side of the tube 45. The impactors 100 and some of the larger or heavier cuttings may be discharged through discharge port 20. The separated and discharged impactors 100 and solids discharged through discharge port 20 may be gravitationally diverted into a vibrating classifier 84 or may be pumped into the classifier 84. A pump (not shown) capable of handling impactors and solids, such as a progressive cavity pump may be situated in communication with the flow line discharge port 20 to conduct the separated impactors 100 selectively into the vibrating separator 84 or elsewhere in the circulation fluid circulation system.

The vibrating classifier 84 may comprise a three-screen section classifier of which screen section 18 may remove the coarsest grade material. The removed coarsest grade material may be selectively directed by outlet 78 to one of storage bin 82 or pumped back into the flow line 15 downstream of discharge port 20. A second screen section 92 may remove a re-usable grade of impactors 100, which in turn may be directed by outlet 90 to the impactor storage tank 94. A third screen section 86 may remove the finest grade material from the circulation fluid. The removed finest grade material may be selectively directed by outlet 80 to storage bin 82, or pumped back into the flow line 15 at a point downstream of discharge port 20. Circulation fluid collected in a lower portion of the classified 84 may be returned to a mud tank 6 for re-use.

The circulation fluid may be recovered for recirculation in a wellbore or the circulation fluid may be a fluid that is substantially not recovered. The circulation fluid may be a liquid, gas, foam, mist, or other substantially continuous or multiphase fluid. For recovery, the circulation fluid and other components entrained within the circulation fluid may be directed across a shale shaker (not shown) or into a mud tank 6, whereby the circulation fluid may be further processed for re-circulation into a wellbore.

The excavation system 1 creates a mass-velocity relationship in a plurality of the solid material impactors 100, such that an impactor 100 may have sufficient energy to structurally alter the formation 52 in a zone of a point of impact. The mass-velocity relationship may be satisfied as sufficient when a substantial portion by weight of the solid material impactors 100 may by virtue of their mass and velocity at the exit of the nozzle 64, create a structural alteration as claimed or disclosed herein. Impactor velocity to achieve a desired effect upon a given formation may vary as a function of formation compressive strength, hardness, or other rock properties, and as a function of impactor size and circulation fluid rheological properties. A substantial portion means at least five percent by weight of the plurality of solid material impactors that are introduced into the circulation fluid.

The impactors 100 for a given velocity and mass of a substantial portion by weight of the impactors 100 are subject to the following mass-velocity relationship. The resulting kinetic energy of at least one impactor 100 exiting a nozzle 64 is at least 0.075 Ft·Lbs or has a minimum momentum of 0.0003 Lbf·Sec.

Kinetic energy is quantified by the relationship of an object's mass and its velocity. The quantity of kinetic energy associated with an object is calculated by multiplying its mass times its velocity squared. To reach a minimum value of kinetic energy in the mass-velocity relationship as defined, small particles such as those found in abrasives and grits, must have a significantly high velocity due to the small mass of the particle. A large particle, however, needs only moderate velocity to reach an equivalent kinetic energy of the small particle because its mass may be several orders of magnitude larger.

The velocity of a substantial portion by weight of the plurality of solid material impactors 100 immediately exiting a nozzle 64 may be as slow as 100 feet per second and as fast as 1000 feet per second, immediately upon exiting the nozzle 64.

The velocity of a majority by weight of the impactors 100 may be substantially the same, or only slightly reduced, at the point of impact of an impactor 100 at the formation surface 66 as compared to when leaving the nozzle 64. Thus, it may be appreciated by those skilled in the art that due to the close proximity of a nozzle 64 to the formation being impacted, the velocity of a majority of impactors 100 exiting a nozzle 64 may be substantially the same as a velocity of an impactor 100 at a point of impact with the formation 52. Therefore, in many practical applications, the above velocity values may be determined or measured at substantially any point along the path between near an exit end of a nozzle 64 and the point of impact, without material deviation from the scope of this invention.

In addition to the impactors 100 satisfying the mass-velocity relationship described above, a substantial portion by weight of the solid material impactors 100 have an average mean diameter of between approximately 0.050 to 0.500 of an inch.

To excavate a formation 52, the excavation implement, such as a drill bit 60 or impactor 100, must overcome minimum, in-situ stress levels or toughness of the formation 52. These minimum stress levels are known to typically range from a few thousand pounds per square inch, to in excess of 65,000 pounds per square inch. To fracture, cut, or plastically deform a portion of formation 52, force exerted on that portion of the formation 52 typically should exceed the minimum, in-situ stress threshold of the formation 52. When an impactor 100 first initiates contact with a formation, the unit stress exerted upon the initial contact point may be much higher than 10,000 pounds per square inch, and may be well in excess of one million pounds per square inch. The stress applied to the formation 52 during contact is governed by the force the impactor 100 contacts the formation with and the area of contact of the impactor with the formation. The stress is the force divided by the area of contact. The force is governed by Impulse Momentum theory whereby the time at which the contact occurs determines the magnitude of the force applied to the area of contact. In cases where the particle is contacting a relatively hard surface at an elevated velocity, the force of the particle when in contact with the surface is not constant, but is better described as a spike. However, the force need not be limited to any specific amplitude or duration. The magnitude of the spike load can be very large and occur in just a small fraction of the total impact time. If the area of contact is small the unit stress can reach values many times in excess of the in situ failure stress of the rock, thus guaranteeing fracture initiation and propagation and structurally altering the formation 52.

A substantial portion by weight of the solid material impactors 100 may apply at least 5000 pounds per square inch of unit stress to a formation 52 to create the structurally altered zone Z in the formation. The structurally altered zone Z is not limited to any specific shape or size, including depth or width. Further, a substantial portion by weight of the impactors 100 may apply in excess of 20,000 pounds per square inch of unit stress to the formation 52 to create the structurally altered zone Z in the formation. The mass-velocity relationship of a substantial portion by weight of the plurality of solid material impactors 100 may also provide at least 30,000 pounds per square inch of unit stress.

A substantial portion by weight of the solid material impactors 100 may have any appropriate velocity to satisfy the mass-velocity relationship. For example, a substantial portion by weight of the solid material impactors may have a velocity of at least 100 feet per second when exiting the nozzle 64. A substantial portion by weight of the solid material impactors 100 may also have a velocity of at least 100 feet per second and as great as 1200 feet per second when exiting the nozzle 64. A substantial portion by weight of the solid material impactors 100 may also have a velocity of at least 100 feet per second and as great as 750 feet per second when exiting the nozzle 64. A substantial portion by weight of the solid material impactors 100 may also have a velocity of at least 350 feet per second and as great as 500 feet per second when exiting the nozzle 64.

Impactors 100 may be selected based upon physical factors such as size, projected velocity, impactor strength, formation 52 properties and desired impactor concentration in the circulation fluid. Such factors may also include; (a) an expenditure of a selected range of hydraulic horsepower across the one or more nozzles, (b) a selected range of circulation fluid velocities exiting the one or more nozzles or impacting the formation, and (c) a selected range of solid material impactor velocities exiting the one or more nozzles or impacting the formation, (d) one or more rock properties of the formation being excavated, or (e), any combination thereof.

If an impactor 100 is of a specific shape such as that of a dart, a tapered conic, a rhombic, an octahedral, or similar oblong shape, a reduced impact area to impactor mass ratio may be achieved. The shape of a substantial portion by weight of the impactors 100 may be altered, so long as the mass-velocity relationship remains sufficient to create a claimed structural alteration in the formation and an impactor 100 does not have any one length or diameter dimension greater than approximately 0.100 inches. Thereby, a velocity required to achieve a specific structural alteration may be reduced as compared to achieving a similar structural alteration by impactor shapes having a higher impact area to mass ratio. Shaped impactors 100 may be formed to substantially align themselves along a flow path, which may reduce variations in the angle of incidence between the impactor 100 and the formation 52. Such impactor shapes may also reduce impactor contact with the flow structures such those in the pipe string 55 and the excavation rig 5 and may thereby minimize abrasive erosion of flow conduits.

Referring to FIGS. 1-4, a substantial portion by weight of the impactors 100 may engage the formation 52 with sufficient energy to enhance creation of a wellbore 70 through the formation 52 by any or a combination of different impact mechanisms. First, an impactor 100 may directly remove a larger portion of the formation 52 than may be removed by abrasive-type particles. In another mechanism, an impactor 100 may penetrate into the formation 52 without removing formation material from the formation 52. A plurality of such formation penetrations, such as near and along an outer perimeter of the wellbore 70 may relieve a portion of the stresses on a portion of formation being excavated, which may thereby enhance the excavation action of other impactors 100 or the drill bit 60. Third, an impactor 100 may alter one or more physical properties of the formation 52. Such physical alterations may include creation of micro-fractures and increased brittleness in a portion of the formation 52, which may thereby enhance effectiveness the impactors 100 in excavating the formation 52. The constant scouring of the bottom of the borehole also prevents the build up of dynamic filter-cake, which can significantly increase the apparent toughness of the formation 52.

FIG. 2 illustrates an impactor 100 that has been impaled into a formation 52, such as a lower surface 66 in a wellbore 70. For illustration purposes, the surface 66 is illustrated as substantially planar and transverse to the direction of impactor travel 100*a*. The impactors 100 circulated through a nozzle 64 may engage the formation 52 with sufficient energy to effect one or more properties of the formation 52.

A portion of the formation 52 ahead of the impactor 100 substantially in the direction of impactor travel T may be altered such as by micro-fracturing and/or thermal alteration due to the impact energy. In such occurrence, the structurally altered zone Z may include an altered zone depth D. An example of a structurally altered zone Z is a compressive zone Z1, which may be a zone in the formation 52 compressed by the impactor 100. The compressive zone Z1 may have a length L1, but is not limited to any specific shape or size. The compressive zone Z1 may be thermally altered due to impact energy.

An additional example of a structurally altered zone 102 near a point of impaction may be a zone of micro-fractures Z2. The structurally altered zone Z may be broken or otherwise altered due to the impactor 100 and/or a drill bit 60, such as by crushing, fracturing, or micro-fracturing.

FIG. 2 also illustrates an impactor 100 implanted into a formation 52 and having created an excavation E wherein material has been ejected from or crushed beneath the impactor 100. Thereby the excavation E may be created, which as illustrated in FIG. 3 may generally conform to the shape of the impactor 100.

Figure 3:
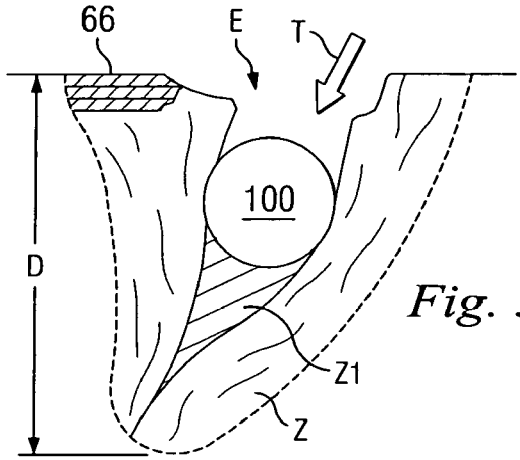
FIG. 3 illustrates an impactor embedded into the formation at an angle to a normalized surface plane of the target formation.
Figure 4:
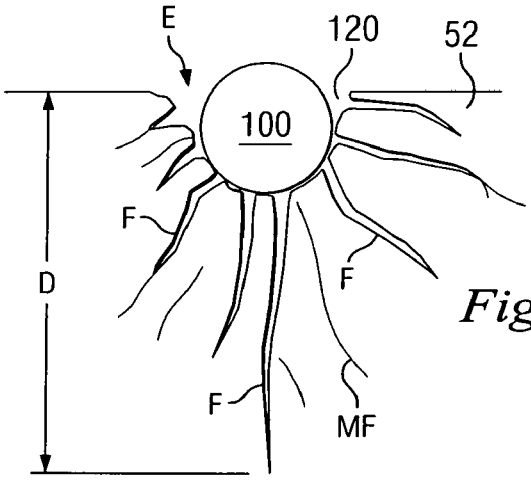
FIG. 4 illustrates an impactor impacting a formation with a plurality of fractures induced by the impact.

FIGS. 3 and 4 illustrate excavations E where the size of the excavation may be larger than the size of the impactor 100. In FIG. 2, the impactor 100 is shown as impacted into the formation 52 yielding an excavation depth D.

An additional theory for impaction mechanics in cutting a formation 52 may postulate that certain formations 52 may be highly fractured or broken up by impactor energy. FIG. 4 illustrates an interaction between an impactor 100 and a formation 52. A plurality of fractures F and micro-fractures MF may be created in the formation 52 by impact energy.

An impactor 100 may penetrate a small distance into the formation 52 and cause the displaced or structurally altered formation 52 to "splay out" or be reduced to small enough particles for the particles to be removed or washed away by hydraulic action. Hydraulic particle removal may depend at least partially upon available hydraulic horsepower and at least partially upon particle wet-ability and viscosity. Such formation deformation may be a basis for fatigue failure of a portion of the formation by "impactor contact," as the plurality of solid material impactors 100 may displace formation material back and forth.

Each nozzle 64 may be selected to provide a desired circulation fluid circulation rate, hydraulic horsepower substantially at the nozzle 64, and/or impactor energy or velocity when exiting the nozzle 64. Each nozzle 64 may be selected as a function of at least one of (a) an expenditure of a selected range of hydraulic horsepower across the one or more nozzles 64, (b) a selected range of circulation fluid velocities exiting the one or more nozzles 64, and (c) a selected range of solid material impactor 100 velocities exiting the one or more nozzles 64.

To optimize ROP, it may be desirable to determine, such as by monitoring, observing, calculating, knowing, or assuming one or more excavation parameters such that adjustments may be made in one or more controllable variables as a function of the determined or monitored excavation parameter. The one or more excavation parameters may be selected from a group comprising: (a) a rate of penetration into the formation 52, (b) a depth of penetration into the formation 52, (c) a formation excavation factor, and (d) the number of solid material impactors 100 introduced into the circulation fluid per unit of time. Monitoring or observing may include monitoring or observing one or more excavation parameters of a group of excavation parameters comprising: (a) rate of nozzle rotation, (b) rate of penetration into the formation 52, (c) depth of penetration into the formation 52, (d) formation excavation factor, (e) axial force applied to the drill bit 60, (f) rotational force applied to the bit 60, (g) the selected circulation rate, (h) the selected pump pressure, and/or (i) wellbore fluid dynamics, including pore pressure.

One or more controllable variables or parameters may be altered, including at least one of (a) rate of impactor 100 introduction into the circulation fluid, (b) impactor 100 size, (c) impactor 100 velocity, (d) drill bit nozzle 64 selection, (e) the selected circulation rate of the circulation fluid, (f) the selected pump pressure, and (g) any of the monitored excavation parameters.

To alter the rate of impactors 100 engaging the formation 52, the rate of impactor 100 introduction into the circulation fluid may be altered. The circulation fluid circulation rate may also be altered independent from the rate of impactor 100 introduction. Thereby, the concentration of impactors 100 in the circulation fluid may be adjusted separate from the fluid circulation rate. Introducing a plurality of solid material impactors 100 into the circulation fluid may be a function of impactor 100 size, circulation fluid rate, nozzle rotational speed, wellbore 70 size, and a selected impactor 100 engagement rate with the formation 52. The impactors 100 may also be introduced into the circulation fluid intermittently during the excavation operation. The rate of impactor 100 introduction relative to the rate of circulation fluid circulation may also be adjusted or interrupted as desired.

The plurality of solid material impactors 100 may be introduced into the circulation fluid at a selected introduction rate and/or concentration to circulate the plurality of solid material impactors 100 with the circulation fluid through the nozzle 64. The selected circulation rate and/or pump pressure, and nozzle selection may be sufficient to expend a desired portion of energy or hydraulic horsepower in each of the circulation fluid and the impactors 100.

An example of an operative excavation system 1 may comprise a bit 60 with an 8½ inch bit diameter. The solid material impactors 100 may be introduced into the circulation fluid at a rate of 12 gallons per minute. The circulation fluid containing the solid material impactors may be circulated through the bit 60 at a rate of 462 gallons per minute. A substantial portion by weight of the solid material impactors may have an average mean diameter of 0.100". The following parameters will result in approximately a 27 feet per hour penetration rate into Sierra White Granite. In this example, the excavation system may produce 1413 solid material impactors 100 per cubic inch with approximately 3.9 million impacts per minute against the formation 52. On average, 0.00007822 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 1.14 Ft Lbs., thus satisfying the mass-velocity relationship described above.

Another example of an operative excavation system 1 may comprise a bit 60 with an 8½" bit diameter. The solid material impactors 100 may be introduced into the circulation fluid at a rate of 12 gallons per minute. The circulation fluid containing the solid material impactors may be circulated through the nozzle 64 at a rate of 462 gallons per minute. A substantial portion by weight of the solid material impactors may have an average mean diameter of 0.075". The following parameters will result in approximately a 35 feet per hour penetration rate into Sierra White Granite. In this example, the excavation system 1 may produce 3350 solid material impactors 100 per cubic inch with approximately 9.3 million impacts per minute against the formation 52. On average, 0.0000428 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 0.240 Ft Lbs., thus satisfying the mass-velocity relationship described above.

In addition to impacting the formation with the impactors 100, the bit 60 may be rotated while circulating the circulation fluid and engaging the plurality of solid material impactors 100 substantially continuously or selectively intermittently. The nozzle 64 may also be oriented to cause the solid material impactors 100 to engage the formation 52 with a radially outer portion of the bottom hole surface 66. Thereby, as the drill bit 60 is rotated, the impactors 100, in the bottom hole surface 66 ahead of the bit 60, may create one or more circumferential kerfs. The drill bit 60 may thereby generate formation cuttings more efficiently due to reduced stress in the surface 66 being excavated, due to the one or more substantially circumferential kerfs in the surface 66.

The excavation system 1 may also include inputting pulses of energy in the fluid system sufficient to impart a portion of the input energy in an impactor 100. The impactor 100 may thereby engage the formation 52 with sufficient energy to achieve a structurally altered zone Z. Pulsing of the pressure of the circulation fluid in the pipe string 55, near the nozzle 64 also may enhance the ability of the circulation fluid to generate cuttings subsequent to impactor 100 engagement with the formation 52.

Each combination of formation type, bore hole size, bore hole depth, available weight on bit, bit rotational speed, pump rate, hydrostatic balance, circulation fluid rheology, bit type, and tooth/cutter dimensions may create many combinations of optimum impactor presence or concentration, and impactor energy requirements. The methods and systems of this invention facilitate adjusting impactor size, mass, introduction rate, circulation fluid rate and/or pump pressure, and other adjustable or controllable variables to determine and maintain an optimum combination of variables. The methods and systems of this invention also may be coupled with select bit nozzles, downhole tools, and fluid circulating and processing equipment to effect many variations in which to optimize rate of penetration.

Figure 5:
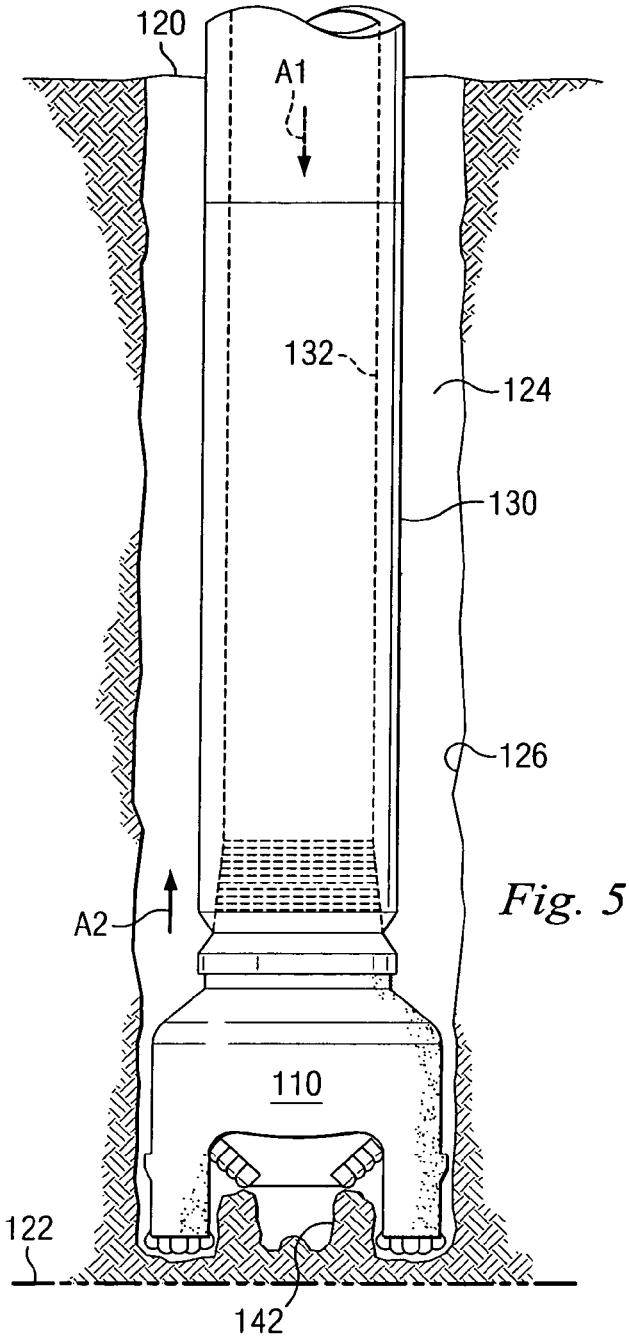
FIG. 5 is a side elevational view of a drilling system utilizing a first embodiment of a drill bit.

FIG. 5 shows an alternate embodiment of the drill bit 60 (FIG. 1) and is referred to, in general, by the reference numeral 110 and which is located at the bottom of a well bore 120 and attached to a drill string 130. The drill bit 110 acts upon a bottom surface 122 of the well bore 120. The drill string 130 has a central passage 132 that supplies drilling fluids to the drill bit 110 as shown by the arrow A1. The drill bit 110 uses the drilling fluids and solid material impactors 100 when acting upon the bottom surface 122 of the well bore 120. The drilling fluids then exit the well bore 120 through a well bore annulus 124 between the drill string 130 and the inner wall 126 of the well bore 120. Particles of the bottom surface 122 removed by the drill bit 110 exit the well bore 120 with the drilling fluid through the well bore annulus 124 as shown by the arrow A2. The drill bit 110 creates a rock ring 142 at the bottom surface 122 of the well bore 120.

Figure 6:
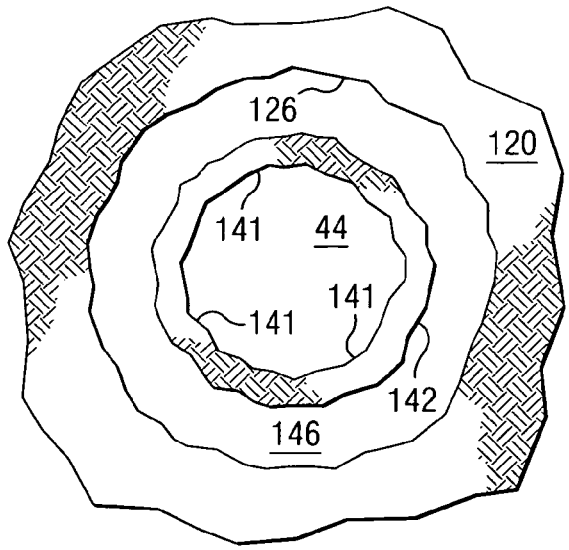
FIG. 6 is a top plan view of the bottom surface of a well bore formed by the drill bit of FIG. 5.

Referring now to FIG. 6, a top view of the rock ring 124 formed by the drill bit 110 is illustrated. An excavated interior cavity 144 is worn away by an interior portion of the drill bit 110 and the exterior cavity 146 and inner wall 126 of the well bore 120 are worn away by an exterior portion of the drill bit 110. The rock ring 142 possesses hoop strength, which holds the rock ring 142 together and resists breakage. The hoop strength of the rock ring 142 is typically much less than the strength of the bottom surface 122 or the inner wall 126 of the well bore 120, thereby making the drilling of the bottom surface 122 less demanding on the drill bit 110. By applying a compressive load and a side load, shown with arrows 141, on the rock ring 142, the drill bit 110 causes the rock ring 142 to fracture. The drilling fluid 140 then washes the residual pieces of the rock ring 142 back up to the surface through the well bore annulus 124.

The mechanical cutters, utilized on many of the surfaces of the drill bit 110, may be any type of protrusion or surface used to abrade the rock formation by contact of the mechanical cutters with the rock formation. The mechanical cutters may be Polycrystalline Diamond Coated (PDC), or any other suitable type mechanical cutter such as tungsten carbide cutters. The mechanical cutters may be formed in a variety of shapes, for example, hemispherically shaped, cone shaped, etc. Several sizes of mechanical cutters are also available, depending on the size of drill bit used and the hardness of the rock formation being cut.

Figure 7:
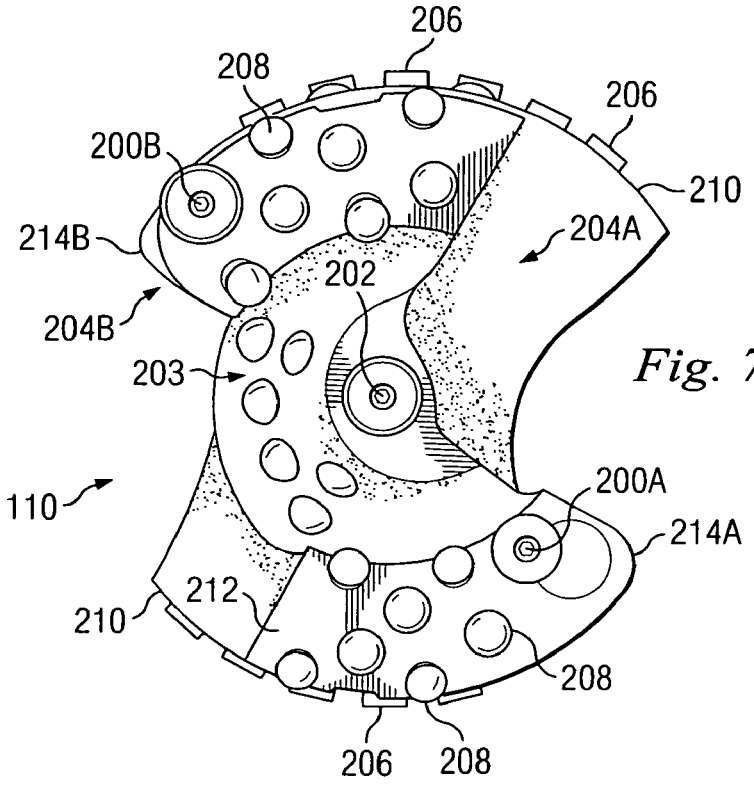
FIG. 7 is an end elevational view of the drill bit of FIG. 5.

Referring now to FIG. 7, an end elevational view of the drill bit 110 of FIG. 5 is illustrated. The drill bit 110 comprises two side nozzles 200A, 200B and a center nozzle 202. The side and center nozzles 200A, 200B, 202 discharge drilling fluid and solid material impactors (not shown) into the rock formation or other surface being excavated. The solid material impactors may comprise steel shot ranging in diameter from about 0.010 to about 0.500 of an inch. However, various diameters and materials such as ceramics, etc. may be utilized in combination with the drill bit 120. The solid material impactors contact the bottom surface 122 of the well bore 120 and are circulated through the annulus 124 to the surface. The solid material impactors may also make up any suitable percentage of the drilling fluid for drilling through a particular formation.

Still referring to FIG. 7 the center nozzle 202 is located in a center portion 203 of the drill bit 110. The center nozzle 202 may be angled to the longitudinal axis of the drill bit 110 to create an excavated interior cavity 244 and also cause the rebounding solid material impactors to flow into the major junk slot, or passage, 204A. The side nozzle 200A located on a side arm 214A of the drill bit 110 may also be oriented to allow the solid material impactors to contact the bottom surface 122 of the well bore 120 and then rebound into the major junk slot, or passage, 204A. The second side nozzle 200B is located on a second side arm 214B. The second side nozzle 200B may be oriented to allow the solid material impactors to contact the bottom surface 122 of the well bore 120 and then rebound into a minor junk slot, or passage, 204B. The orientation of the side nozzles 200A, 200B may be used to facilitate the drilling of the large exterior cavity 46. The side nozzles 200A, 200B may be oriented to cut different portions of the bottom surface 122. For example, the side nozzle 200B may be angled to cut the outer portion of the excavated exterior cavity 146 and the side nozzle 200A may be angled to cut the inner portion of the excavated exterior cavity 146. The major and minor junk slots, or passages, 204A, 204B allow the solid material impactors, cuttings, and drilling fluid 240 to flow up through the well bore annulus 124 back to the surface. The major and minor junk slots, or passages, 204A, 204B are oriented to allow the solid material impactors and cuttings to freely flow from the bottom surface 122 to the annulus 124.

As described earlier, the drill bit 110 may also comprise mechanical cutters and gauge cutters. Various mechanical cutters are shown along the surface of the drill bit 110. Hemispherical PDC cutters are interspersed along the bottom face and the side walls of the drill bit 110. These hemispherical cutters along the bottom face break down the large portions of the rock ring 142 and also abrade the bottom surface 122 of the well bore 120. Another type of mechanical cutter along the side arms 214A, 214B are gauge cutters 230. The gauge cutters 230 form the final diameter of the well bore 120. The gauge cutters 230 trim a small portion of the well bore 120 not removed by other means. Gauge bearing surfaces 206 are interspersed throughout the side walls of the drill bit 110. The gauge bearing surfaces 206 ride in the well bore 120 already trimmed by the gauge cutters 230. The gauge bearing surfaces 206 may also stabilize the drill bit 110 within the well bore 120 and aid in preventing vibration.

Still referring to FIG. 7 the center portion 203 comprises a breaker surface, located near the center nozzle 202, comprising mechanical cutters 208 for loading the rock ring 142. The mechanical cutters 208 abrade and deliver load to the lower stress rock ring 142. The mechanical cutters 208 may comprise PDC cutters, or any other suitable mechanical cutters. The breaker surface is a conical surface that creates the compressive and side loads for fracturing the rock ring 142. The breaker surface and the mechanical cutters 208 apply force against the inner boundary of the rock ring 142 and fracture the rock ring 142. Once fractured, the pieces of the rock ring 142 are circulated to the surface through the major and minor junk slots, or passages, 204A, 204B.

Figure 8:
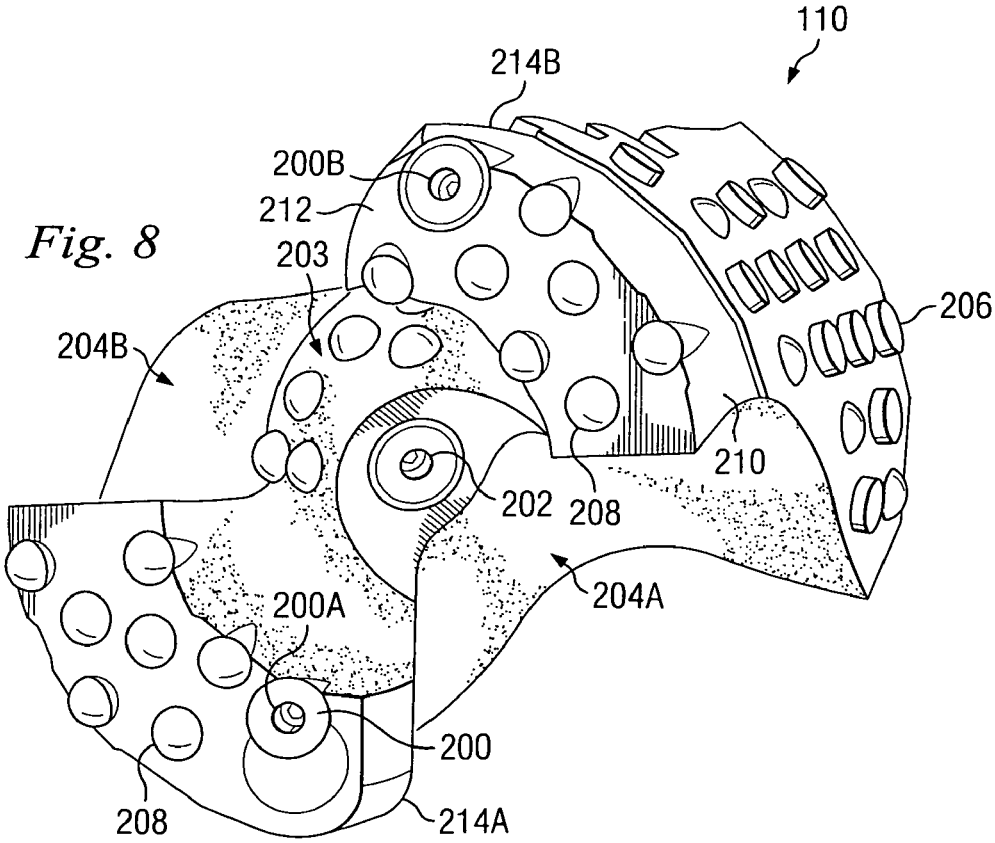
FIG. 8 is an enlarged end elevational view of the drill bit of FIG. 5.

Referring now to FIG. 8, an enlarged end elevational view of the drill bit 110 is shown. As shown more clearly in FIG. 8, the gauge bearing surfaces 206 and mechanical cutters 208 are interspersed on the outer side walls of the drill bit 110. The mechanical cutters 208 along the side walls may also aid in the process of creating drill bit 110 stability and also may perform the function of the gauge bearing surfaces 206 if they fail. The mechanical cutters 208 are oriented in various directions to reduce the wear of the gauge bearing surface 206 and also maintain the correct well bore 120 diameter. As noted with the mechanical cutters 208 of the breaker surface, the solid material impactors fracture the bottom surface 122 of the well bore 120 and, as such, the mechanical cutters 208 remove remaining ridges of rock and assist in the cutting of the bottom hole. However, the drill bit 110 need not necessarily comprise the mechanical cutters 208 on the side wall of the drill bit 110.

Figure 9:
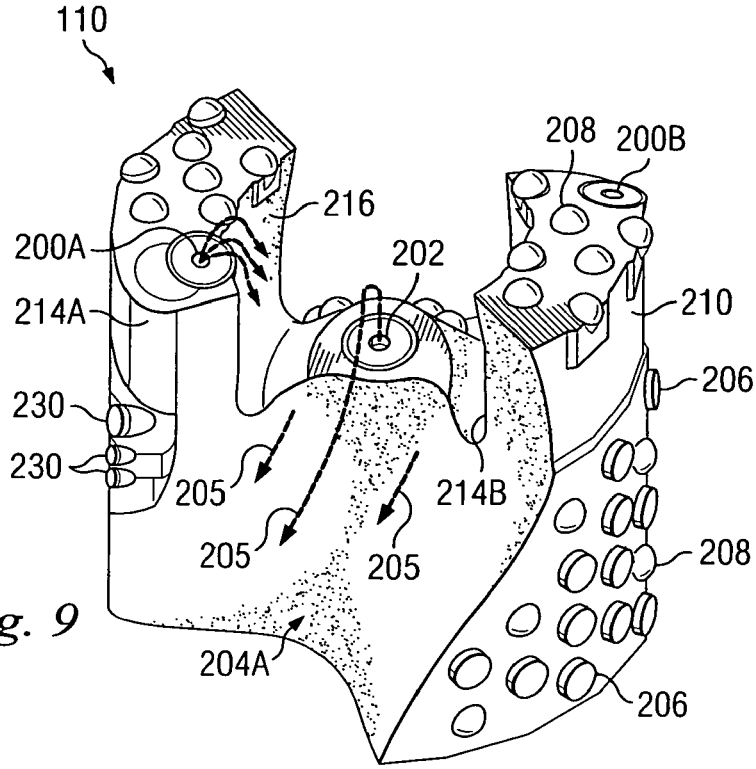
FIG. 9 is a perspective view of the drill bit of FIG. 5.

Referring now to FIG. 9, a side elevational view of the drill bit 110 is illustrated. FIG. 9 shows the gauge cutters 230 included along the side arms 214A, 214B of the drill bit 110. The gauge cutters 230 are oriented so that a cutting face of the gauge cutter 230 contacts the inner wall 126 of the well bore 120. The gauge cutters 230 may contact the inner wall 126 of the well bore at any suitable backrake, for example a backrake of 15° to 45°. Typically, the outer edge of the cutting face scrapes along the inner wall 126 to refine the diameter of the well bore 120.

Still referring to FIG. 9 one side nozzle 200A is disposed on an interior portion of the side arm 214A and the second side nozzle 200B is disposed on an exterior portion of the opposite side arm 214B. Although the side nozzles 200A, 200B are shown located on separate side arms 214A, 214B of the drill bit 110, the side nozzles 200A, 200B may also be disposed on the same side arm 214A or 214B. Also, there may only be one side nozzle, 200A or 200B. Also, there may only be one side arm, 214A or 214B.

Each side arm 214A, 214B fits in the excavated exterior cavity 146 formed by the side nozzles 200A, 200B and the mechanical cutters 208 on the face 212 of each side arm 214A, 214B. The solid material impactors from one side nozzle 200A rebound from the rock formation and combine with the drilling fluid and cuttings flow to the major junk slot 204A and up to the annulus 124. The flow of the solid material impactors, shown by arrows 205, from the center nozzle 202 also rebound from the rock formation up through the major junk slot 204A.

Figure 10:
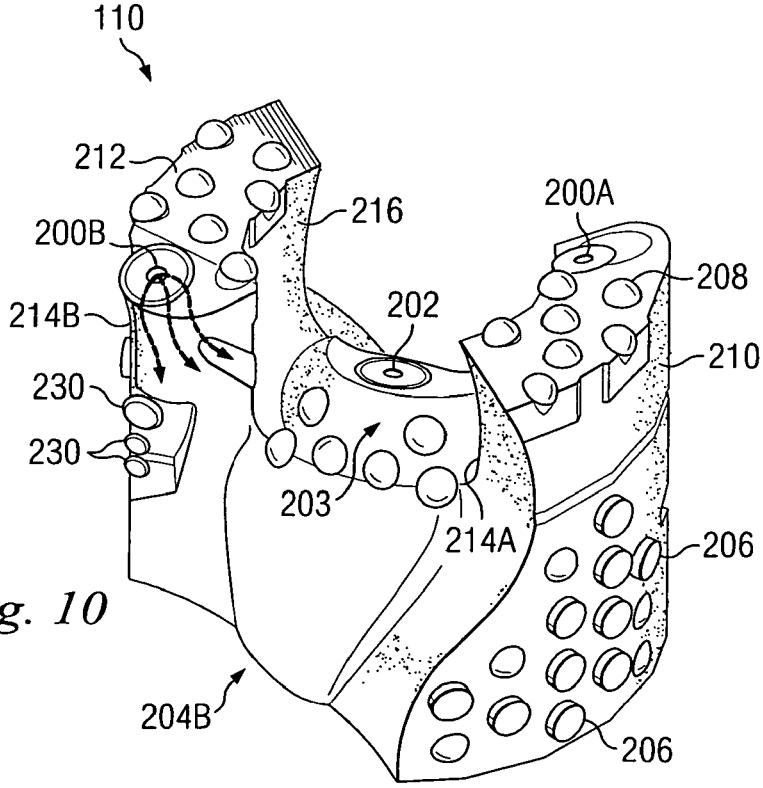
FIG. 10 is a perspective view of the drill bit of FIG. 5 illustrating a breaker and junk slot of a drill bit.
Figure 11:
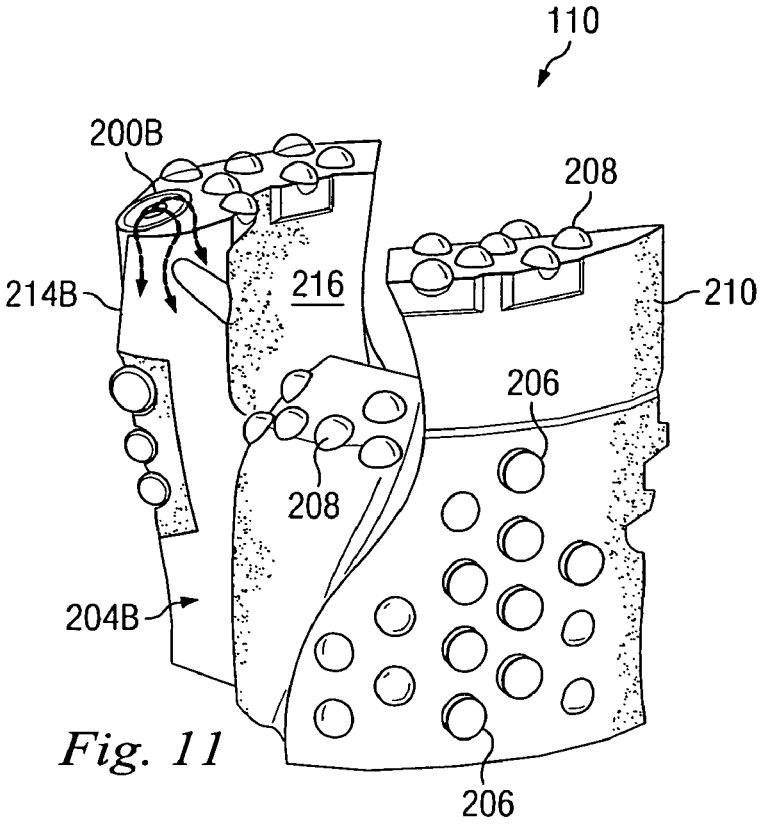
FIG. 11 is a side elevational view of the drill bit of FIG. 5 illustrating a flow of solid material impactors.

Referring now to FIGS. 10 and 11, the minor junk slot 204B, breaker surface, and the second side nozzle 200B are shown in greater detail. The breaker surface is conically shaped, tapering to the center nozzle 202. The second side nozzle 200B is oriented at an angle to allow the outer portion of the excavated exterior cavity 146 to be contacted with solid material impactors. The solid material impactors then rebound up through the minor junk slot 204B, shown by arrows 205, along with any cuttings and drilling fluid 240 associated therewith.

Figure 12:
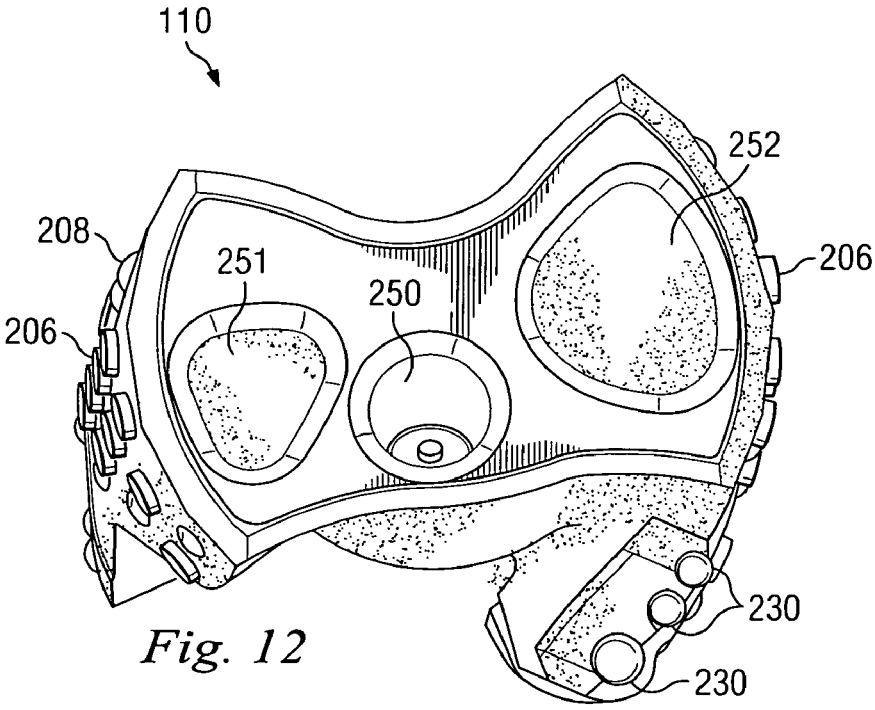
FIG. 12 is a top elevational view of the drill bit of FIG. 5 illustrating side and center cavities.
Figure 13:
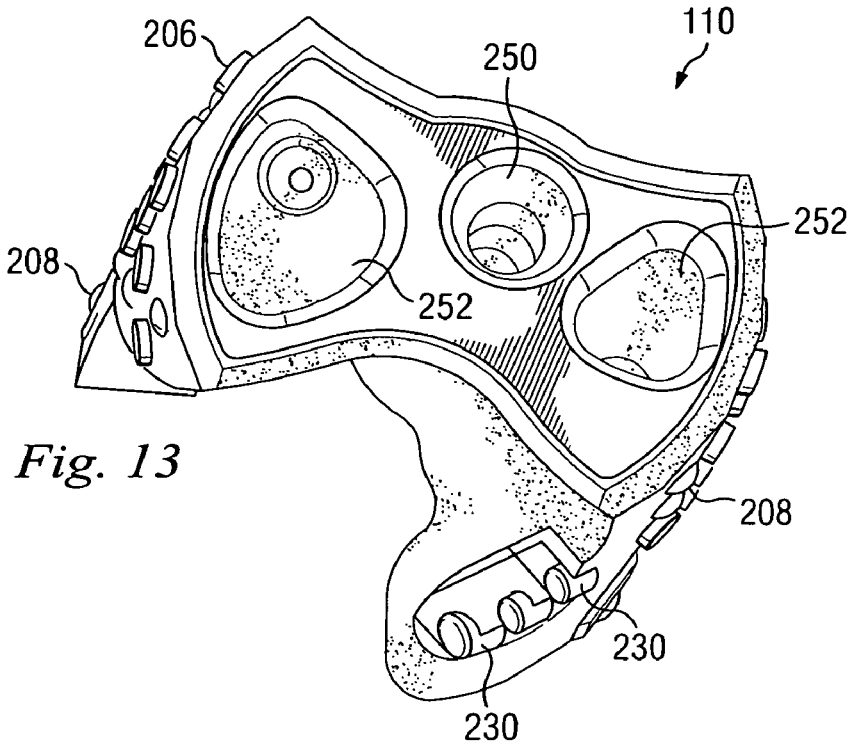
FIG. 13 is a canted top elevational view of the drill bit of FIG. 5.

Referring now to FIGS. 12 and 13, top elevational views of the drill bit 110 are shown. Each nozzle 200A, 200B, 202 receives drilling fluid 240 and solid material impactors from a common plenum feeding separate cavities 250, 251, and 252. Since the common plenum has a diameter, or cross section, greater than the diameter of each cavity 250, 251, and 252, the mixture, or suspension of drilling fluid and impactors is accelerated as it passes from the plenum to each cavity. The center cavity 250 feeds a suspension of drilling fluid 240 and solid material impactors to the center nozzle 202 for contact with the rock formation. The side cavities 251, 252 are formed in the interior of the side arms 214A, 214B of the drill bit 110, respectively. The side cavities 251, 252 provide drilling fluid 240 and solid material impactors to the side nozzles 200A, 200B for contact with the rock formation. By utilizing separate cavities 250, 251,252 for each nozzle 202, 200A, 200B, the percentages of solid material impactors in the drilling fluid 240 and the hydraulic pressure delivered through the nozzles 200A, 200B, 202 can be specifically tailored for each nozzle 200A, 200B, 202. Solid material impactor distribution can also be adjusted by changing the nozzle diameters of the side and center nozzles 200A, 200B, and 202 by changing the diameters of the nozzles. However, in alternate embodiments, other arrangements of the cavities 250, 251, 252, or the utilization of a single cavity, are possible.

Figure 14:
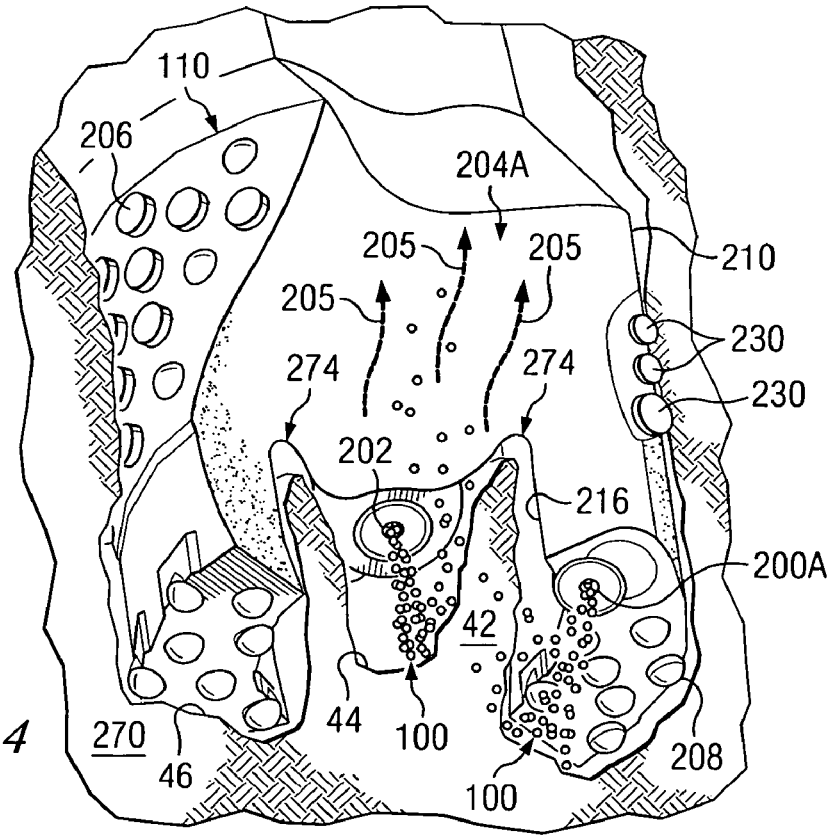
FIG. 14 is a cutaway view of the drill bit of FIG. 5 engaged in a well bore.

Referring now to FIG. 14, the drill bit 110 in engagement with the rock formation 270 is shown. As previously discussed, the solid material impactors 272 flow from the nozzles 200A, 200B, 202 and make contact with the rock formation 270 to create the rock ring 142 between the side arms 214A, 214B of the drill bit 110 and the center nozzle 202 of the drill bit 110. The solid material impactors 272 from the center nozzle 202 create the excavated interior cavity 244 while the side nozzles 200A, 200B create the excavated exterior cavity 146 to form the outer boundary of the rock ring 142. The gauge cutters 230 refine the more crude well bore 120 cut by the solid material impactors 272 into a well bore 120 with a more smooth inner wall 126 of the correct diameter.

Still referring to FIG. 14 the solid material impactors 272 flow from the first side nozzle 200A between the outer surface of the rock ring 142 and the interior wall 216 in order to move up through the major junk slot 204A to the surface. The second side nozzle 200B (not shown) emits solid material impactors 272 that rebound toward the outer surface of the rock ring 142 and to the minor junk slot 204B (not shown). The solid material impactors 272 from the side nozzles 200A, 200B may contact the outer surface of the rock ring 142 causing abrasion to further weaken the stability of the rock ring 142. Recesses 274 around the breaker surface of the drill bit 110 may provide a void to allow the broken portions of the rock ring 142 to flow from the bottom surface 122 of the well bore 120 to the major or minor junk slot 204A, 204B.

Figure 15:
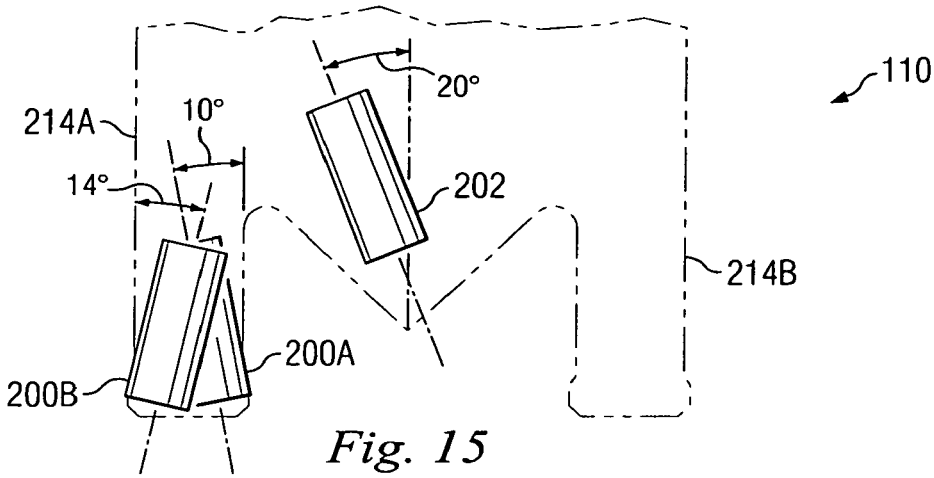
FIG. 15 is a schematic diagram of the orientation of the nozzles of a second embodiment of a drill bit.

Referring now to FIG. 15, an example orientation of the nozzles 200A, 200B, 202 are illustrated. The center nozzle 202 is disposed left of the center line of the drill bit 110 and angled on the order of around 20° left of vertical. Alternatively, both of the side nozzles 200A, 200B may be disposed on the same side arm 214 of the drill bit 110 as shown in FIG. 15. In this embodiment, the first side nozzle 200A, oriented to cut the inner portion of the excavated exterior cavity 146, is angled on the order of around 10° left of vertical. The second side nozzle 200B is oriented at an angle on the order of around 14° right of vertical. This particular orientation of the nozzles allows for a large interior excavated cavity 244 to be created by the center nozzle 202. The side nozzles 200A, 200B create a large enough excavated exterior cavity 146 in order to allow the side arms 214A, 214B to fit in the excavated exterior cavity 146 without incurring a substantial amount of resistance from uncut portions of the rock formation 270. By varying the orientation of the center nozzle 202, the excavated interior cavity 244 may be substantially larger or smaller than the excavated interior cavity 244 illustrated in FIG. 14. The side nozzles 200A, 200B may be varied in orientation in order to create a larger excavated exterior cavity 146, thereby decreasing the size of the rock ring 142 and increasing the amount of mechanical cutting required to drill through the bottom surface 122 of the well bore 120. Alternatively, the side nozzles 200A, 200B may be oriented to decrease the amount of the inner wall 126 contacted by the solid material impactors 272. By orienting the side nozzles 200A, 200B at, for example, a vertical orientation, only a center portion of the excavated exterior cavity 146 would be cut by the solid material impactors and the mechanical cutters would then be required to cut a large portion of the inner wall 126 of the well bore 120.

Figure 16:
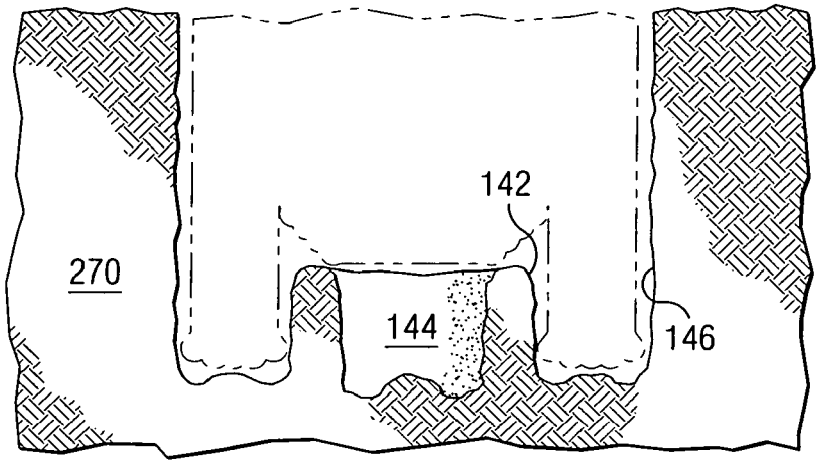
FIG. 16 is a side cross-sectional view of the rock formation created by the drill bit of FIG. 5 represented by the schematic of the drill bit of FIG. 5 inserted therein.
Figure 17:
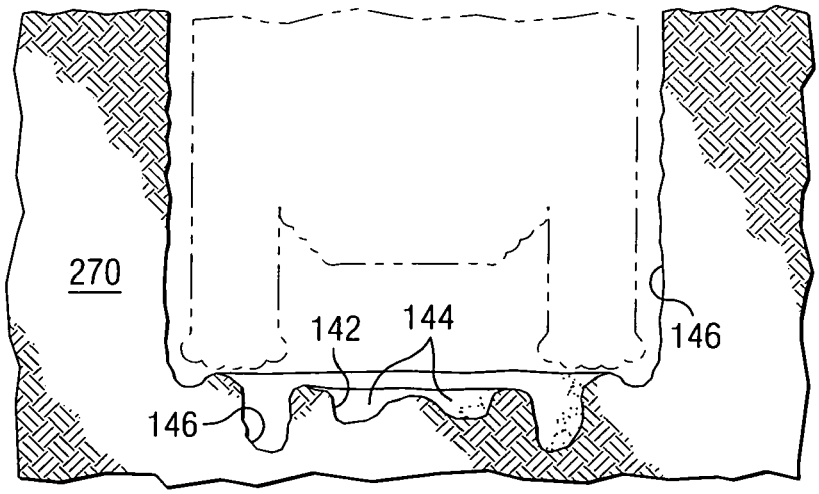
FIG. 17 is a side cross-sectional view of the rock formation created by drill bit of FIG. 5 represented by the schematic of the drill bit of FIG. 5 inserted therein.

Referring now to FIGS. 16 and 17, side cross-sectional views of the bottom surface 122 of the well bore 120 drilled by the drill bit 110 are shown. With the center nozzle angled on the order of around 20° left of vertical and the side nozzles 200A, 200B angled on the order of around 10° left of vertical and around 14° right of vertical, respectively, the rock ring 142 is formed. By increasing the angle of the side nozzle 200A, 200B orientation, an alternate rock ring 142 shape and bottom surface 122 is cut as shown in FIG. 17. The excavated interior cavity 244 and rock ring 142 are much more shallow as compared with the rock ring 142 in FIG. 16. It is understood that various different bottom hole patterns can be generated by different nozzle configurations.

Although the drill bit 110 is described comprising orientations of nozzles and mechanical cutters, any orientation of either nozzles, mechanical cutters, or both may be utilized. The drill bit 110 need not comprise a center portion 203. The drill bit 110 also need not even create the rock ring 142. For example, the drill bit may only comprise a single nozzle and a single junk slot. Furthermore, although the description of the drill bit 110 describes types and orientations of mechanical cutters, the mechanical cutters may be formed of a variety of substances, and formed in a variety of shapes.

Figure 18:
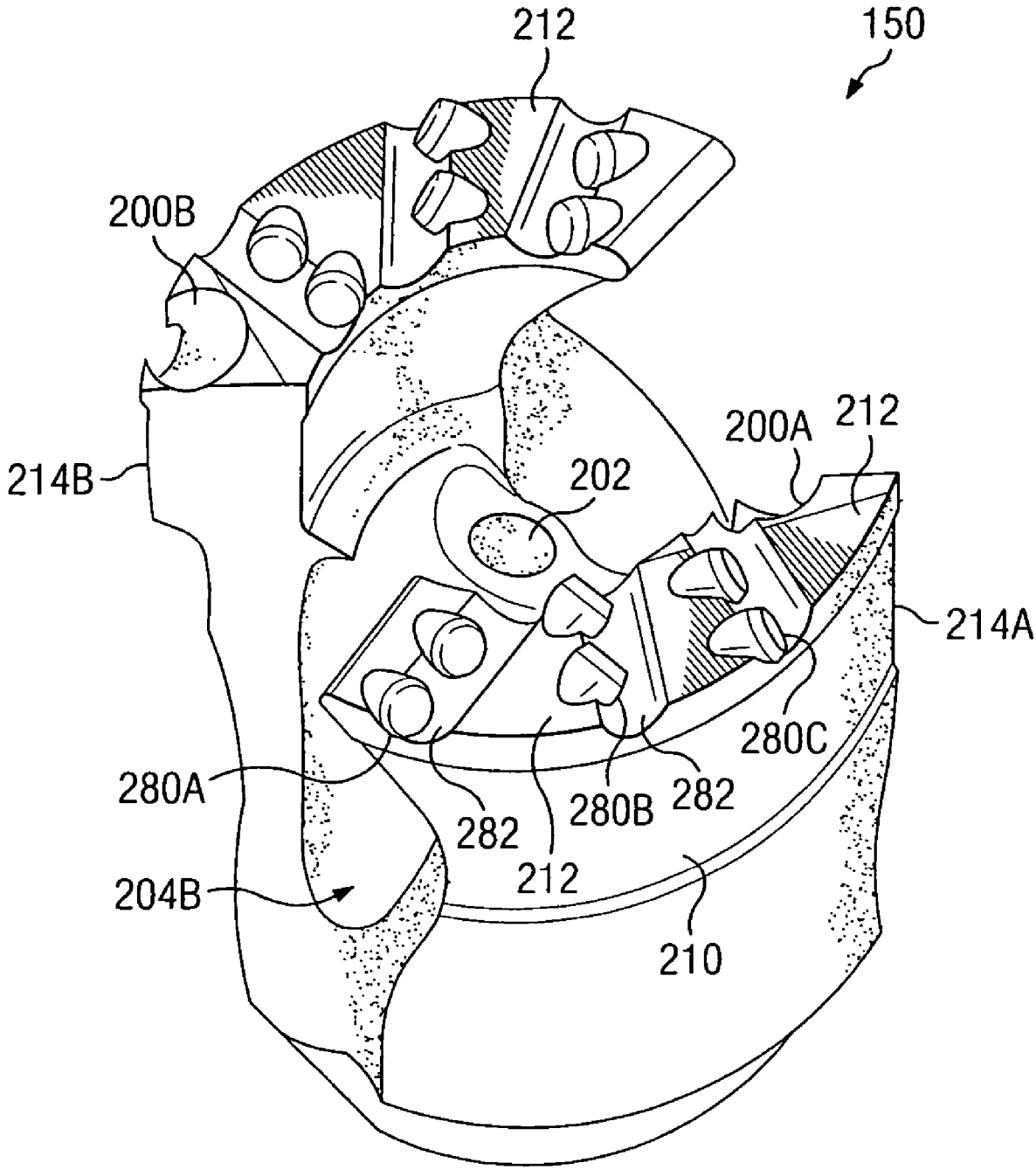
FIG. 18 is a perspective view of an alternate embodiment of a drill bit.
Figure 19:
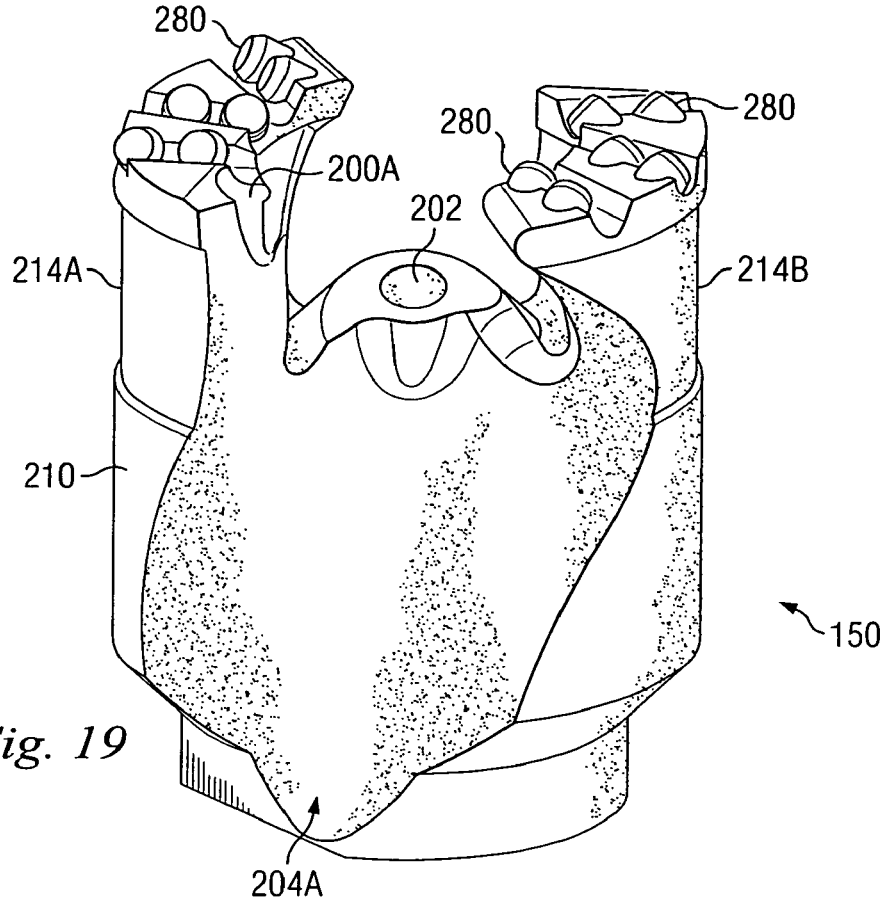
FIG. 19 is a perspective view of the drill bit of FIG. 18.

Referring now to FIGS. 18-19, a drill bit 150 in accordance with a second embodiment is illustrated. As previously noted, the mechanical cutters, such as the gauge cutters 230, mechanical cutters 208, and gauge bearing surfaces 206 may not be necessary in conjunction with the nozzles 200A, 200B, 202 in order to drill the required well bore 120. The side wall of the drill bit 150 may or may not be interspersed with mechanical cutters. The side nozzles 200A, 200B and the center nozzle 202 are oriented in the same manner as in the drill bit 150, however, the face 212 of the side arms 214A, 214B comprises angled (PDCs) 280 as the mechanical cutters.

Figure 20:
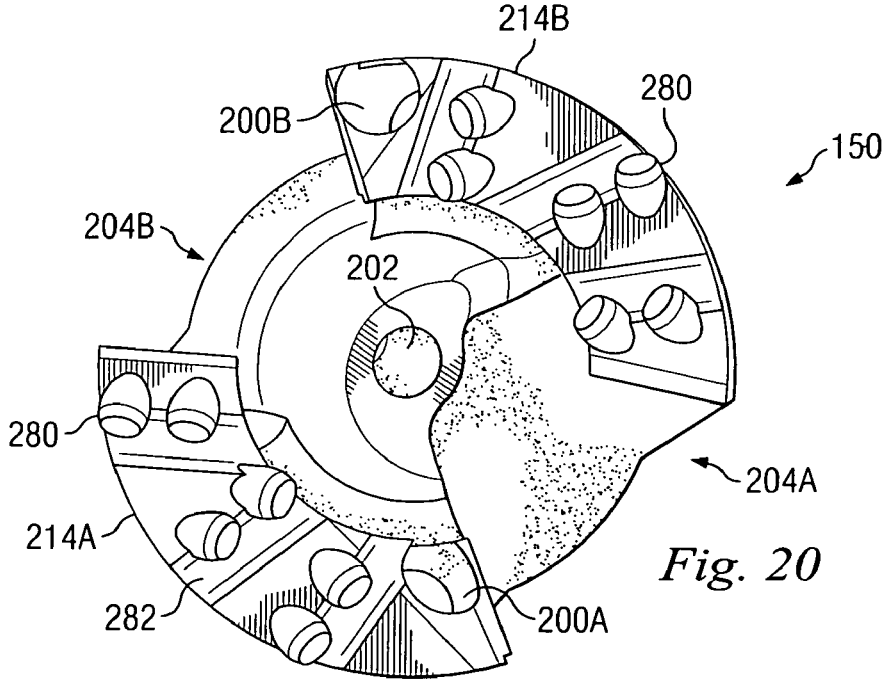
FIG. 20 illustrates an end elevational view of the drill bit of FIG. 18.

Still referring to FIGS. 18-20 each row of PDCs 280 is angled to cut a specific area of the bottom surface 122 of the well bore 120. A first row of PDCs 280A is oriented to cut the bottom surface 122 and also cut the inner wall 126 of the well bore 120 to the proper diameter. A groove 282 is disposed between the cutting faces of the PDCs 280 and the face 212 of the drill bit 150. The grooves 282 receive cuttings, drilling fluid 240, and solid material impactors and direct them toward the center nozzle 202 to flow through the major and minor junk slots, or passages, 204A, 204B toward the surface. The grooves 282 may also direct some cuttings, drilling fluid 240, and solid material impactors toward the inner wall 126 to be received by the annulus 124 and also flow to the surface. Each subsequent row of PDCs 280B, 280C may be oriented in the same or different position than the first row of PDCs 280A. For example, the subsequent rows of PDCs 280B, 280C may be oriented to cut the exterior face of the rock ring 142 as opposed to the inner wall 126 of the well bore 120. The grooves 282 on one side arm 214A may also be oriented to direct the cuttings and drilling fluid 240 toward the center nozzle 202 and to the annulus 124 via the major junk slot 204A. The second side arm 214B may have grooves 282 oriented to direct the cuttings and drilling fluid 240 to the inner wall 126 of the well bore 120 and to the annulus 124 via the minor junk slot 204B.

The PDCs 280 located on the face 212 of each side arm 214A, 214B are sufficient to cut the inner wall 126 to the correct size. However, mechanical cutters may be placed throughout the side wall of the drill bit 150 to further enhance the stabilization and cutting ability of the drill bit 150.

Figure 21:
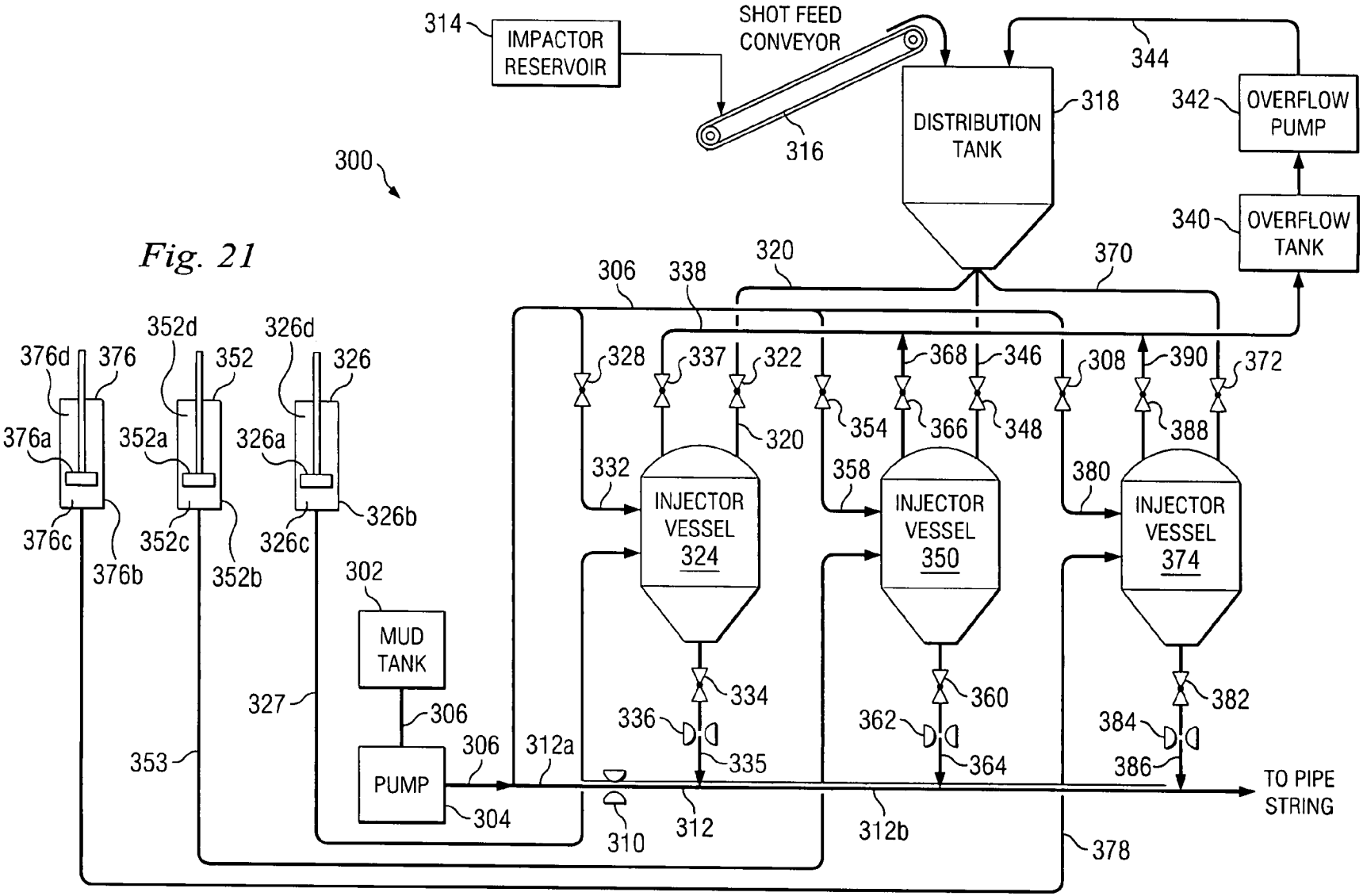
FIG. 21 is a schematic view of an injection system according to an embodiment.

Referring to FIG. 21, an injection system is generally referred to by the reference numeral 300 and includes a drilling fluid tank or mud tank 302 that is fluidicly coupled to a pump 304 via a hydraulic supply line 306 that also extends from the pump to a valve 308. An orifice 310 is fluidicly coupled to the hydraulic supply line 306 via a hydraulic supply line 312 that also extends to and/or is fluidicly coupled to a pipe string such as, for example, the pipe string 55 described above in connection with the excavation system 1 of the embodiment of FIG. 1. In an exemplary embodiment, it is understood that the hydraulic supply line 312 may be fluidicly coupled to the pipe string 55 via one or more components of the excavation system 1 of the embodiment of FIG. 1, including the impactor slurry injector head 34, the injector port 30, the fluid-conducting through-bore of the swivel 28, and/or the feed end 55*a* of the pipe string. Line portions 312*a* and 312*b* of the line 312 are defined and separated by the location of the orifice 310.

A solid-material-impactor bin or reservoir 314 is operably coupled to a solid-impactor transport device such as a shot-feed conveyor 316 which, in turn, is operably coupled to a distribution tank 318. A conduit 320 connects the tank 318 to a valve 322, and the conduit further extends and is connected to an injector vessel 324.

A hydraulic-actuated cylinder 326 is fluidicly coupled to the vessel 324 via a hydraulic flow line 327. The cylinder 326 includes a piston 326*a* that reciprocates in a cylinder housing 326*b* in a conventional manner. The housing 326*b* defines a variable-volume chamber 326*c* in fluid communication with the line 327, and further defines a variable-volume chamber 326*d* into which hydraulic cylinder fluid is introduced, and from which the hydraulic fluid is discharged, under conditions to be described.

A valve 328 is fluidicly coupled to the line 306 via a hydraulic line 332, and the line 332 also extends to the vessel 324, thereby fluidicly coupling the valve to the vessel. A valve 334 is fluidicly coupled to the vessel 324. A hydraulic line 335 fluidicly couples an orifice 336 to the valve 334, and the line also extends to the line portion 312*b* of the line 312. A valve 337 is fluidicly coupled to the vessel 324 via a hydraulic line 338 that also extends to a reservoir or tank 340. A pump 342 is fluidicly coupled to the tank 340 via a hydraulic line 344 that also extends to the tank 318.

A conduit 346 connects the tank 318 to a valve 348, and the conduit further extends and is connected to an injector vessel 350. A hydraulic-actuated cylinder 352 is fluidicly coupled to the vessel 350 via a hydraulic flow line 353. The cylinder 352 includes a piston 352*a* that reciprocates in a cylinder housing 352*b* in a conventional manner. The housing 352*b* defines a variable-volume chamber 352*c* in fluid communication with the line 353, and further defines a variable-volume chamber 352*d* into which hydraulic cylinder fluid is introduced, and from which the hydraulic fluid is discharged, under conditions to be described.

A valve 354 is fluidicly coupled to the line 306 via a hydraulic line 358, and the line 358 also extends to the vessel 350, thereby fluidicly coupling the valve to the vessel. A valve 360 is fluidicly coupled to the vessel 350, and an orifice 362 is fluidicly coupled to the valve via a hydraulic line 364 that also extends to the line portion 312*b* of the line 312. A valve 366 is fluidicly coupled to the vessel 350 via a hydraulic line 368 that also extends to the line 338.

A conduit 370 connects the tank 318 to a valve 372, and the conduit further extends and is connected to an injector vessel 374. A hydraulic-actuated cylinder 376 is fluidicly coupled to the vessel 374 via a hydraulic line 378, and the cylinder includes a piston 376*a* that reciprocates in a cylinder housing 376*b* in a conventional manner. The housing 376*b* defines a variable-volume chamber 376*c* in fluid communication with the line 378, and further defines a variable-volume chamber 376*d* into which hydraulic cylinder fluid is introduced, and from which the hydraulic fluid is discharged, under conditions to be described.

A hydraulic line 380 fluidicly couples the valve 308 to the vessel 374. A valve 382 is fluidicly coupled to the vessel 374, and an orifice 384 is fluidicly coupled to the valve via a hydraulic line 386 that also extends to the line portion 312*b* of the line 312. A valve 388 is fluidicly coupled to the vessel 374 via a hydraulic line 390 that also extends to the line 338. In an exemplary embodiment, it is understood that all of the above-described lines and line portions define flow regions through which fluid may flow over a range of fluid pressures.

Prior to the general operation of the injection system 300, all of the valves in the injection system may be closed, including the valves 322, 348, 372, 328, 337, 354, 366, 308, 388, 334, 360 and 382. Moreover, the pump 304 may cause liquid such as drilling fluid to flow from the mud tank 302, through the line 306, the line portion 312*a*, the orifice 310 and the line portion 312*b*, and to the pipe string 55. It is understood that the pressure in the line 306 and the line portion 312*a* is substantially equal to the supply pressure of the pump 304, and that the pressure in the line portion 312*b* is less than the pressure in the line 306 and the line portion 312*a* due to the pressure drop caused by the orifice 310. It is further understood that the portion of the line 306 extending to the valve 308, and the lines 327, 353, 378, 332, 358, 380, 338, 368 and 390 may be full of drilling fluid. Moreover, it is understood that the injector vessels 324, 350 and 374 may also be full of drilling fluid. The reservoir 314 is filled with material such as, for example, the solid material impactors 100 discussed above in connection with FIGS. 1-20. The tank 318 may also be filled with the solid material impactors 100, and/or may also be filled with drilling fluid.

For clarity purposes, the individual operation of the injector vessel 324 will be described. Initially, the injector vessel 324 is full of drilling fluid and the valve 337 is open, while the valves 322, 348, 372, 328, 354, 366, 308, 388, 334, 360 and 382 remain closed. As a result of the valve 337 being open, the pressure in the injector vessel 324 is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 324, the valve 322 is opened and the conveyor 316 transports solid material impactors 100 from the reservoir 314 to the tank 318. Solid material impactors 100 are also transported from the tank 318 and into the injector vessel 324 via the conduit 320 and the valve 322, thereby charging the injector vessel with the solid material impactors. In an exemplary embodiment, the solid material impactors 100 may be fed into the injector vessel 324 with drilling fluid, in a solution or slurry form, and/or be may be gravity fed into the injector vessel 324 via the conduit 320 and the valve 322. The solid material impactors 100 and the drilling fluid present in the injector vessel 324 mix to form a suspension of liquid in the form of drilling fluid and the solid material impactors 100, that is, to form an impactor slurry.

As a result of the introduction of the solid material impactors 100 into the injector vessel 324, drilling fluid present in the injector vessel is displaced and the volume of the displaced drilling fluid flows to the tank 340 via the line 338 and the valve 337. It is understood that the pump 342 may be operated to cause at least a portion of the displaced drilling fluid in the tank 340 to flow into the tank 318 via the line 344.

After the injector vessel 324 has been charged, that is, after the desired and relatively high volume of the solid material impactors 100 has been introduced into the injector vessel, the valve 322 is closed to prevent further introduction of solid material impactors 100 into the injector vessel, and the valve 337 is closed to prevent any further flow of drilling fluid to the tank 340. The cylinder 326 is then operated so that hydraulic cylinder fluid is introduced into the chamber 326*d* and, in response, the piston 326*a* applies pressure to the drilling fluid in the line 327, thereby pressurizing the line 327 and the injector vessel 324. The cylinder 326 pressurizes the line 327 and the injector vessel 324 until the pressure in the line 327 and the injector vessel 324 is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 328 is opened and, in response, a portion of the drilling fluid in the line 332 may flow through the valve 328 so that the respective pressures in the line portion 312*a*, the line 306, the line 332 and the injector vessel 324 further equalize to a pressure that still remains greater than the pressure in the line portion 312*b*.

The valve 334 is opened, thereby permitting the impactor slurry to flow through the line 335 and the orifice 336, and to the line portion 312*b*. It is understood that the pressure in the line 335 may be less than the pressure in the line 306 due to several factors such as, for example, the pressure drop associated with the flow of the impactor slurry through one or more components such as, for example, the valve 334 and the orifice 336. Notwithstanding this pressure drop, the pump 304 continues to maintain a pressurized flow of drilling fluid into the injector vessel 324 via the line 306, the valve 328 and the line 332. Due to the pressurized flow of drilling fluid, and the pressure drop across the orifice 310, the pressure in the line 335 is still greater than the pressure in the line portion 312*b* of the line 312. As a result, the impactor slurry having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the slurry from the injector vessel 324 to the line portion 312*b* via the line 335 and the orifice 336. In an exemplary embodiment, it is understood that the flow of impactor slurry delivered to the pipe string 55 via the line portion 312*b* of the line 312 may be accelerated and discharged to remove a portion of the formation 52 (FIG. 1) in a manner similar to that described above.

After the impactor slurry has been completely discharged from the injector vessel 324, the valves 328 and 334 are closed, thereby preventing any flow of drilling fluid from the tank 302, through the pump 304, the line 306, the line 332, the injector vessel 324, the valve 334, the orifice 336 and the line 335, and to the line portion 312*b* of the line 312. The cylinder 326 is then operated so that the hydraulic cylinder fluid in the chamber 326*d* is discharged therefrom. During this discharge, the pressurized drilling fluid still present in the line 327 and the injector vessel 324 applies pressure against the piston 326*a*. As a result, the pressure in the line 327 and the injector vessel 324 is reduced, and may be reduced to atmospheric pressure. The valve 337 may be opened, thereby permitting a volume of the pressurized drilling fluid that may still be present in the injector vessel 324 to be displaced, thereby causing additional drilling fluid to flow from the line 338 to the tank 340. As a result, the pressure in the injector vessel 324 may be vented, thereby facilitating its return to atmospheric pressure.

At this point, the injector vessel 324 is again in its initial condition, with the injector vessel full of drilling fluid and the valve 337 open, and the valves 322, 348, 372, 328, 354, 366, 308, 388, 334, 360 and 382 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 324 may be repeated by again opening the valve 322 to again charge the injector vessel 324, that is, to again permit introduction of the solid material impactors 100 into the injector vessel 324, as discussed above.

The individual operation of the injector vessel 350 will be described. In an exemplary embodiment, the individual operation of the injector vessel 350 is substantially similar to the operation of the injector vessel 324, with the conduit 346, the valve 348, the injector vessel 350, the cylinder 352, the piston 352*a*, the housing 352*b*, the chamber 352*c*, the chamber 352*d*, the valve 354, the line 353, the line 358, the valve 360, the orifice 362, the line 364 and the valve 366 operating in a manner substantially similar to the above-described operation of the conduit 320, the valve 322, the injector vessel 324, the cylinder 326, the piston 326*a*, the housing 326*b*, the chamber 326*c*, the chamber 326*d*, the valve 328, the line 327, the line 332, the valve 334, the orifice 336, the line 335 and the valve 337, respectively. The line 368 operates in a manner similar to the line 338, except that both the line 368 and the line 338 are used to vent the injector vessel 350 during its operation.

More particularly, the injector vessel 350 is initially full of drilling fluid and the valve 366 is open, while the valves 322, 348, 372, 328, 354, 337, 308, 388, 334, 360 and 382 remain closed. As a result of the valve 366 being open, the pressure in the injector vessel 350 is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 350, the valve 348 is opened and the conveyor 316 transports solid material impactors 100 from the reservoir 314 to the tank 318. Solid material impactors 100 are also transported from the tank 318 and into the injector vessel 350 via the conduit 346 and the valve 348, thereby charging the injector vessel with the solid material impactors. In an exemplary embodiment, the solid material impactors 100 may be fed into the injector vessel 350 with drilling fluid, in a solution or slurry form, and/or may be gravity fed into the injector vessel 350 via the conduit 346 and the valve 348. The solid material impactors 100 and the drilling fluid present in the injector vessel 350 mix to form a suspension of liquid in the form of drilling fluid and the solid material impactors 100, that is, to form an impactor slurry.

As a result of the introduction of the solid material impactors 100 into the injector vessel 350, drilling fluid present in the injector vessel is displaced and the volume of the displaced drilling fluid flows to the tank 340 via the lines 368 and 338 and the valve 366. It is understood that the pump 342 may be operated to cause at least a portion of the displaced drilling fluid in the tank 340 to flow into the tank 318 via the line 344.

After the injector vessel 350 has been charged, that is, after the desired and relatively high volume of the solid material impactors 100 has been introduced into the injector vessel, the valve 346 is closed to prevent further introduction of solid material impactors 100 into the injector vessel, and the valve 366 is closed to prevent any further flow of drilling fluid to the tank 340. The cylinder 352 is then operated so that hydraulic cylinder fluid is introduced into the chamber 352*d* and, in response, the piston 352*a* applies pressure to the drilling fluid in the line 353, thereby pressurizing the line 353 and the injector vessel 350. The cylinder 352 pressurizes the line 353 and the injector vessel 350 until the pressure in the line 353 and the injector vessel 350 is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 354 is opened and, in response, a portion of the drilling fluid in the line portion 358 may flow through the valve 354 so that the respective pressures in the line portion 312*a*, the line 306, the line 358 and the injector vessel 350 further equalize to a pressure that still remains greater than the pressure in the line portion 312*b*.

The valve 360 is opened, thereby permitting the impactor slurry to flow through the line 364 and the orifice 362, and to the line portion 312*b*. It is understood that the pressure in the line 364 may be less than the pressure in the line 306 due to several factors such as, for example, the pressure drop associated with the flow of the impactor slurry through one or more components such as, for example, the valve 360 and the orifice 362. Notwithstanding this pressure drop, the pump 304 continues to maintain a pressurized flow of drilling fluid into the injector vessel 350 via the line 306, the valve 354 and the line 358. Due to the pressurized flow of drilling fluid, and the pressure drop across the orifice 310, the pressure in the line 364 is still greater than the pressure in the line portion 312*b* of the line 312. As a result, the impactor slurry having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the slurry from the injector vessel 350 to the line portion 312*b* via the line 364 and the orifice 362. In an exemplary embodiment, it is understood that the flow of impactor slurry delivered to the pipe string 55 via the line portion 312*b* of the line 312 may be accelerated and discharged to remove a portion of the formation 52 (FIG. 1) in order to excavate the formation, in a manner similar to that described above.

After the impactor slurry has been completely discharged from the injector vessel 350, the valves 354 and 360 are closed, thereby preventing any flow of drilling fluid from the tank 302, through the pump 304, the line 306, the line 358, the injector vessel 350, the valve 360, the orifice 362 and the line 364, and to the line portion 312*b* of the line 312. The cylinder 352 is then operated so that the hydraulic cylinder fluid in the chamber 352*d* is discharged therefrom. During this discharge, the pressurized drilling fluid still present in the line 353 and the injector vessel 350 applies pressure against the piston 352*a*. As a result, the pressure in the line 353 and the injector vessel 350 is reduced, and may be reduced to atmospheric pressure. The valve 366 may be opened, thereby permitting a volume of the pressurized drilling fluid that may still be present in the injector vessel 350 to be displaced via the line 368, thereby causing additional drilling fluid to flow from the line 338 to the tank 340. As a result, the pressure in the injector vessel 350 may be vented, thereby facilitating its return to atmospheric pressure.

At this point, the injector vessel 350 is again in its initial condition, with the injector vessel full of drilling fluid and the valve 366 open, and the valves 322, 348, 372, 328, 354, 337, 308, 388, 334, 360 and 382 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 350 may be repeated by again opening the valve 348 to again charge the injector vessel 350, that is, to again permit introduction of the solid material impactors 100 into the injector vessel 350, as discussed above.

The individual operation of the injector vessel 374 will be described. In an exemplary embodiment, the individual operation of the injector vessel 374 is substantially similar to the operation of the injector vessel 324, with the conduit 370, the valve 372, the injector vessel 374, the cylinder 376, the piston 376*a*, the housing 376*b*, the chamber 376*c*, the chamber 376*d*, the valve 308, the line 378, the line 380, the valve 382, the orifice 384, the line 386 and the valve 388 operating in a manner substantially similar to the above-described operation of the conduit 320, the valve 322, the injector vessel 324, the cylinder 326, the piston 326*a*, the housing 326*b*, the chamber 326*c*, the chamber 326*d*, the valve 328, the line 327, the line 332, the valve 334, the orifice 336, the line 335 and the valve 337, respectively. The line 390 operates in a manner similar to the line 338, except that both the line 390 and the line 338 are used to vent the injector vessel 374 during its operation.

More particularly, the injector vessel 374 is initially full of drilling fluid and the valve 388 is open, while the valves 322, 348, 372, 328, 354, 366, 308, 337, 334, 360 and 382 remain closed. As a result of the valve 388 being open, the pressure in the injector vessel 374 is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 374, the valve 372 is opened and the conveyor 316 transports solid material impactors 100 from the reservoir 314 to the tank 318. Solid material impactors 100 are also transported from the tank 318 and into the injector vessel 374 via the conduit 370 and the valve 372, thereby charging the injector vessel with the solid material impactors. In an exemplary embodiment, the solid material impactors 100 may be fed into the injector vessel 374 with drilling fluid, in a solution or slurry form, and/or may be gravity fed into the injector vessel 374 via the conduit 370 and the valve 372. In an exemplary embodiment, the solid material impactors 100 may be gravity fed into the injector vessel 374 via the conduit 370 and the valve 372. The solid material impactors 100 and the drilling fluid present in the injector vessel 374 mix to form a suspension of liquid in the form of drilling fluid and the solid material impactors 100, that is, to form an impactor slurry.

As a result of the introduction of the solid material impactors 100 into the injector vessel 374, drilling fluid present in the injector vessel is displaced and the volume of the displaced drilling fluid flows to the tank 340 via the lines 390 and 338 and the valve 337. It is understood that the pump 342 may be operated to cause at least a portion of the displaced drilling fluid in the tank 340 to flow into the tank 318 via the line 344.

After the injector vessel 374 has been charged, that is, after the desired and relatively high volume of the solid material impactors 100 has been introduced into the injector vessel, the valve 372 is closed to prevent further introduction of solid material impactors 100 into the injector vessel, and the valve 388 is closed to prevent any further flow of drilling fluid to the tank 340. The cylinder 376 is then operated so that hydraulic cylinder fluid is introduced into the chamber 376*d* and, in response, the piston 376*a* applies pressure to the drilling fluid in the line 378, thereby pressurizing the line 378, the line 380 and the injector vessel 374. The cylinder 376 pressurizes the line 378 and the injector vessel 374 until the pressure in the line 378 and the injector vessel 374 is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 308 is opened and, in response, a portion of the drilling fluid in the line portion 306 may flow through the valve 308 so that the respective pressures in the line portion 312*a*, the line 306, the line 380 and the injector vessel 374 further equalize to a pressure that still remains greater than the pressure in the line portion 312*b*.

The valve 382 is opened, thereby permitting the impactor slurry to flow through the line 386 and the orifice 384, and to the line portion 312*b*. It is understood that the pressure in the line 386 may be less than the pressure in the line 306 due to several factors such as, for example, the pressure drop associated with the flow of the impactor slurry through one or more components such as, for example, the valve 382 and the orifice 384. Notwithstanding this pressure drop, the pump 304 continues to maintain a pressurized flow of drilling fluid into the injector vessel 374 via the line 306, the valve 308 and the line 380. Due to the pressurized flow of drilling fluid, and the pressure drop across the orifice 310, the pressure in the line 386 is still greater than the pressure in the line portion 312*b* of the line 312. As a result, the impactor slurry having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the slurry from the injector vessel 374 to the line portion 312*b* via the line 386 and the orifice 384. In an exemplary embodiment, it is understood that the flow of impactor slurry delivered to the pipe string 55 via the line portion 312*b* of the line 312 may be accelerated and discharged to remove a portion of the formation 52 (FIG. 1) in order to excavate the formation, in a manner similar to that described above.

After the impactor slurry has been completely discharged from the injector vessel 374, the valves 308 and 382 are closed, thereby preventing any flow of drilling fluid from the tank 302, through the pump 304, the line 306, the line 380, the injector vessel 374, the valve 382, the orifice 384 and the line 386, and to the line portion 312*b* of the line 312. The cylinder 376 is then operated so that the hydraulic cylinder fluid in the chamber 376*d* is discharged therefrom. During this discharge, the pressurized drilling fluid still present in the line 378 and the injector vessel 374 applies pressure against the piston 376*a*. As a result, the pressure in the line 378 and the injector vessel 374 is reduced, and may be reduced to atmospheric pressure. The valve 388 is opened, thereby permitting a volume of the pressurized drilling fluid that may still be present in the injector vessel 374 to be displaced via the line 390, thereby causing additional drilling fluid to flow from the line 338 to the tank 340. As a result, the pressure in the injector vessel 374 may be vented, thereby facilitating its return to atmospheric pressure.

At this point, the injector vessel 374 is again in its initial condition, with the injector vessel full of drilling fluid and the valve 388 open, and the valves 322, 348, 372, 328, 354, 366, 308, 337, 334, 360 and 382 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 374 may be repeated by again opening the valve 372 to again charge the injector vessel 374, that is, to again permit introduction of the solid material impactors 100 into the injector vessel 374, as discussed above.

Referring to the table in FIG. 22 with continuing reference to FIG. 21, although the individual operation of the injector vessel 350 is substantially similar to the operation of the injector vessel 324, the initiation of the operation of the injector vessel 350, in an exemplary embodiment, is staggered in time from the initiation of the operation of the injector vessel 324. Similarly, although the individual operation of the injector vessel 374 is substantially similar to the operation of each of the injector vessels 324 and 350, the initiation of the operation of the injector vessel 374, in an exemplary embodiment, is staggered in time from the initiations of operation of both of the injector vessels 324 and 350. As a result, each of the injector vessels 324, 350 and 374 undergoes a different operational step at one or more times during the operation of the system 300.

For example and with reference to the row of operational steps corresponding to the time period labeled "Time 3" in the table shown in FIG. 22, during the above-described injection of impactor slurry into the line portion 312*b* and to the pipe string 55 by the injector vessel 324, the injector vessel 350 may be pressurized using the cylinder 352 until the pressure in the injector vessel is greater than the pressure in the line portion 312*b*, and is less than, substantially or nearly equal to, or greater than, the pressure in the line 306 which, as noted above, is substantially equal to the supply pressure of the pump 304. During the pressurization of the injector vessel 350 using the cylinder 352, the pistons 326*a* and 376*a* do not apply pressure against the drilling fluid in the lines 327 and 378, respectively, so that only the injector vessel 350 is pressurized.

Moreover, and again during the injection of impactor slurry into the line portion 312*b* and to the pipe string 55 by the injector vessel 324, the injector vessel 376 may be charged with the desired volume of solid material impactors 100 by opening the valve 372 and permitting the solid material impactors 100 to be transported from the tank 318 to the injector vessel 376 via the valve and the conduit 370. During the charging of the injector vessel 376 with the solid material impactors 100, the valves 322 and 348 are closed to prevent any charging of the injector vessels 324 and 350, respectively, so that only the injector vessel 374 is charged with the solid material impactors.

With reference to the row of operational blocks corresponding to the time period labeled "Time 4" in the table shown in FIG. 22, which corresponds to another time period after the injection of the impactor slurry by the injector vessel 324, pressurization of the injector vessel 350, and charging of the injector vessel 374, the injector vessel 324 may be again charged with the desired volume of solid material impactors 100.

During the charging of the injector vessel 324, the injector vessel 350 may inject impactor slurry into the line portion 312*b* of the line 312, and to the pipe string 55, through the open valve 360, the orifice 362 and the line 364. During the injection by the injector vessel 350, the valves 334 and 382 are closed to prevent any injection into the line portion 312*b* by the injector vessels 324 and 376, respectively.

Moreover, and again during the charging of the injector vessel 324, the injector vessel 374 may be pressurized using the cylinder 376 until the pressure in the injector vessel is greater than the pressure in the line portion 312*b*, and is less than, substantially or nearly equal to, or greater than, the pressure in the line 306 which, as noted above, is substantially equal to the supply pressure of the pump 304. During the pressurization of the injector vessel 374 by the cylinder 376, the pistons 326*a* and 352*a* do not apply pressure against the drilling fluid in the lines 327 and 353, respectively, so that only the injector vessel 374 is pressurized.

With reference to the row of operational blocks corresponding to the time period labeled "Time 5" in the table shown in FIG. 22, which corresponds to another time period after the charging of the injector vessel 324, injection of impactor slurry by the injector vessel 350, and pressurization of the injector vessel 374, the injector vessel 324 may be again pressurized using the cylinder 326 until the pressure in the injector vessel 324 is greater than the pressure in the line portion 312*b*, and is less than, substantially equal to, or greater than, the pressure in the line 306 which, as noted above, is substantially equal to the supply pressure of the pump 304.

During the pressurization of the injector vessel 324, the injector vessel 350 may be charged with the desired volume of solid material impactors 100 by opening the valve 348 and permitting the solid material impactors 100 to be transported from the tank 318 to the injector vessel 350 via the valve and the conduit 346. During the charging of the injector vessel 350 with the solid material impactors 100, the valves 322 and 372 are closed to prevent any charging of the injector vessels 324 and 374, respectively, so that only the injector vessel 350 is charged with the solid material impactors.

Moreover, and again during the pressurization of the injector vessel 324, the injector vessel 374 may inject impactor slurry into the line portion 312*b* of the line 312, and to the pipe string 55, through the open valve 382, the orifice 384 and the line 386. During the injection by the injector vessel 374, the valves 334 and 360 are closed to prevent any injection into the line portion 312*b* by the injector vessels 324 and 350, respectively.

In view of the foregoing, it is understood that, during at least portions of one or more time periods during the operation of the system 300, one of the injector vessels 324, 350 and 374 will be undergoing charging, that is, receiving a desired volume of solid material impactors 100, while another of the injector vessels will be undergoing pressurization to a pressure substantially or nearly equal to the supply pressure of the pump 304, and while yet another of the injector vessels will be injecting impactor slurry into the line portion 312*b* and to the pipe string 55. As a result, a constant, generally uniformly distributed and relatively-high-pressure injection of impactor slurry will be injected into and flow through a flow region defined by the line portion 312*b* of the line 312 and to the pipe string 55 during the operation of the system 300, with the impactor slurry having a relatively high volume of solid material impactors 100. It is understood that, during a particular time period during the operation of the system 300, the charging of one of the injector vessels 324, 350 and 374 may occur before, during and/or after the pressurization of another of the injector vessels 324, 350 and 374 which, in turn, may occur before, during and/or after the injection of impactor slurry by yet another of the injector vessels 324, 350 and 374. It is understood that, during a particular time period of operation of the system 300, the charging of one of the injector vessels 324, 350 and 374 may occur simultaneously with, at least partially simultaneously with, or not simultaneously with the pressurization of another of the injector vessels 324, 350 and 374 which, in turn, may occur simultaneously with, at least partially simultaneously with, or not simultaneously with the injection of impactor slurry by yet another of the injector vessels 324, 350 and 374.

It is understood that the sequence of operation of each of the injector vessels 324, 350 and 374 is substantially the same, but that the initiation of the operational sequence of each injector vessel is controlled relative to the initiation of the operational sequences of the other injector vessels. The sequential injection of impactor slurry by the injector vessels 324, 350 and 374 may be controlled to achieve the desired or required mass flow rate of impactor slurry in the line portion 312*b*.

It is further understood that a wide variety of time-staggering configurations between the initiations of operation of the injector vessels 324, 350 and 374 may be employed during the operation of the system 300. Also, it is understood that the order of operation depicted in FIG. 22 is arbitrary and may be modified. For example, the order of initial operation, that is, the time-staggering order, between the injector vessels 324, 350 and 374 may be modified. In an exemplary embodiment, it is understood that each of the time steps or time periods needed to charge one of the injector vessels 324, 350 and 374, pressurize one of the injector vessels 324, 350 and 374, and/or permit one of the injectors 324, 350 and 374 to inject impactor slurry may not be constant and may vary among each other. Moreover, in an exemplary embodiment, the time period or time step required to charge and/or pressurize one or more of the injector vessels 324, 350 and 374, and/or the time step or time period required to permit one or more of the injector vessels 324, 350 and 374 to inject impactor slurry, may vary as time passes.

Moreover, it is understood that the above-described initial conditions of the system 300, and/or one or more of the injector vessels 324, 350 and 374 may be arbitrary and that additional operational steps may be necessary to carry out the above-described operation of the system. For example, if the injector vessel 324 is not initially full of drilling fluid, it is understood that the injector vessel 324 may be filled with drilling fluid.

It is understood that the quantity of injector vessels in the system 300 may be decreased to two injector vessels or one injector vessel, or may be increased to an unlimited number. In an exemplary embodiment, the quantity of injector vessels in the system 300 may be increased to an unlimited number for one or more reasons such as, for example, redundancy and/or maintenance reasons. It is further understood that the quantity of injector vessels may be dictated by many factors, including the desired or required mass flow rates of the solid material impactors 100 and/or the impactor slurry containing drilling fluid and the solid material impactors 100, the desire or requirement to smooth the injection of impactor slurry, and/or the desire or requirement to more evenly distribute the solid material impactors 100 within the flowing impactor slurry.

Further, it is understood that the valves 322, 348, 372, 328, 354, 366, 308, 388, 334, 360 and 382 may be controlled in any conventional manner, including the opening and closing thereof. Also, it is understood that each of the valves 322, 348, 372, 328, 354, 366, 308, 388, 334, 360 and 382 may be controlled to fully open, fully close, partially open and/or partially close, in order to achieve operational goals and/or requirements such as, for example, the desired or required mass flow rate of impactor slurry and/or the solid material impactors 100.

Figure 23:
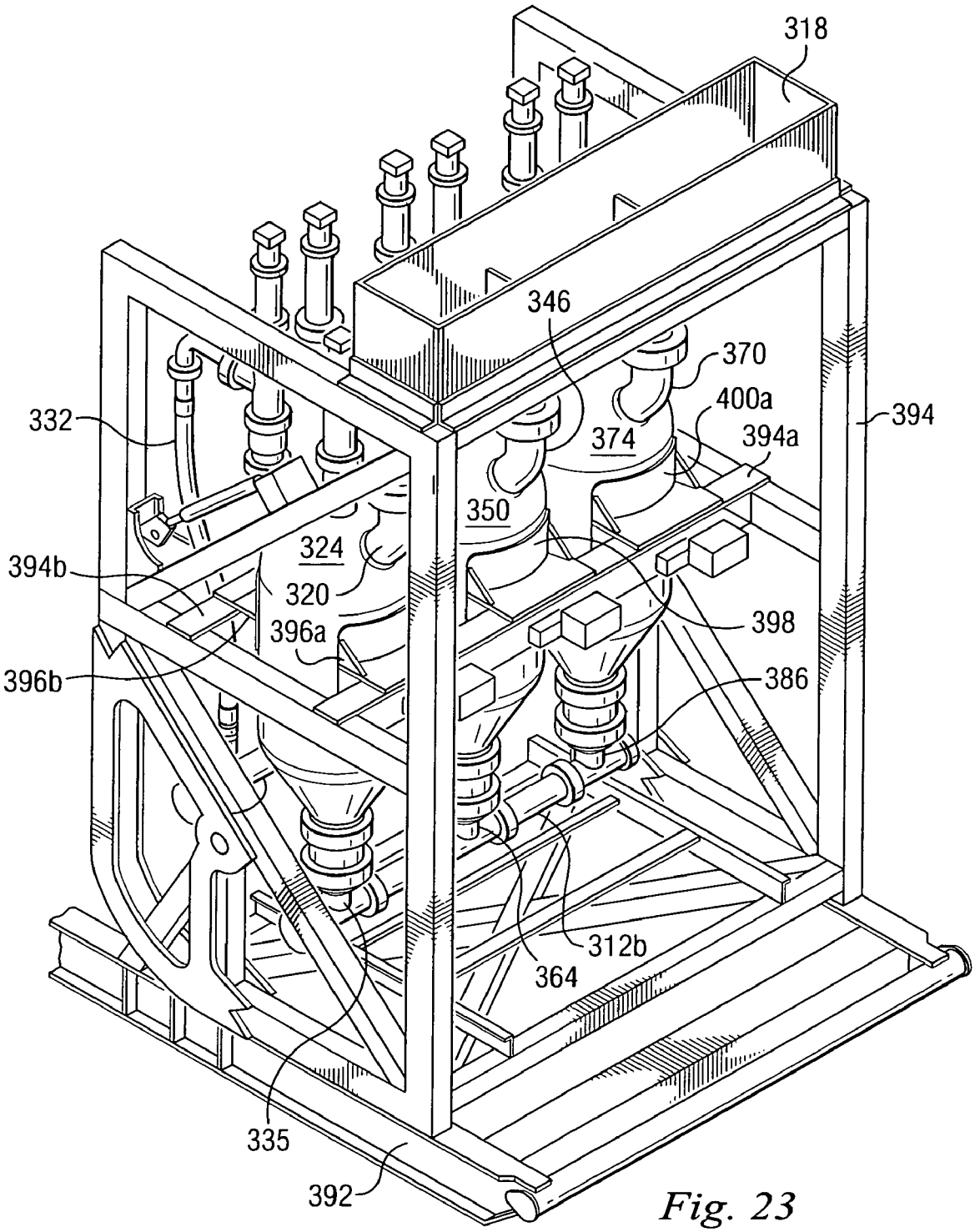
FIG. 23 is a perspective view of a portion of the injection system of FIG. 21 according to an embodiment, the portion including a plurality of injector vessels.
Figure 24:
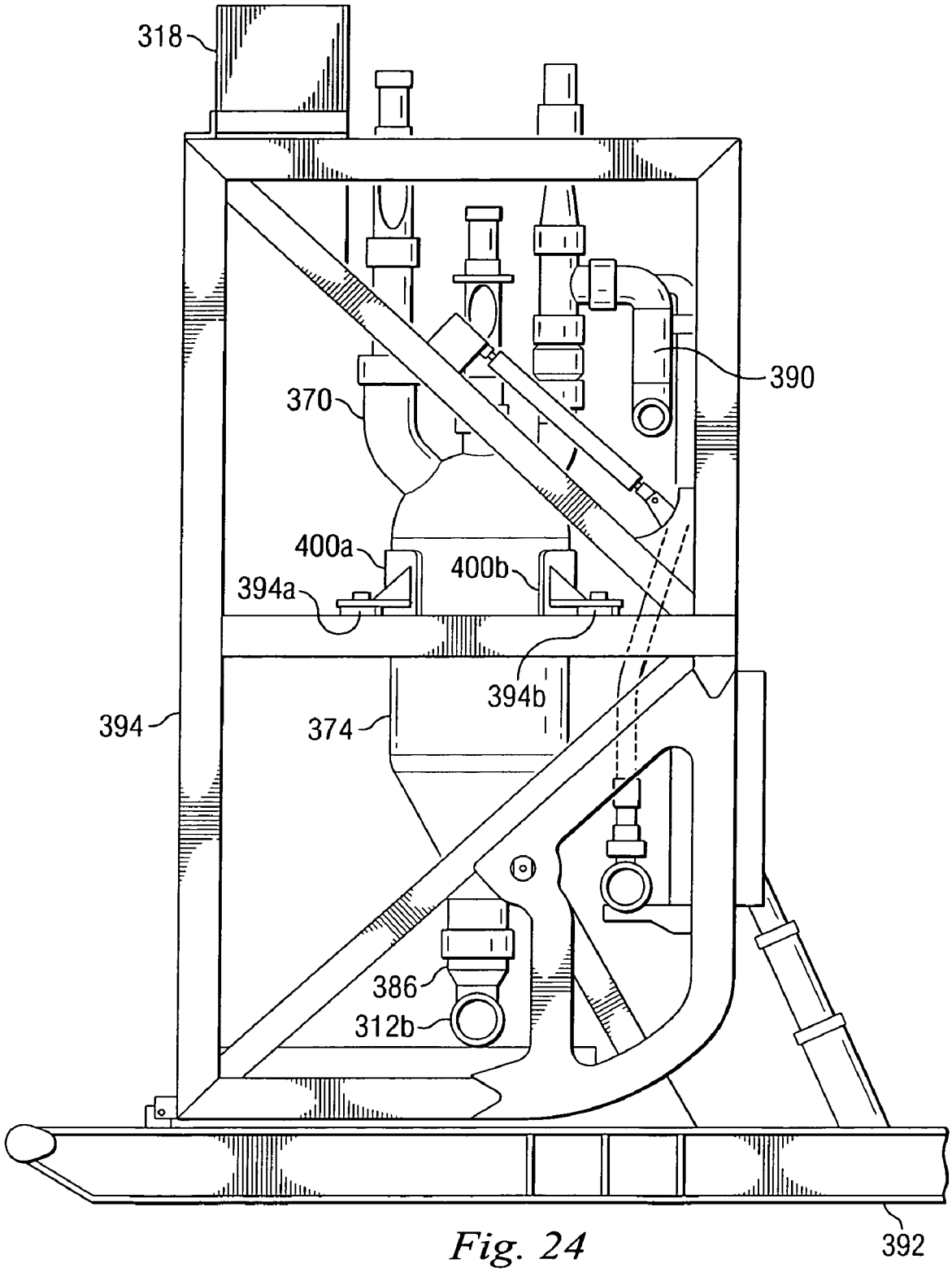
FIG. 24 is an elevational view of the portion of the injection system of FIG. 23.

In an exemplary embodiment, as illustrated in FIGS. 23-24 with continuing reference to FIGS. 21-22, the injector vessels 324, 350 and 374 of the injection system 300 are mounted on a skid 392 and are supported by a frame structure 394 extending from the skid. Symmetric support brackets 396*a* and 396*b* connect the injector vessel 324 to horizontally-extending members 394*a* and 394*b*, respectively, of the frame structure 394. Similarly, a support bracket 398 connects the injector vessel 350 to the member 394*a* and another support bracket, symmetric to the support bracket 398 and not shown, connects the injector vessel 350 to the member 394*b*. Symmetric support brackets 400*a* and 400*b* connect the injector vessel 374 to the members 394*a* and 394*b*, respectively. Several additional components of the injection system 300 are shown in FIGS. 23 and/or 24, including the tank 318; the conduits 320, 346 and 370; the line portion 312*b* of the line 312; the lines 335, 364 and 386; the line 338; the line 390; and the line 380. It is understood that one or more additional components of the system 300 may be mounted on the skid and/or supported by the frame structure 394, such as, for example, the pumps 304 and/or 342, the cylinders 326, 352 and/or 376, and/or the tanks 302 and/or 340.

Figure 25:
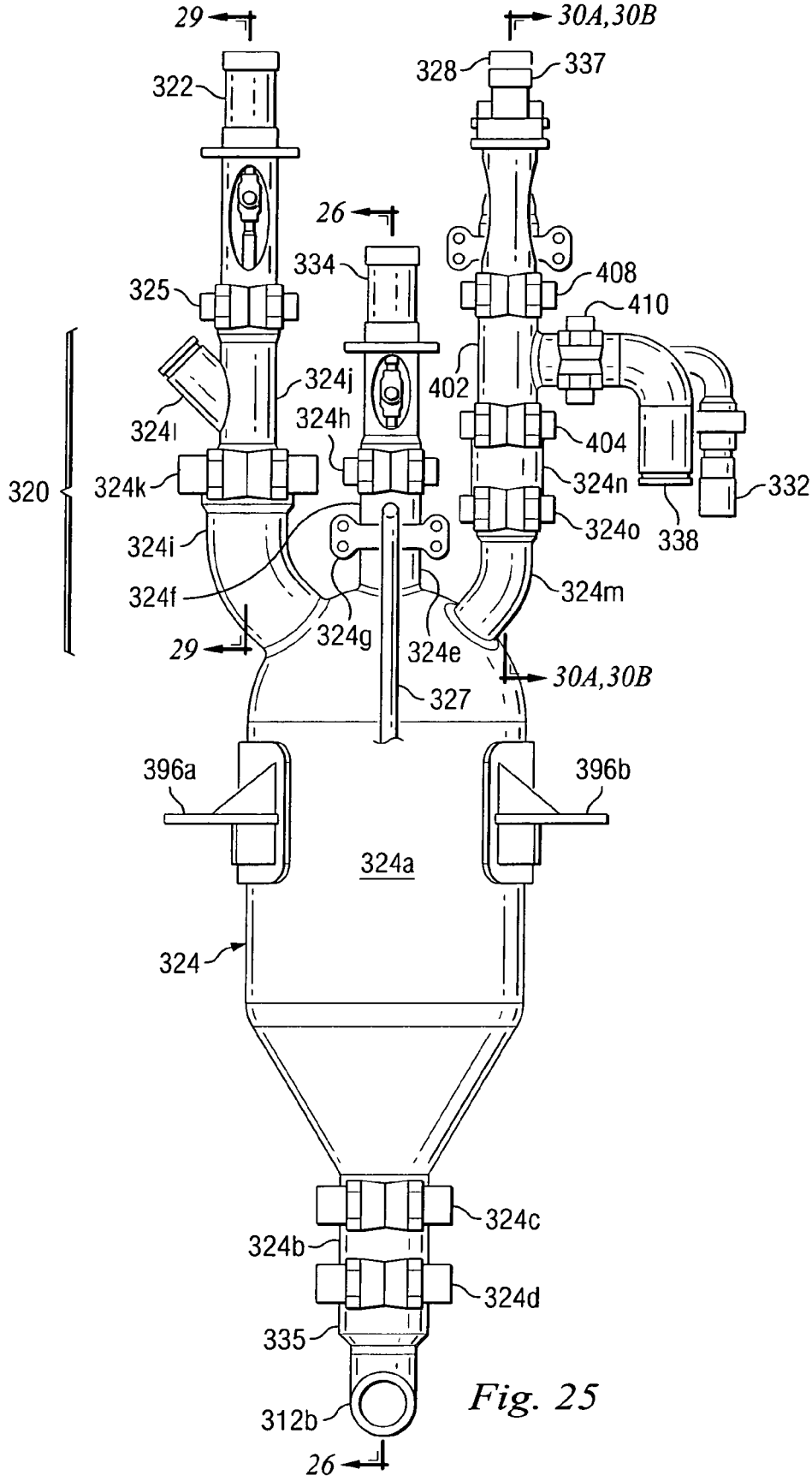
FIG. 25 is an elevational view of an injector vessel of the portion of the injection system of FIG. 23.

In an exemplary embodiment, as illustrated in FIG. 25, the injector vessel 324 includes a body 324*a* and a tubular spool 324*b* connected to the body via a clamping ring 324*c*. The line 335 is connected to the tubular spool 324*b* via a clamping ring

324*d*. A tubular portion 324*e* extends upwards from the body 324*a* and is connected to a tubular portion 324*f* via a clamping ring 324*g*. The line 327 is connected to the tubular portion 324*f*; and the tubular portion is connected to the valve 334 via a clamping ring 324*h*. The valve 334 will be described in greater detail below.

A tubular portion 324*i* extends from the body 324*a* and is connected to a tubular portion 324*j* via a clamping ring 324*k*, and a tubular portion 324*l* extends from the tubular portion 324*j*. The valve 322 is connected to the tubular portion 324*j* via a clamping ring 325. The valve 322 will be described in greater detail below. It is understood that the tubular portions 324*i*, 324*j* and 324*l* collectively define the conduit 320 that connects the tank 318 to the body 324*a* of the injector vessel 324. It is further understood that one or more additional intervening parts may extend between the tubular portion 324*l* and the tank 318, and that these one or more additional intervening parts may collectively define the conduit 320 that connects the tank 18 to the body 324*a* of the injector 324, along with the tubular portions 324*i*, 324*j* and 324*l*.

A tubular portion 324*m* extends from the body 324*a* and is connected to a tubular portion 324*n* via a clamping ring 324*o*. A tee 402 is connected to the tubular portion 324*n* via a clamping ring 404. The valve 337 is connected to the tee 402 via a clamping ring 408. The valve 328 is connected to the body 324*a* of the injector vessel 324 via intervening parts not shown and in a manner to be described below.

The line 338 is connected to the tee 402 via a clamping ring 410. The line 332 is connected to the body 324*a* of the injector vessel 324 via intervening parts not shown and in a manner to be described below. It is understood that only portions of the lines 327, 332 and 338 are shown in FIG. 25.

Figure 26:
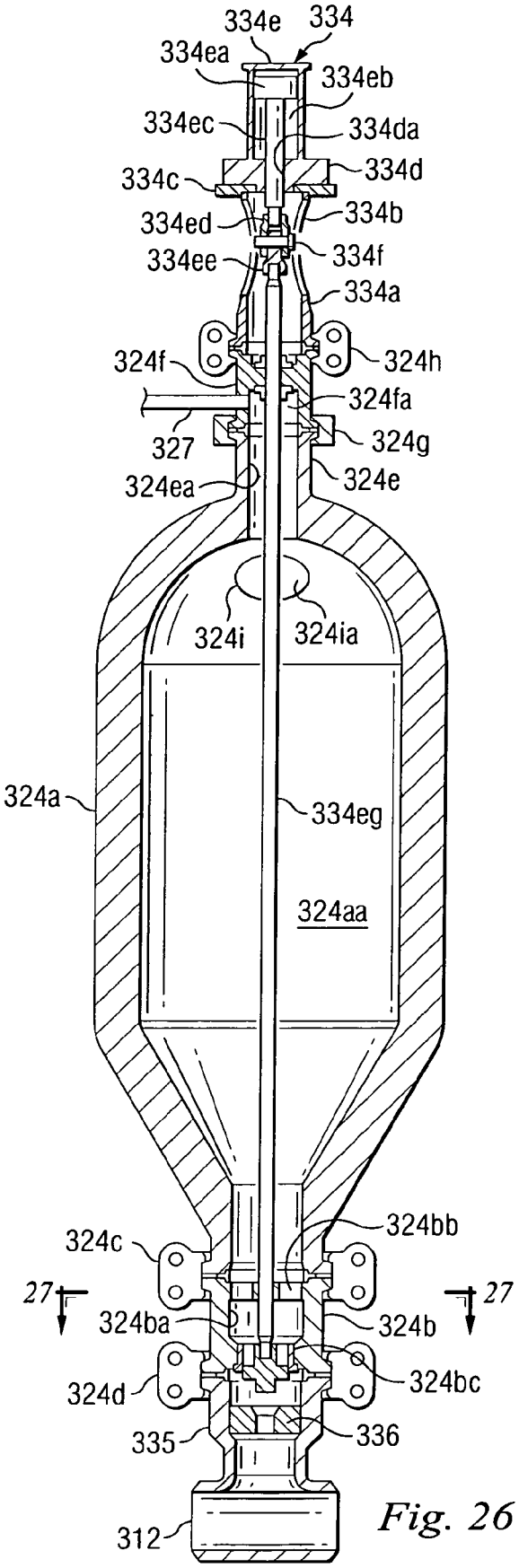
FIG. 26 is a sectional view of the injector vessel of FIG. 25 taken along line 26-26.
Figure 27:
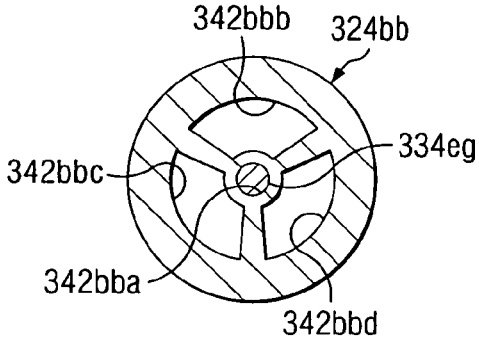
FIG. 27 is a sectional view of the injector vessel of FIG. 26 taken along line 27-27.
Figure 28:
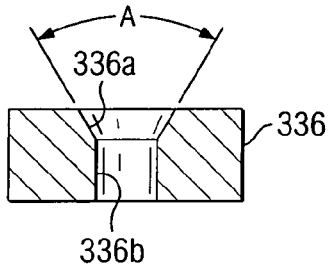
FIG. 28 is an enlarged view of a portion of the injector vessel of FIG. 26.

In an exemplary embodiment, as illustrated in FIGS. 26-28, the body 324*a* of the injector vessel 324 defines a variable-diameter chamber 324*aa*, and the tubular portion 324*i* defines a passage 324*ia*. The tubular spool 324*b* defines a passage 324*ba* and includes a radially-extending disc 324*bb* disposed within the passage in the vicinity of the clamping ring 324*c*. The disc 324*bb* includes an axially-extending through-bore 324*bba* and three circumferentially-spaced through-openings 324*bbb*, 324*bbc* and 324*bbd*. A plug seat 324*bc* is connected to the interior surface of the tubular spool 324*b* and extends within the passage 324*ba*.

The orifice 336 is connected to the interior surface of and radially extends within the line 335, and includes a countersunk opening 336*a* and a through-bore 336*b* extending therefrom. In an exemplary embodiment, the countersunk opening 336*a* defines an angle A. In an exemplary embodiment, the angle A may be 30 degrees, resulting in the orifice 336 defining a 30-degree-metering throat that is adapted to meter fluid flow through the orifice 336. It is understood that the angle A may vary widely.

The tubular portions 324*e* and 324*f* define passages 324*ea* and 324*fa*, respectively. The valve 334 includes a generally hour-glass-shaped support member 334*a*, through which a window 334*b* extends, and an end of which is connected to the tubular portion 324*f* via the clamping ring 324*h*. A support collar 334*c* is coupled to the other end of the support member 334*a*, and a housing base 334*d* is coupled to and extends through the collar 334*c*, and defines a bore 334*da*. A hydraulic-actuated and/or pneumatic-actuated cylinder 334*e* is connected to the housing base 334*d*, and includes a piston 334*ea* that reciprocates in a housing 334*eb* in response to cylinder fluid being introduced into, and discharged from, the housing, in a conventional manner.

An end of a rod 334*ec* is connected to and extends downward from the piston 334*ea*, extending through the bore 334*da* and into the support member 334*a*. The other end of the rod 334*ec* is connected to a coupling 334*ed* which in turn, is connected to a coupling 334*ee* via a pin 334*ef*. An end of a shaft 334*eg* is connected to the coupling 334*ee*, and the shaft extends downwards through the support member 334*a*, through the passages 324*fa* and 324*ea* of the tubular portions 324*f* and 324*e*, respectively, through the chamber 324*aa*, the bore 324*bba* of the disc 324*bb* of the tubular spool 324*b*, and the passage 324*ba* of the tubular spool, and at least partially within the plug seat 324*bc*. The disc 324*bb* is adapted to support and/or stabilize the shaft 334*eg*. A plug element 334*eh* is connected to the other end of the shaft 334*eg*, and at least partially extends within the line 335 at an axial position above the orifice 336. The plug element is 334*eh* is adapted to move up and down in response to the reciprocating motion of the piston 334*ea*, and thus engage and disengage, respectively, the plug seat 324*bc* to close and open, respectively, the valve 334.

Figure 29:
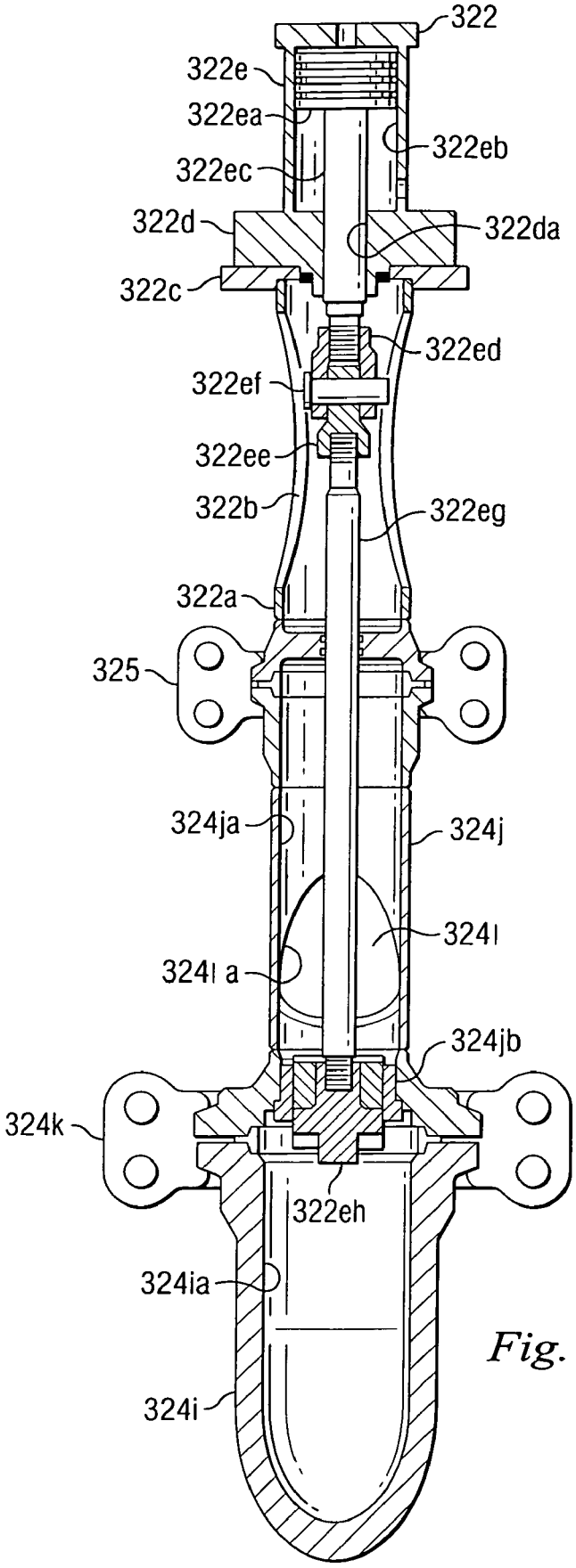
FIG. 29 is a sectional view of the injector vessel of FIG. 25 taken along line 29-29.

In an exemplary embodiment, as illustrated in FIG. 29, the tubular portion 324*i* of the injection vessel 324 defines the passage 324*ia*, as noted above. The tubular portions 324*j* and 324*l* define passages 324*ja* and 324*la*, respectively. A plug seat 324*jb* is connected to the interior surface of the tubular portion 324*j* and extends within the passage 324*ja*.

The valve 322 includes a generally hour-glass-shaped support member 322*a*, through which a window 322*b* extends, and an end of which is connected to the tubular portion 324*j* via the clamping ring 325. A support collar 322*c* is coupled to the other end of the support member 322*a*, and a housing base 322*d* is coupled to and extends through the collar 322*c*, and defines a bore 322*da*. A hydraulic-actuated and/or pneumatic-actuated cylinder 322*e* is connected to the housing base 322*d*, and includes a piston 322*ea* that reciprocates in a housing 322*eb* in response to cylinder fluid being introduced into, and discharged from, the housing, in a conventional manner.

An end of a rod 322*ec* is connected to and extends downward from the piston 322*ea*, extending through the bore 322*da* and into the support member 322*a*. The other end of the rod 322*ec* is connected to a coupling 322*ed* which, in turn, is connected to a coupling 322*ee* via a pin 322*ef*. An end of a shaft 322*eg* is connected to the coupling 322*ee*, and the shaft extends downwards through the support member 322*a*, through the passage 324*ja* of the tubular portion 324*j*, and at least partially within the plug seat 324*jb*. A plug element 322*eh* is connected to the other end of the shaft 322*eg*, and at least partially extends within the passage 324*ia*. The plug element 322*eh* is adapted to move up and down in response to the reciprocating motion of the piston 322*ea*, and thus engage and disengage, respectively, the plug seat 324*jb* to close and open, respectively, the valve 322.

Figure 30B:
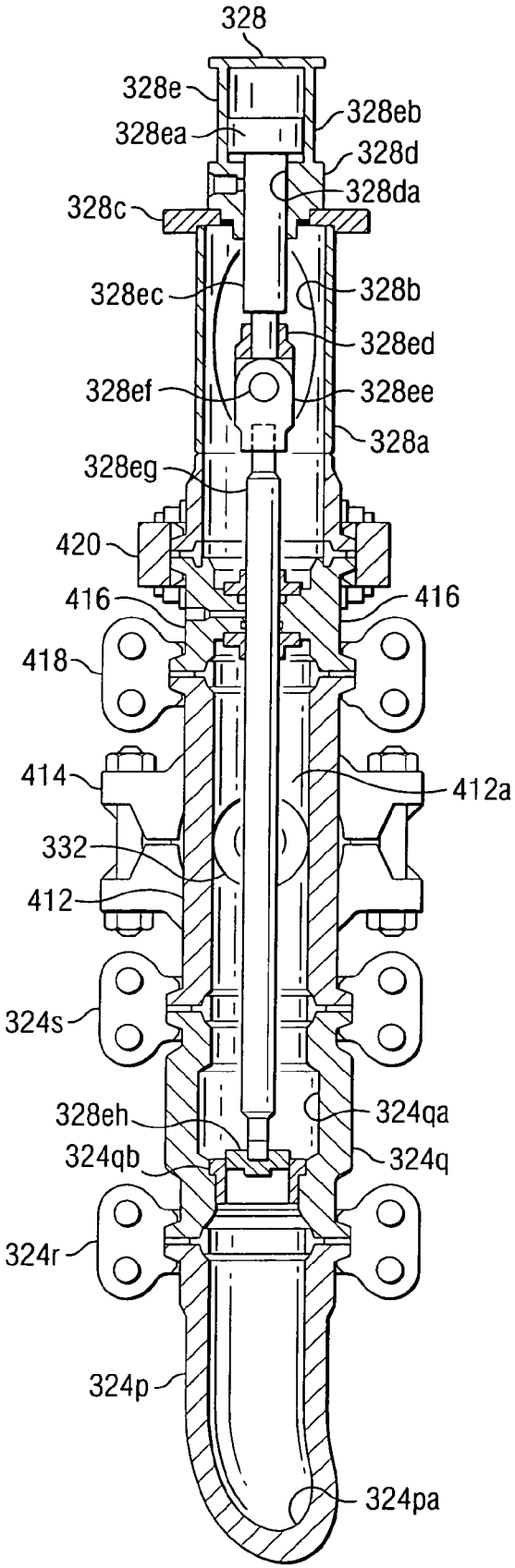
FIGS. 30A-30B are co-planar sectional views of the injector vessel of FIG. 25 taken along line 30A, 30B-30A, 30B.
Figure 30A:
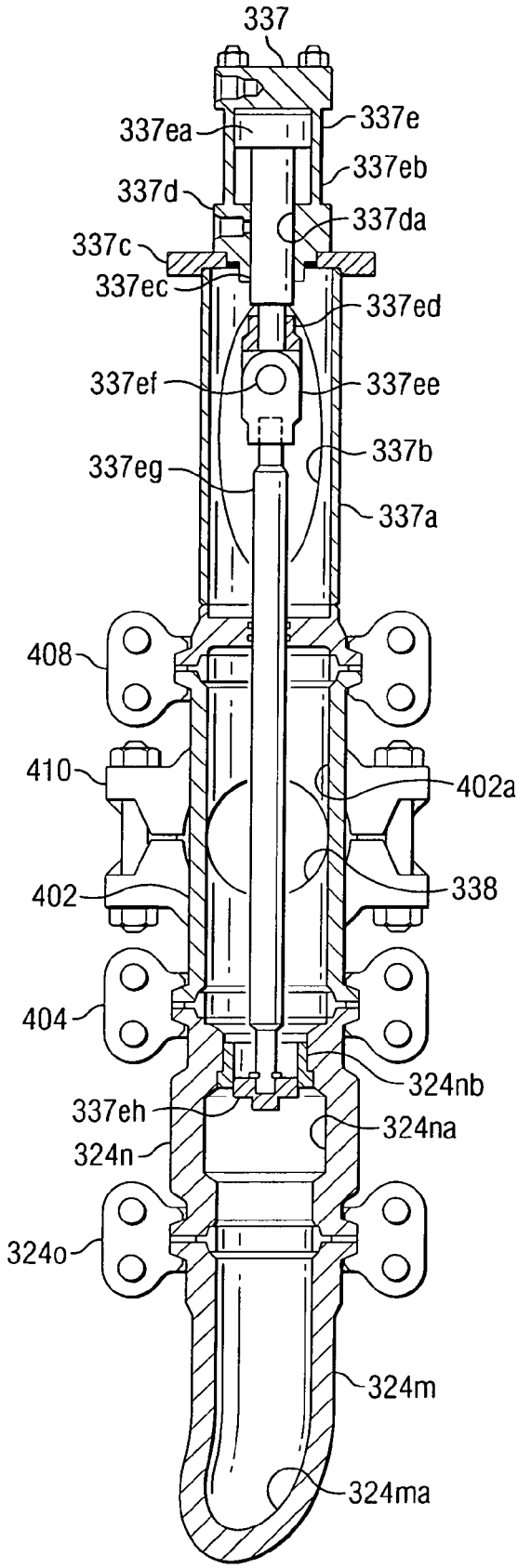

In an exemplary embodiment, as illustrated in FIG. 30A, the tubular portions 324*m* and 324*n* define passages 324*ma* and 324*na*, respectively, and the tee 402 defines a passage 402*a*. A plug seat 324*nb* is connected to the interior surface of the tubular portion 324*n* and extends within the passage 324*na*.

The valve 337 includes a generally hour-glass-shaped support member 337*a*, through which a window 337*b* extends, and an end of which is connected to the tee 402 via the clamping ring 408. A support collar 337*c* is coupled to the other end of the support member 337*a*, and a housing base 337*d* is coupled to and extends through the collar 337*c*, and defines a bore 337*da*. A hydraulic-actuated and/or pneumatic-actuated cylinder 337*e* is connected to the housing base 337*d*, and includes a piston 337*ea* that reciprocates in a housing 337*eb* in response to cylinder fluid being introduced into, and discharged from, the housing, in a conventional manner.

An end of a rod 337*ec* is connected to and extends downward from the piston 337*ea*, extending through the bore 337*da* and into the support member 337*a*. The other end of the rod 337*ec* is connected to a coupling 337*ed* which, in turn, is connected to a coupling 337*ee* via a pin 337*ef*. An end of a shaft 337*eg* is connected to the coupling 337*ee*, and the shaft extends downwards through the support member 337*a*, through the passage 402*a* of the tee 402, and at least partially within the plug seat 324*nb*. A plug element 337*eh* is connected to the other end of the shaft 337*eg*, and at least partially extends within the passage 324*na* of the tubular portion 324*n*. The plug element is 337*eh* is adapted to move up and down in response to the reciprocating motion of the piston 337*ea*, and thus engage and disengage, respectively, the plug seat 324*nb* to close and open, respectively, the valve 337.

In an exemplary embodiment, as illustrated in FIG. 30B and noted above, the valve 328 is connected to the body 324*a* of the injector vessel 324 via intervening parts, which include a tubular portion 324*p* extending from the body 324*a* that defines a passage 324*pa*, and a tubular portion 324*q* connected to the tubular portion 324*p*, via a clamping ring 324*r*, and that defines a passage 324*qa*. A plug seat 324*qb* is connected to the interior surface of the tubular portion 324*q* and extends within the passage 324*qa*. A clamping ring 324*s* connects the tubular portion 324*q* to a tee 412 which, in turn, is connected to the line 338 via a clamping ring 414. The tee 412 defines a passage 412*a*. A coupling member 416 is connected to the tee 412 via a clamping ring 418.

The valve 328 is connected to the coupling member 416 via a clamping ring 420. The valve 328 includes a generally hour-glass-shaped support member 328*a*, through which a window 328*b* extends, and an end of which is connected to the coupling member 416 via the clamping ring 420. A support collar 328*c* is coupled to the other end of the support member 328*a*, and a housing base 328*d* is coupled to and extends through the collar 328*c*, and defines a bore 328*da*. A hydraulic-actuated and/or pneumatic-actuated cylinder 328*e* is connected to the housing base 328*d*, and includes a piston 328*ea* that reciprocates in a housing 328*eb* in response to cylinder fluid being introduced into, and discharged from, the housing, in a conventional manner.

An end of a rod 328*ec* is connected to and extends downward from the piston 328*ea*, extending through the bore 328*da* and into the support member 328*a*. The other end of the rod 328*ec* is connected to a coupling 328*ed* which, in turn, is connected to a coupling 328*ee* via a pin 328*ef*. An end of a shaft 328*eg* is connected to the coupling 328*ee*, and the shaft extends downwards through the support member 328*a*, through the coupling member 416, through the passage 412*a* of the tee 412, and at least partially within the passage 324*qa* of the tubular portion 324*q*. A plug element 328*eh* is connected to the other end of the shaft 328*eg*, and at least partially extends within the passage 324*qa* of the tubular portion 324*q*. The plug element 328*eh* is adapted to move up and down in response to the reciprocating motion of the piston 328*ea*, and thus disengage and engage, respectively, the plug seat 324*qb* to open and close, respectively, the valve 328.

Figure 31:
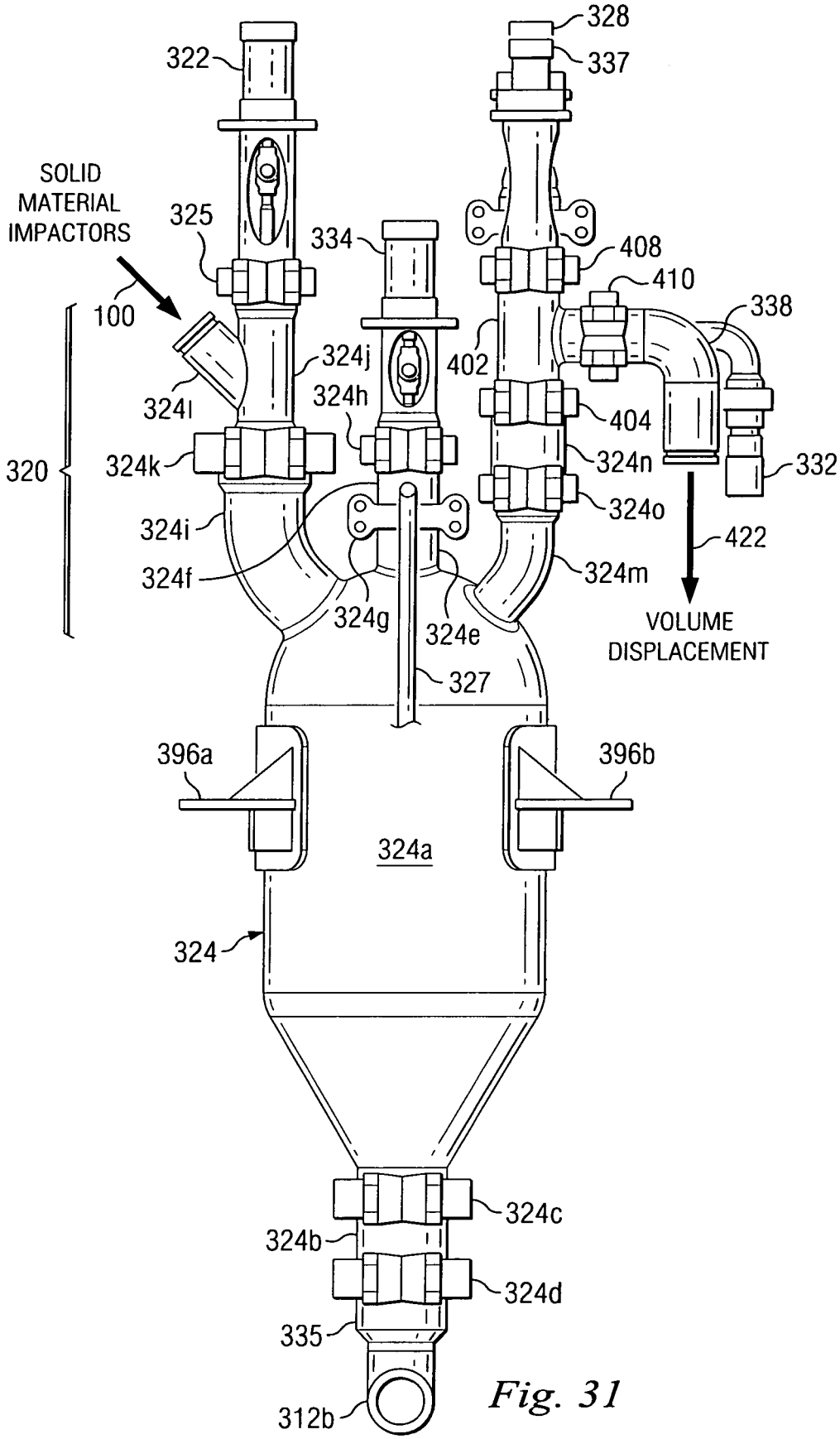
FIGS. 31-34 are views similar to that of FIG. 25 but depicting different operational modes of the injector vessel.

In an exemplary embodiment, as illustrated in FIG. 31 with continuing reference to FIGS. 21-30, the individual operation of the injector vessel 324, when mounted on the skid 392 and supported by the frame 394, will be described. It is understood that the operation of the injector vessel 324, when mounted on the skid 392 and supported by the frame 394, substantially corresponds to the operation of the injector vessel 324 described above in connection with FIG. 21.

Initially, the chamber 324*aa* of the body 324*a* of the injector vessel 324 is full of drilling fluid and the valve 337 is open, that is, the plug element 337*eh* is disengaged from the plug seat 324*nb*, while the valves 322, 348, 372, 328, 354, 366, 308, 388, 334, 360 and 382 remain closed. As a result of the valve 337 being open, the pressure within the chamber 324*aa* is substantially equal to atmospheric pressure. The pump 304 continues to cause drilling fluid to flow from the mud tank 302, through the line 306, the line portion 312*a*, the orifice 310 and the line portion 312*b*, and to the pipe string 55.

To operate the injector vessel 324, the valve 322 is opened by moving the piston 322*ea* downward so that, as a result, the rod 322*ec*, the coupling 322*ed*, the pin 322*ef*, the coupling 322*ee*, the shaft 322*eg* and the plug element 322*eh* move downward and the plug element disengages from the plug seat 324*jb*. In an exemplary embodiment, it is understood that the piston 322*ea*, and therefore the valve 322, may be controlled in any conventional manner. The conveyor 316 transports solid material impactors 100 from the reservoir 314 to the tank 318. Solid material impactors 100 flow from the tank 318 and into the chamber 324*aa* of the body 324*a* of the injector vessel 324 via the conduit 320, that is, via at least the passages 324*la*, 324*ja* and 324*ia*, and via the valve 322, that is, via between the gap between the plug element 322*eh* and the plug seat 324*jb*, thereby charging the injector vessel with the solid material impactors. In an exemplary embodiment, the solid material impactors 100 may be fed into the injector vessel 324 with drilling fluid, in a solution or slurry form, and/or may be may be gravity fed into the injector vessel 324 via the conduit 320 and the valve 322. The solid material impactors 100 and the drilling fluid present in the chamber 324*aa* of the body 324*a* of the injector vessel 324 mix to form a suspension of liquid in the form of drilling fluid and the solid material impactors 100.

As a result of the introduction of the solid material impactors 100 into the chamber 324*aa*, drilling fluid present in the chamber is displaced and the volume of the displaced drilling fluid flows to the tank 340 via a volume displacement 422 in the chamber, the passage 324*ma*, the gap between the plug seat 324*nb* and the plug element 337*eh* of the open valve 337, the passage 402*a* and the line 338. It is understood that the pump 342 may be operated to cause at least a portion of the displaced drilling fluid in the tank 340 to flow into the tank 318 via the line 344.

After the injector vessel 324 has been charged, that is, after the desired and relatively high volume of the solid material impactors 100 has been introduced into the chamber 324*aa*, the valve 322 is closed to prevent further introduction of solid material impactors 100 into the injector vessel, that is, the piston 322*ea* is moved upward so that, as a result, the coupling 322*ed*, the pin 322*ef*, the coupling 322*ee*, the shaft 322*eg* and the plug element 322*eh* move upward and the plug element engages the plug seat 324*jb*. The valve 337 is closed to prevent any further flow of drilling fluid to the tank 340, that is, the piston 337*ea* is moved upward so that, as a result, the rod 337*ec*, the coupling 337*ed*, the pin 337*ef*, the coupling 337*ee*, the shaft 337*eg* and the plug element 337*eh* move upward and the plug element engages the plug seat 324*nb*. In an exemplary embodiment, it is understood that the piston 337*ea*, and therefore the valve 337, may be controlled in any conventional manner.

Figure 32:
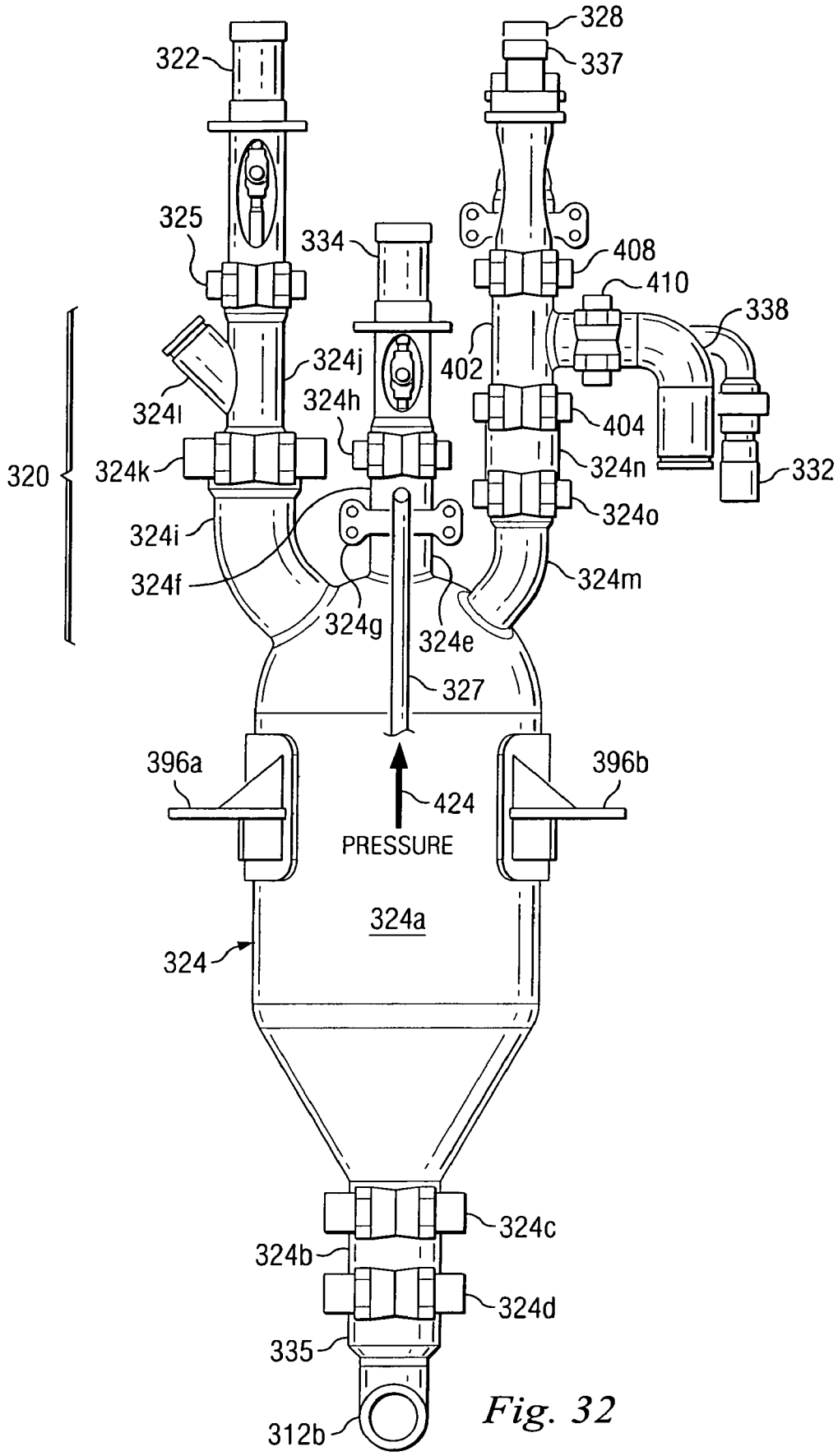

In an exemplary embodiment, as illustrated in FIG. 32 with continuing reference to FIGS. 21-31, the cylinder 326 is operated so that hydraulic cylinder fluid is introduced into the chamber 326*d* and, in response, the piston 326*a* applies pressure to the drilling fluid in the line 327, thereby applying a pressure 424 in the line 327, the passage 324*fa*, the passage 324*ea* and the chamber 324*aa*. The cylinder 326 applies the pressure 424 in the line 327, the passage 324*fa*, the passage

324*ea* and the chamber 324*aa* until the pressure in the line 327, the passage 324*fa*, the passage 324*ea* and the chamber 324*aa* is greater than the pressure in the line portion 312*b*, and is less than, substantially or nearly equal to, or greater than, the pressure in the line 306 and the line portion 312*a* which, in turn and as noted above, is substantially equal to the supply pressure of the pump 304.

The valve 328 is opened by moving the piston 328*ea* upward so that, as a result, the rod 328*ec*, the coupling 328*ed*, the pin 328*ef*, the coupling 328*ee*, the shaft 328*eg* and the plug element 328*eh* move upward and the plug element disengages from the plug seat 324*qb*. In an exemplary embodiment, it is understood that the piston 328*ea*, and therefore the valve 328, may be controlled in any conventional manner. In response, a portion of the drilling fluid in the line 332, the passage 412*a*, the passage 324*qa* and/or the passage 324*pa*, may flow through the valve 328 so that the respective pressures in the line portion 312*a*, the line 306, the line 332, the passage 412*a*, the passage 324*qa*, the passage 324*pa* and the chamber 324*aa* further equalize to a pressure that still remains greater than the pressure in the line portion 312*b*.

Figure 33:
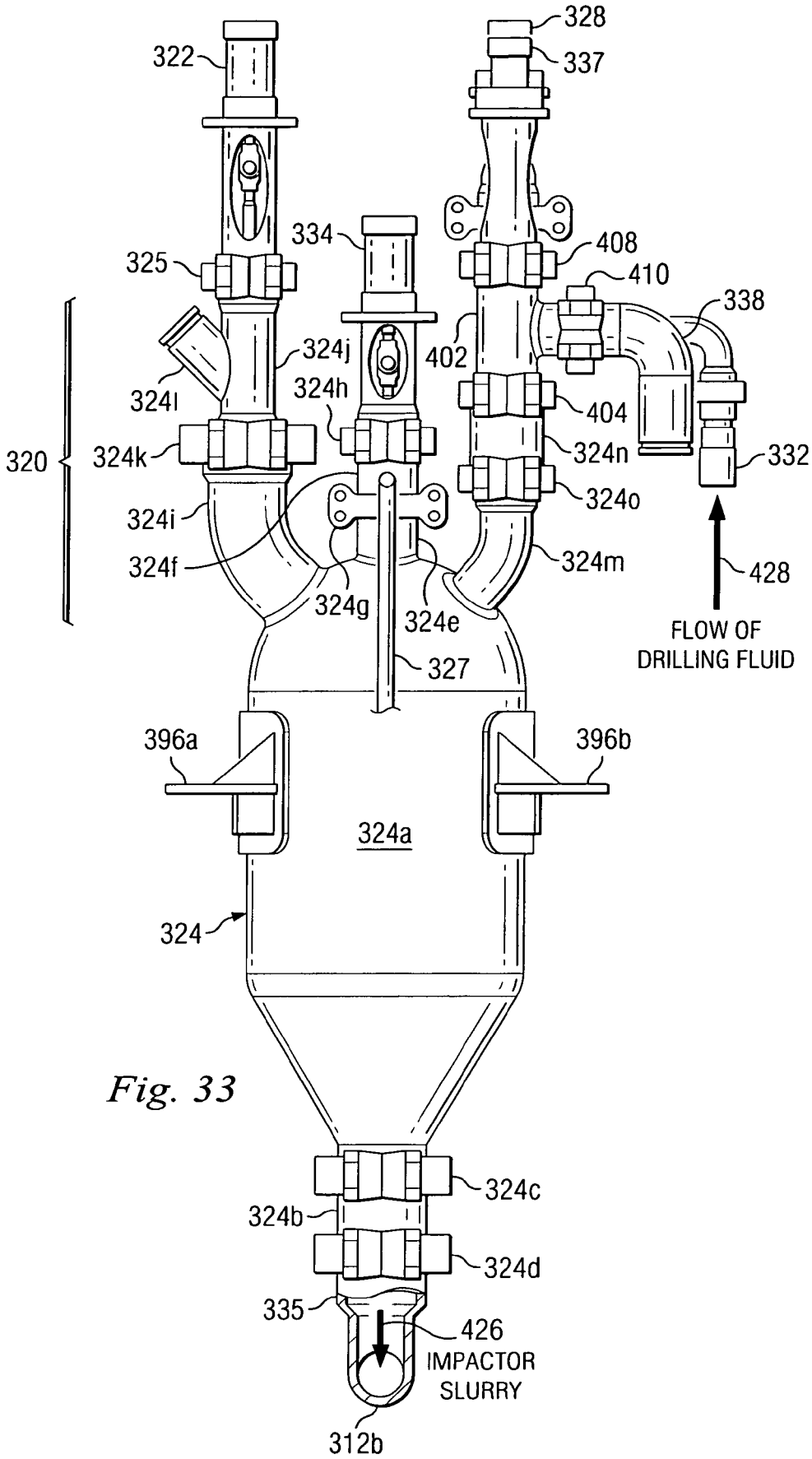

In an exemplary embodiment, as illustrated in FIG. 33 with continuing reference to FIGS. 21-32, the valve 334 is opened by moving the piston 334*ea* downward so that, as a result, the rod 334*ec*, the coupling 334*ed*, the pin 334*ef*, the coupling 334*ee*, the shaft 334*eg* and the plug element 334*eh* move downward and the plug element disengages from the plug seat 324*bc*. In an exemplary embodiment, it is understood that the movement of the piston 334*ea*, and therefore the valve 334, may be controlled in any conventional manner.

As a result of the opening of the valve 334, an impactor slurry 426, that is, the suspension of liquid in the form of drilling fluid and the solid material impactors 100, flows through the chamber 324*aa*, the openings 342*bba*, 342*bbb* and 342*bbc*, the passage 324*ba* of the spool 324*b*, the line 335, and the countersunk opening 336*a* and the through-bore 336*b* of the orifice 336.

As a result of the flow of the impactor slurry 426, the impactor slurry is permitted to be injected into the line portion 312*b*. It is understood that the pressure in the line 335 may be less than the pressure in the line 306 due to several factors such as, for example, the pressure drop associated with the flow of the impactor slurry 426 through one or more components such as, for example, the valve 334 and the orifice 336. Notwithstanding this pressure drop, the pump 304 continues to maintain a pressurized flow of drilling fluid 428 into the chamber 324*aa* via the line 306, the line 332, the passage 412*a*, the passage 324*qa*, the gap between the plug seat 324*qb* and the plug element 328*eh* of the valve 328 and the passage 324*pa*. Due to the pressurized flow of drilling fluid 428, and the pressure drop across the orifice 310, the pressure in the line 335 is still greater than the pressure in the line portion 312*b* of the line 312. As a result, the impactor slurry 426 having the desired and relatively high volume of solid material impactors 100 is injected into the line portion 312*b* of the line 312, and therefore to the pipe string 55, at a relatively high pressure.

In an exemplary embodiment, it is understood that gravity may be employed to assist in the flow of the impactor slurry 426 from the injector vessel 324 to the line portion 312*b* via the line 335 and the orifice 336. In an exemplary embodiment, it is understood that the flow of impactor slurry delivered to the pipe string 55 via the line portion 312*b* of the line 312 may be accelerated and discharged to remove a portion of the formation 52 (FIG. 1), in a manner similar to that described above.

Figure 34:
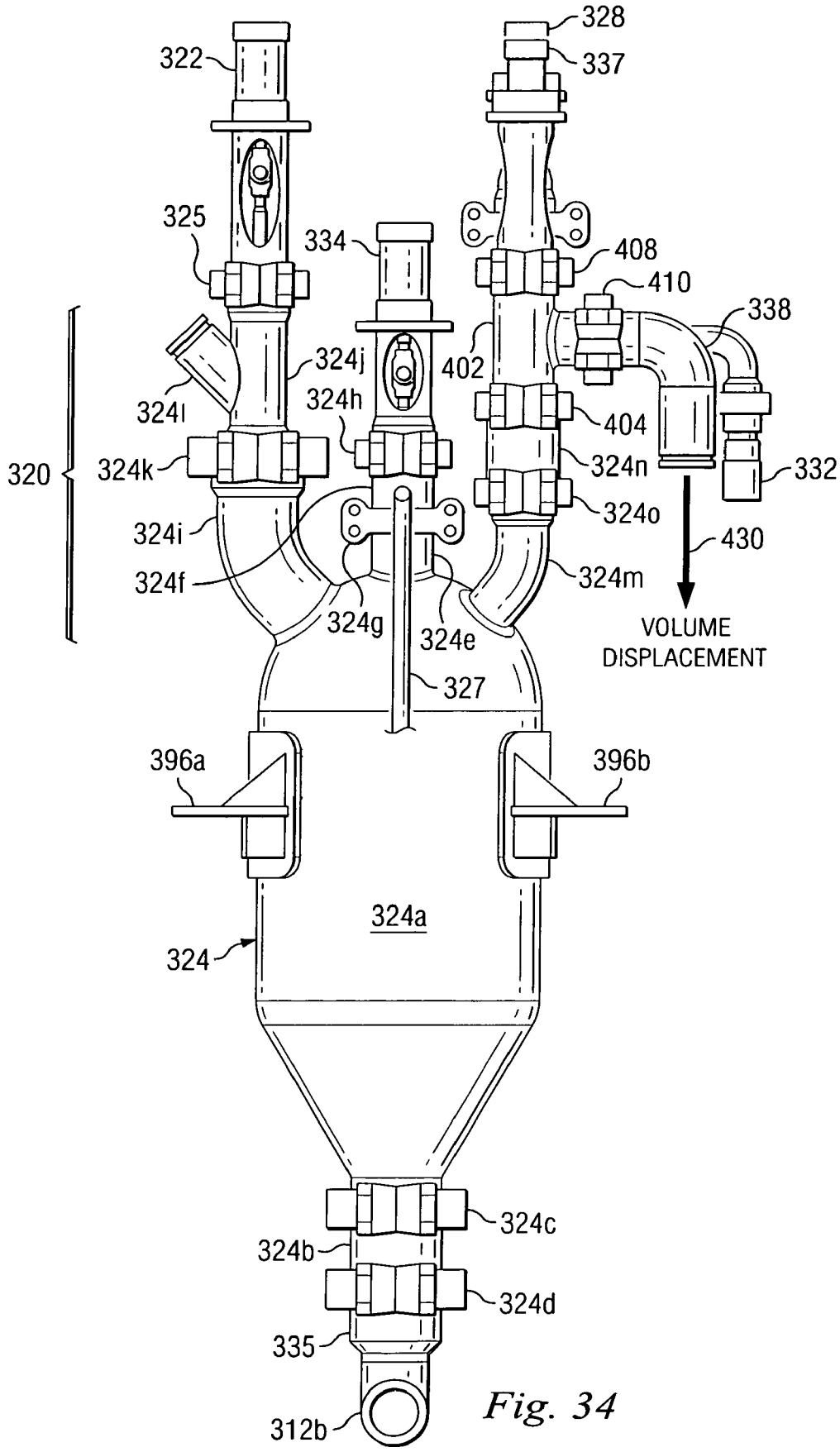

In an exemplary embodiment, as illustrated in FIG. 34 with continuing reference to FIGS. 21-33, after the impactor slurry has been completely discharged from the injector vessel 324, the valves 328 and 334 are closed, thereby preventing any flow of drilling fluid from the tank 302, through the pump 304, the line 306, the line 332, the injector vessel 324, the valve 334, the orifice 336 and the line 335, and to the line portion 312*b* of the line 312.

In an exemplary embodiment, in response to the closing of the valve 334 and thus the engagement of the plug element 334*eh* and the plug seat 324*bc*, the contact line defined by the engagement between the plug element of the valve and the plug seat may be 15 degrees from the longitudinal axis of the tubular spool 324*b*. In an exemplary embodiment, the contact lines defined by the engagement between the plug element 334*eh* of the valve 334 and the plug seat 324*bc* of the tubular spool 324*b*, corresponding to two 180-degree-circumferentially-spaced locations on the plug element, may define a 30-degree angle therebetween.

The cylinder 326 is then operated so that the hydraulic cylinder fluid in the chamber 326*d* is discharged therefrom. During this discharge, the pressurized drilling fluid still present in the line 327 and the injector vessel 324 applies pressure against the piston 326*a*. As a result, the pressure in the line 327, the passage 324*fa*, the passage 324*ea* and the chamber 324*aa* of the injector vessel 324 is reduced, and may be reduced to atmospheric pressure. The valve 337 is opened, that is the plug element 337*eh* disengages from the plug seat 324*nb*, thereby permitting a volume of the pressurized drilling fluid that may still be present in the chamber 324*aa* to be displaced so that the volume of the displaced drilling fluid flows to the tank 340 via a volume displacement 430 in the chamber, the passage 324*ma*, the passage 324*na*, the gap between the plug seat 324*nb* and the plug element 337*eh* of the open valve 337, the passage 402*a* and the line 338. As a result, the pressure in the injector vessel 324 may be vented, thereby facilitating its return to atmospheric pressure.

At this point, the injector vessel 324 is again in its initial condition, with the injector vessel full of drilling fluid and the valve 337 open, and the valves 322, 348, 372, 328, 354, 366, 308, 388, 334, 360, 382 and 406 closed. The pump 304 continues to cause drilling fluid to flow from the mud tank 302, through the line 306, the line portion 312*a*, the orifice 310 and the line portion 312*b*, and to the pipe string 55.

In an exemplary embodiment, the above-described operation of the injector vessel 324 may be repeated by again opening the valve 322 to again charge the injector vessel 324, that is, to again permit introduction of the solid material impactors 100 into the injector vessel 324, as discussed above.

In an exemplary embodiment, it is understood that the embodiments of the injector vessels 350 and 374 depicted in FIGS. 23 and/or 24 are substantially similar to the injector vessel 324 described above in connection with FIGS. 25-30 and therefore will not be described in detail. Moreover, it is understood that, in a manner that is substantially similar to the manner in which the operation of the embodiment of the injector vessel 324 depicted in FIGS. 23 and 25-30 substantially corresponds to the operation of the injector vessel 324 described above in connection with FIG. 21, the operation of each of the embodiments of the injector vessels 350 and 374 depicted in FIGS. 23 and/or 24 substantially corresponds to the operation of each of the injector vessels 350 and 374, respectively, described above in connection with FIG. 21.

In an exemplary embodiment, it is understood that the embodiments of the injector vessels 324, 350 and 374 depicted in FIGS. 23-30 may be operated in a manner substantially similar to the operation of the injector vessels 324, 350 and 374 of the injection system 300 described above in connection with FIG. 22.

Figure 35:
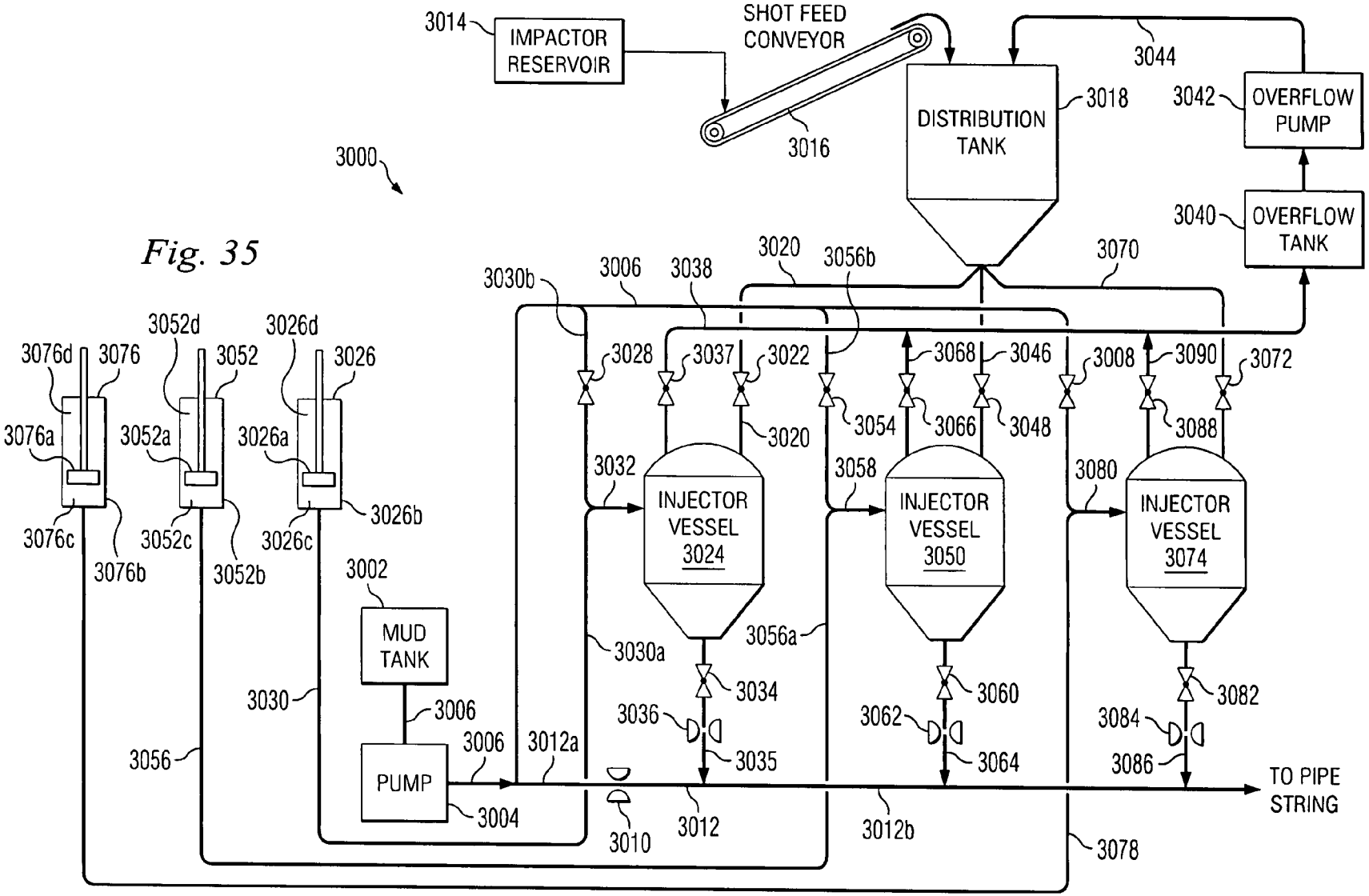
FIG. 35 is a schematic view of an injection system according to another embodiment.

Referring to FIG. 35, an injection system according to another embodiment is generally referred to by the reference numeral 3000 and includes a drilling fluid tank or mud tank 3002 that is fluidicly coupled to a pump 3004 via a hydraulic supply line 3006 that also extends from the pump to a valve 3008. An orifice 3010 is fluidicly coupled to the hydraulic supply line 3006 via a hydraulic supply line 3012 that also extends to and/or is fluidicly coupled to a pipe string such as, for example, the pipe string 55 described above in connection with the excavation system 1 of the embodiment of FIG. 1. In an exemplary embodiment, it is understood that the hydraulic supply line 3012 may be fluidicly coupled to the pipe string 55 via one or more components of the excavation system 1 of the embodiment of FIG. 1, including the impactor slurry injector head 34, the injector port 30, the fluid-conducting through-bore of the swivel 28, and/or the feed end 55*a* of the pipe string. Line portions 3012*a* and 3012*b* of the line 3012 are defined and separated by the location of the orifice 3010.

A solid-material-impactor bin or reservoir 3014 is operably coupled to a solid-impactor transport device such as a shot-feed conveyor 3016 which, in turn, is operably coupled to a distribution tank 3018. A conduit 3020 connects the tank 3018 to a valve 3022, and the conduit further extends and is connected to an injector vessel 3024.

A hydraulic-actuated cylinder 3026 is fluidicly coupled to a valve 3028 via a hydraulic flow line 3030 that also extends to the line 3006. Line portions 3030*a* and 3030*b* are defined and separated by the valve 3028. The cylinder 26 includes a piston 3026*a* that reciprocates in a cylinder housing 3026*b* in a conventional manner. The housing 3026*b* defines a variable-volume chamber 3026*c* in fluid communication with the line 3030, and further defines a variable-volume chamber 3026*d* into which hydraulic cylinder fluid is introduced, and from which the hydraulic fluid is discharged, under conditions to be described.

A hydraulic line 3032 fluidicly couples the line 3030 to the vessel 3024, and a valve 3034 is fluidicly coupled to the vessel 3024. A hydraulic line 3035 fluidicly couples an orifice 3036 to the valve 3034, and the line also extends to the line portion 3012*b* of the line 3012. A valve 3037 is fluidicly coupled to the vessel 3024 via a hydraulic line 3038 that also extends to a reservoir or tank 3040. A pump 3042 is fluidicly coupled to the tank 3040 via a hydraulic line 3044 that also extends to the tank 3018.

A conduit 3046 connects the tank 3018 to a valve 3048, and the conduit further extends and is connected to an injector vessel 3050. A hydraulic-actuated cylinder 3052 is fluidicly coupled to a valve 3054 via a hydraulic flow line 3056 that also extends to the line 3006. Line portions 3056*a* and 3056*b* are defined and separated by the valve 3054. The cylinder 3052 includes a piston 3052*a* that reciprocates in a cylinder housing 3052*b* in a conventional manner. The housing 3052*b* defines a variable-volume chamber 3052*c* in fluid communication with the line 3056, and further defines a variable-volume chamber 3052*d* into which hydraulic cylinder fluid is introduced, and from which the hydraulic fluid is discharged, under conditions to be described.

A hydraulic line 3058 fluidicly couples the line 3056 to the vessel 3050. A valve 3060 is fluidicly coupled to the vessel 3050, and an orifice 3062 is fluidicly coupled to the valve via a hydraulic line 3064 that also extends to the line portion 3012*b* of the line 3012. A valve 3066 is fluidicly coupled to the vessel 3050 via a hydraulic line 3068 that also extends to the line 3038.

A conduit 3070 connects the tank 3018 to a valve 3072, and the conduit further extends and is connected to an injector vessel 3074. A hydraulic-actuated cylinder 3076 is fluidicly coupled to the valve 3008 via a hydraulic line 3078, and the cylinder includes a piston 3076*a* that reciprocates in a cylinder housing 3076*b* in a conventional manner. The housing 3076*b* defines a variable-volume chamber 3076*c* in fluid communication with the line 3056, and further defines a variable-volume chamber 3076*d* into which hydraulic cylinder fluid is introduced, and from which the hydraulic fluid is discharged, under conditions to be described.

A hydraulic line 3080 fluidicly couples the line 3078 to the vessel 3074. A valve 3082 is fluidicly coupled to the vessel 3074, and an orifice 3084 is fluidicly coupled to the valve via a hydraulic line 3086 that also extends to the line portion 3012*b* of the line 3012. A valve 3088 is fluidicly coupled to the vessel 3074 via a hydraulic line 3090 that also extends to the line 3038. In an exemplary embodiment, it is understood that all of the above-described lines and line portions define flow regions through which fluid may flow over a range of fluid pressures.

Prior to the general operation of the injection system 3000, all of the valves in the injection system may be closed, including the valves 3022, 3048, 3072, 3028, 3037, 3054, 3066, 3008, 3088, 3034, 3060 and 3082. Moreover, the pump 3004 may cause liquid such as drilling fluid to flow from the mud tank 3002, through the line 3006, the line portion 3012*a*, the orifice 3010 and the line portion 3012*b*, and to the pipe string 55. It is understood that the pressure in the line 3006 and the line portion 3012*a* is substantially equal to the supply pressure of the pump 3004, and that the pressure in the line portion 3012*b* is less than the pressure in the line 3006 and the line portion 3012*a* due to the pressure drop caused by the orifice 3010. It is further understood that the portion of the line 3006 extending to the valve 3008, the line portions 3030*b*, 3056*b*, 3030*a* and 3056*a*, and the lines 3078, 3032, 3058, 3080, 3038, 3068 and 3090 may be full of drilling fluid. Moreover, it is understood that the injector vessels 3024, 3050 and 3074 may also be full of drilling fluid. The reservoir 3014 is filled with material such as, for example, the solid material impactors 100 discussed above in connection with FIGS. 1-20. The tank 3018 may also be filled with the solid material impactors 100, and/or may also be filled with drilling fluid.

For clarity purposes, the individual operation of the injector vessel 3024 will be described. Initially, the injector vessel 3024 is full of drilling fluid and the valve 3037 is open, while the valves 3022, 3048, 3072, 3028, 3054, 3066, 3008, 3088, 3034, 3060 and 3082 remain closed. As a result of the valve 3037 being open, the pressure in the injector vessel 3024 is substantially equal to atmospheric pressure. The pump 3004 continues to cause drilling fluid to flow from the mud tank 3002, through the line 3006, the line portion 3012*a*, the orifice 3010 and the line portion 3012*b*, and to the pipe string 55.

To operate the injector vessel 3024, the valve 3022 is opened and the conveyor 3016 transports solid material impactors 100 from the reservoir 3014 to the tank 3018. Solid material impactors 100 are also transported from the tank 3018 and into the injector vessel 3024 via the conduit 3020 and the valve 3022, thereby charging the injector vessel with the solid material impactors. In an exemplary embodiment, the solid material impactors 100 may be fed into the injector vessel 3024 with drilling fluid, in a solution or slurry form, and/or be may be gravity fed into the injector vessel 3024 via the conduit 3020 and the valve 3022. The solid material impactors 100 and the drilling fluid present in the injector vessel 3024 mix to form a suspension of liquid in the form of drilling fluid and the solid material impactors 100, that is, to form an impactor slurry.

As a result of the introduction of the solid material impactors 100 into the injector vessel 3024, drilling fluid present in the injector vessel is displaced and the volume of the displaced drilling fluid flows to the tank 3040 via the line 3038 and the valve 3037. It is understood that the pump 3042 may be operated to cause at least a portion of the displaced drilling fluid in the tank 3040 to flow into the tank 3018 via the line 3044.

After the injector vessel 3024 has been charged, that is, after the desired and relatively high volume of the solid material impactors 100 has been introduced into the injector vessel, the valve 3022 is closed to prevent further introduction of solid material impactors 100 into the injector vessel, and the valve 3037 is closed to prevent any further flow of drilling fluid to the tank 3040. The cylinder 3026 is then operated so that hydraulic cylinder fluid is introduced into the chamber 3026*d* and, in response, the piston 3026*a* applies pressure to the drilling fluid in the line 3030, thereby pressurizing the line 3030, the line 3032 and the injector vessel 3024. The cylinder 3026 pressurizes the line portion 3030*a*, the line 3032 and the injector vessel 3024 until the pressure in the line portion 3030*a*, the line 3032 and the injector vessel 3024 is greater than the pressure in the line portion 3012*b*, and is less than, substantially or nearly equal to, or greater than, the pressure in the line 3006 and the line portion 3012*a* which, in turn and as noted above, is substantially equal to the supply pressure of the pump 3004.

The valve 3028 is opened and, in response, a portion of the drilling fluid in the line portion 3030*b* may flow through the valve 3028 and into the line portion 3030*a* so that the respective pressures in the line portions 3012*a*, 3030*a* and 3030*b*, the line 3032 and the injector vessel 3024 further equalize to a pressure that still remains greater than the pressure in the line portion 3012*b*.

The valve 3034 is opened, thereby permitting the impactor slurry to flow through the line 3035 and the orifice 3036, and to the line portion 3012*b*. It is understood that the pressure in the line 3035 may be less than the pressure in the line 3006 due to several factors such as, for example, the pressure drop associated with the flow of the impactor slurry through one or more components such as, for example, the valve 3034 and the orifice 3036. Notwithstanding this pressure drop, the pump 3004 continues to maintain a pressurized flow of drilling fluid into the injector vessel 3024 via the line 3006, the line portion 3030*b*, the valve 3028, the line portion 3030*a* and the line 3032. Due to the pressurized flow of drilling fluid, and the pressure drop across the orifice 3010, the pressure in the line 3035 is still greater than the pressure in the line portion 3012*b* of the line 3012. As a result, the impactor slurry having the desired and relatively high volume of solid material impactors 100 is injected into the line portion 3012*b* of the line 3012, and therefore to the pipe string 55, at a relatively high pressure.

In an exemplary embodiment, it is understood that gravity may be employed to assist in the flow of the slurry from the injector vessel 3024 to the line portion 3012*b* via the line 3035 and the orifice 3036. In an exemplary embodiment, it is understood that the flow of impactor slurry delivered to the pipe string 55 via the line portion 3012*b* of the line 3012 may be accelerated and discharged to remove a portion of the formation 52 (FIG. 1) in a manner similar to that described above.

After the impactor slurry has been completely discharged from the injector vessel 3024, the valves 3028 and 3034 are closed, thereby preventing any flow of drilling fluid from the tank 3002, through the pump 3004, the line 3006, the line portion 3030*b*, the line portion 3030*a*, the line 3032, the injector vessel 3024, the valve 3034, the orifice 3036 and the line 3035, and to the line portion 3012*b* of the line 3012. The cylinder 3026 is then operated so that the hydraulic cylinder fluid in the chamber 3026*d* is discharged therefrom. During this discharge, the pressurized drilling fluid still present in the line 3032, the line portion 3030*a* and the injector vessel 3024 applies pressure against the piston 3026*a*. As a result, the pressure in the line 3032, the line portion 3030*a* and the injector vessel 3024 is reduced, and may be reduced to atmospheric pressure. The valve 3037 is opened, thereby permitting a volume of the pressurized drilling fluid that may still be present in the injector vessel 3024 to be displaced, thereby causing additional drilling fluid to flow from the line 3038 to the tank 3040. As a result, the pressure in the injector vessel 3024 may be vented, thereby facilitating its return to atmospheric pressure.

At this point, the injector vessel 3024 is again in its initial condition, with the injector vessel full of drilling fluid and the valve 3037 open, and the valves 3022, 3048, 3072, 3028, 3054, 3066, 3008, 3088, 3034, 3060 and 3082 closed. The pump 3004 continues to cause drilling fluid to flow from the mud tank 3002, through the line 3006, the line portion 3012*a*, the orifice 3010 and the line portion 3012*b*, and to the pipe string 55.

In an exemplary embodiment, the above-described operation of the injector vessel 3024 may be repeated by again opening the valve 3022 to again charge the injector vessel 3024, that is, to again permit introduction of the solid material impactors 100 into the injector vessel 3024, as discussed above.

The individual operation of the injector vessel 3050 will be described. In an exemplary embodiment, the individual operation of the injector vessel 3050 is substantially similar to the operation of the injector vessel 3024, with the conduit 3046, the valve 3048, the injector vessel 3050, the cylinder 3052, the piston 3052*a*, the housing 3052*b*, the chamber 3052*c*, the chamber 3052*d*, the valve 3054, the line 3056, the line portion 3056*a*, the line portion 3056*b*, the line 3058, the valve 3060, the orifice 3062, the line 3064 and the valve 3066 operating in a manner substantially similar to the above-described operation of the conduit 3020, the valve 3022, the injector vessel 3024, the cylinder 3026, the piston 3026*a*, the housing 3026*b*, the chamber 3026*c*, the chamber 3026*d*, the valve 3028, the line 3030, the line portion 3030*a*, the line portion 3030*b*, the line 3032, the valve 3034, the orifice 3036, the line 3035 and the valve 3037, respectively. The line 3068 operates in a manner similar to the line 3038, except that both the line 3068 and the line 3038 are used to vent the injector vessel 3050 during its operation.

More particularly, the injector vessel 3050 is initially full of drilling fluid and the valve 3066 is open, while the valves 3022, 3048, 3072, 3028, 3054, 3037, 3008, 3088, 3034, 3060 and 3082 remain closed. As a result of the valve 3066 being open, the pressure in the injector vessel 3050 is substantially equal to atmospheric pressure. The pump 3004 continues to cause drilling fluid to flow from the mud tank 3002, through the line 3006, the line portion 3012*a*, the orifice 3010 and the line portion 3012*b*, and to the pipe string 55.

To operate the injector vessel 3050, the valve 3048 is opened and the conveyor 3016 transports solid material impactors 100 from the reservoir 3014 to the tank 3018. Solid material impactors 100 are also transported from the tank 3018 and into the injector vessel 3050 via the conduit 3046 and the valve 3048, thereby charging the injector vessel with the solid material impactors. In an exemplary embodiment, the solid material impactors 100 may be fed into the injector vessel 3050 with drilling fluid, in a solution or slurry form, and/or may be gravity fed into the injector vessel 3050 via the conduit 3046 and the valve 3048. The solid material impactors 100 and the drilling fluid present in the injector vessel 3050 mix to form a suspension of liquid in the form of drilling fluid and the solid material impactors 100, that is, to form an impactor slurry.

As a result of the introduction of the solid material impactors 100 into the injector vessel 3050, drilling fluid present in the injector vessel is displaced and the volume of the displaced drilling fluid flows to the tank 3040 via the lines 3068 and 3038 and the valve 3066. It is understood that the pump 3042 may be operated to cause at least a portion of the displaced drilling fluid in the tank 3040 to flow into the tank 3018 via the line 3044.

After the injector vessel 3050 has been charged, that is, after the desired and relatively high volume of the solid material impactors 100 has been introduced into the injector vessel, the valve 3046 is closed to prevent further introduction of solid material impactors 100 into the injector vessel, and the valve 3066 is closed to prevent any further flow of drilling fluid to the tank 3040. The cylinder 3052 is then operated so that hydraulic cylinder fluid is introduced into the chamber 3052*d* and, in response, the piston 3052*a* applies pressure to the drilling fluid in the line 3056, thereby pressurizing the line 3056, the line 3058 and the injector vessel 3050. The cylinder 3052 pressurizes the line portion 3056*a*, the line 3058 and the injector vessel 3050 until the pressure in the line portion 3056*a*, the line 3058 and the injector vessel 3050 is greater than the pressure in the line portion 3012*b*, and is less than, substantially or nearly equal to, or greater than, the pressure in the line 3006 and the line portion 3012*a* which, in turn and as noted above, is substantially equal to the supply pressure of the pump 3004.

The valve 3054 is opened and, in response, a portion of the drilling fluid in the line portion 3056*b* may flow through the valve 3054 and into the line portion 3056*a* so that the respective pressures in the line portions 3012*a*, 3056*a* and 3056*b*, the line 3058 and the injector vessel 3050 further equalize to a pressure that still remains greater than the pressure in the line portion 3012*b*.

The valve 3060 is opened, thereby permitting the impactor slurry to flow through the line 3064 and the orifice 3062, and to the line portion 3012*b*. It is understood that the pressure in the line 3064 may be less than the pressure in the line 3006 due to several factors such as, for example, the pressure drop associated with the flow of the impactor slurry through one or more components such as, for example, the valve 3060 and the orifice 3062. Notwithstanding this pressure drop, the pump 3004 continues to maintain a pressurized flow of drilling fluid into the injector vessel 3050 via the line 3006, the line portion 3056*b*, the valve 3054, the line portion 3056*a* and the line 3058. Due to the pressurized flow of drilling fluid, and the pressure drop across the orifice 3010, the pressure in the line 3064 is still greater than the pressure in the line portion 3012*b* of the line 3012. As a result, the impactor slurry having the desired and relatively high volume of solid material impactors 100 is injected into the line portion 3012*b* of the line 3012, and therefore to the pipe string 55, at a relatively high pressure.

In an exemplary embodiment, it is understood that gravity may be employed to assist in the flow of the slurry from the injector vessel 3050 to the line portion 3012*b* via the line 3064 and the orifice 3062. In an exemplary embodiment, it is understood that the flow of impactor slurry delivered to the pipe string 55 via the line portion 3012*b* of the line 3012 may be accelerated and discharged to remove a portion of the formation 52 (FIG. 1) in order to excavate the formation, in a manner similar to that described above.

After the impactor slurry has been completely discharged from the injector vessel 3050, the valves 3054 and 3060 are closed, thereby preventing any flow of drilling fluid from the tank 3002, through the pump 3004, the line 3006, the line portion 3056*b*, the line 3058, the injector vessel 3050, the valve 3060, the orifice 3062 and the line 3064, and to the line portion 3012*b* of the line 3012. The cylinder 3052 is then operated so that the hydraulic cylinder fluid in the chamber 3052*d* is discharged therefrom. During this discharge, the pressurized drilling fluid still present in the line 3058, the line portion 3056*a* and the injector vessel 3050 applies pressure against the piston 3052*a*. As a result, the pressure in the line 3058, the line portion 3056*a* and the injector vessel 3050 is reduced, and may be reduced to atmospheric pressure. The valve 3066 is opened, thereby permitting a volume of the pressurized drilling fluid that may still be present in the injector vessel 3050 to be displaced via the line 3068, thereby causing additional drilling fluid to flow from the line 3038 to the tank 3040. As a result, the pressure in the injector vessel 3050 may be vented, thereby facilitating its return to atmospheric pressure.

At this point, the injector vessel 3050 is again in its initial condition, with the injector vessel full of drilling fluid and the valve 3066 open, and the valves 3022, 3048, 3072, 3028, 3054, 3037, 3008, 3088, 3034, 3060 and 3082 closed. The pump 3004 continues to cause drilling fluid to flow from the mud tank 3002, through the line 3006, the line portion 3012*a*, the orifice 3010 and the line portion 3012*b*, and to the pipe string 55.

In an exemplary embodiment, the above-described operation of the injector vessel 3050 may be repeated by again opening the valve 3048 to again charge the injector vessel 3050, that is, to again permit introduction of the solid material impactors 100 into the injector vessel 3050, as discussed above.

The individual operation of the injector vessel 3074 will be described. In an exemplary embodiment, the individual operation of the injector vessel 3074 is substantially similar to the operation of the injector vessel 3024, with the conduit 3070, the valve 3072, the injector vessel 3074, the cylinder 3076, the piston 3076*a*, the housing 3076*b*, the chamber 3076*c*, the chamber 3076*d*, the valve 3008, the line 3078, the line 3080, the valve 3082, the orifice 3084, the line 3086 and the valve 3088 operating in a manner substantially similar to the above-described operation of the conduit 3020, the valve 3022, the injector vessel 3024, the cylinder 3026, the piston 3026*a*, the housing 3026*b*, the chamber 3026*c*, the chamber 3026*d*, the valve 3028, the line portion 3030*a*, the line 3032, the valve 3034, the orifice 3036, the line 3035 and the valve 3037, respectively. The line 3090 operates in a manner similar to the line 30308, except that both the line 3090 and the line 3038 are used to vent the injector vessel 3074 during its operation.

More particularly, the injector vessel 3074 is initially full of drilling fluid and the valve 3088 is open, while the valves 3022, 3048, 3072, 3028, 3054, 3066, 3008, 3037, 3034, 3060 and 3082 remain closed. As a result of the valve 3088 being open, the pressure in the injector vessel 3074 is substantially equal to atmospheric pressure. The pump 3004 continues to cause drilling fluid to flow from the mud tank 3002, through the line 3006, the line portion 3012*a*, the orifice 3010 and the line portion 3012*b*, and to the pipe string 55.

To operate the injector vessel 3074, the valve 3072 is opened and the conveyor 3016 transports solid material impactors 100 from the reservoir 3014 to the tank 3018. Solid material impactors 100 are also transported from the tank 3018 and into the injector vessel 3074 via the conduit 3070 and the valve 3072, thereby charging the injector vessel with the solid material impactors In an exemplary embodiment, the solid material impactors 100 may be fed into the injector vessel 3074 with drilling fluid, in a solution or slurry form, and/or may be gravity fed into the injector vessel 3074 via the conduit 3070 and the valve 3072. The solid material impactors 100 and the drilling fluid present in the injector vessel 3074 mix to form a suspension of liquid in the form of drilling fluid and the solid material impactors 100, that is, to form an impactor slurry.

As a result of the introduction of the solid material impactors 100 into the injector vessel 3074, drilling fluid present in the injector vessel is displaced and the volume of the displaced drilling fluid flows to the tank 3040 via the lines 3090 and 3038 and the valve 3037. It is understood that the pump 3042 may be operated to cause at least a portion of the displaced drilling fluid in the tank 3040 to flow into the tank 3018 via the line 3044.

After the injector vessel 3074 has been charged, that is, after the desired and relatively high volume of the solid material impactors 100 has been introduced into the injector vessel, the valve 3072 is closed to prevent further introduction of solid material impactors 100 into the injector vessel, and the valve 3088 is closed to prevent any further flow of drilling fluid to the tank 3040. The cylinder 3076 is then operated so that hydraulic cylinder fluid is introduced into the chamber 3076*d* and, in response, the piston 3076*a* applies pressure to the drilling fluid in the line 3078, thereby pressurizing the line 3078, the line 3080 and the injector vessel 3074. The cylinder 3076 pressurizes the line 3078, the line 3080 and the injector vessel 3074 until the pressure in the line 3078, the line 3080 and the injector vessel 3074 is greater than the pressure in the line portion 3012*b*, and is less than, substantially or nearly equal to, or greater than, the pressure in the line 3006 and the line portion 3012*a* which, in turn and as noted above, is substantially equal to the supply pressure of the pump 3004.

The valve 3008 is opened and, in response, a portion of the drilling fluid in the line portion 3006 may flow through the valve 3008 and into the line 3078 so that the respective pressures in the line portion 3012*a*, the lines 3078 and 3080 and the injector vessel 3074 further equalize to a pressure that still remains greater than the pressure in the line portion 3012*b*.

The valve 3082 is opened, thereby permitting the impactor slurry to flow through the line 3086 and the orifice 3084, and to the line portion 3012*b*. It is understood that the pressure in the line 3086 may be less than the pressure in the line 3006 due to several factors such as, for example, the pressure drop associated with the flow of the impactor slurry through one or more components such as, for example, the valve 3082 and the orifice 3084. Notwithstanding this pressure drop, the pump 3004 continues to maintain a pressurized flow of drilling fluid into the injector vessel 3074 via the line 3006, the valve 3008, the line 3078 and the line 3080. Due to the pressurized flow of drilling fluid, and the pressure drop across the orifice 3010, the pressure in the line 3086 is still greater than the pressure in the line portion 3012*b* of the line 3012. As a result, the impactor slurry having the desired and relatively high volume of solid material impactors 100 is injected into the line portion 3012*b* of the line 3012, and therefore to the pipe string 55, at a relatively high pressure.

In an exemplary embodiment, it is understood that gravity may be employed to assist in the flow of the slurry from the injector vessel 3074 to the line portion 3012*b* via the line 3086 and the orifice 3084. In an exemplary embodiment, it is understood that the flow of impactor slurry delivered to the pipe string 55 via the line portion 3012*b* of the line 3012 may be accelerated and discharged to remove a portion of the formation 52 (FIG. 1) in order to excavate the formation, in a manner similar to that described above.

After the impactor slurry has been completely discharged from the injector vessel 3074, the valves 3008 and 3082 are closed, thereby preventing any flow of drilling fluid from the tank 3002, through the pump 3004, the line 3006, the line 3078, the line 3080, the injector vessel 3074, the valve 3082, the orifice 3084 and the line 3086, and to the line portion 3012*b* of the line 3012. The cylinder 3076 is then operated so that the hydraulic cylinder fluid in the chamber 3076*d* is discharged therefrom. During this discharge, the pressurized drilling fluid still present in the line 3080, the line 3078 and the injector vessel 3074 applies pressure against the piston 3076*a*. As a result, the pressure in the line 3080, the line 3078 and the injector vessel 3074 is reduced, and may be reduced to atmospheric pressure. The valve 3088 is opened, thereby permitting a volume of the pressurized drilling fluid that may still be present in the injector vessel 3074 to be displaced via the line 3090, thereby causing additional drilling fluid to flow from the line 3038 to the tank 3040. As a result, the pressure in the injector vessel 3074 is vented, thereby facilitating its return to atmospheric pressure.

At this point, the injector vessel 3074 is again in its initial condition, with the injector vessel full of drilling fluid and the valve 3088 open, and the valves 3022, 3048, 3072, 3028, 3054, 3066, 3008, 3037, 3034, 3060 and 3082 closed. The pump 3004 continues to cause drilling fluid to flow from the mud tank 3002, through the line 3006, the line portion 3012*a*, the orifice 3010 and the line portion 3012*b*, and to the pipe string 55.

In an exemplary embodiment, the above-described operation of the injector vessel 3074 may be repeated by again opening the valve 3072 to again charge the injector vessel 3074, that is, to again permit introduction of the solid material impactors 100 into the injector vessel 3074, as discussed above.

In an exemplary embodiment, it is understood that the injector vessels 3024, 3050 and 3074 of the injection system 3000 may be operated in a manner similar to the operation of the injector vessels 324, 350 and 374 of the injection system 300 described above in connection with FIG. 22.

It is understood that the above-described clamping rings forming the above-described connections may be conventional and may form pressure-tight and fluid-tight connections.

It is understood that additional variations may be made in the foregoing without departing from the scope of the disclosure. For example, in addition to, and/or instead of the valve embodiments described above in connection with FIGS. 25-30, it is understood that each of the valves 322, 348, 372, 328, 354, 366, 308, 388, 334, 360, 382 and 406 may be in the form of a wide variety of valve types and/or may include a wide variety of components thereof such as, for example, a wide variety of ball valves and/or gate valves, and/or may be in the form of any type of closure device.

Moreover, it is understood that the injection system 300, the injection system 3000 and/or components thereof may be combined in whole or in part with the excavation system 1. For example, the injection system 300 may be added to the system 1 and the tank 94 may be replaced by the tank 318, and/or the tank 82 may be replaced by the tank 314. For another example, instead of or in addition to the slurrification tank 98, one or more of the injector vessels 324, 350 and 374 may be used in the system 1. In an exemplary embodiment, the injection system 300 may be added to the system 1 and the slurry line 88 in the system 1 may be replaced by the line portion 312*b*. In an exemplary embodiment, the injection system 300 may be employed without any removal of any of the components of the system 1. In an exemplary embodiment, the injection system 300 may be employed with the removal of one or more components of the system 1 such as, for example, one or more of the tank 94, the tank 82, the tank 98, the line 88, the impactor introducer 96, the tank 6, the pump 10 and/or any combination thereof.

In an exemplary embodiment, in addition to, or instead of the conveyor 16, it is understood that the solid material impactors 100 may be transported to the tank 318 using a wide variety of techniques such as, for example, chutes, conduits, trucks and/or any combination thereof.

In an exemplary embodiment, in addition to, or instead of the valve 334, it is understood that one or more of the above-described closings of the other valves may result in a contact line being defined by the engagement between the plug element of the valve and the corresponding plug seat, and that the contact line may be 15 degrees from an imaginary vertical axis. In an exemplary embodiment, the contact lines defined by the engagement between the plug element of the valve and the corresponding plug seat, corresponding to two 180-degree-circumferentially-spaced locations on the plug element, may define a 30-degree angle therebetween. It is understood that the angle defined by the contact lines defined by the engagement between any one of the above-described plug seats and the corresponding plug element of the corresponding valve may vary widely.

In an exemplary embodiment, and in addition to, or instead of injecting an impactor slurry into a flow region defined by the line portion 312*b* and to the pipe string 55 to remove a portion of the formation 52 (FIG. 1), the injection system 300 and/or the injection system 3000 may be used to inject an impactor slurry into a wide variety of other flow regions defined by a wide variety of systems, vessels, pipelines, naturally-formed structures, man-made structures and/or components and/or subsystems thereof, to serve a wide variety of other purposes. Moreover, the injection system 300 and/or the injection system 3000 may be used to inject an impactor slurry directly into the atmosphere and/or environment, and/or may be used in a wide variety of external applications such as, for example, cleaning applications, so that the flow region is considered to be the atmosphere or environmental surroundings.

In an exemplary embodiment, in addition to, or instead of the solid material impactors 100 and/or drilling fluid, it is understood that the impactor slurry may be a suspension of any type of impactors and/or any type of liquids. The impactors may include and/or be composed of any type of solid material in a wide variety of forms such as, for example, any type of solid pellets, shot or particles. It is understood that the type of liquid or fluid and/or the type of impactor used to form the suspension and therefore the impactor slurry may be dictated by the application for which the injection system 300 and/or the injection system 3000 is to be used.

In an exemplary embodiment, the line 327 may be used as a bleeder line, or a portion of a bleeder line, to bleed air and/or other fluids from the passage 324*fa*, the passage 324*ea* and/or the chamber 324*aa*. One or more valves may be connected to the line 327 and operated so that air and/or other fluids present in the passage 324*fa*, the passage 324*ea* and/or the chamber 324*aa* bleed out through at least a portion of the line 327. The air and/or other fluids may bleed out to, for example, the tank 340. In an exemplary embodiment, the air and/or other fluids may be bleed through at least a portion of the line 327 and be vented to atmosphere. The bleeding of air and/or other fluids from the passage 324*fa*, the passage 324*ea* and/or the chamber 324*aa*, via the line 327 or at least a portion thereof, may occur before, during and/or after one or more of the operational steps described above. For example, bleeding may occur upon start-up operation of the injector vessel 324 and/or after maintenance thereof. In an exemplary embodiment, it is understood that the lines 353 and/or 378 may also be used as bleeder lines.

In an exemplary embodiment, it is understood that, in addition to, or instead of the cylinders 326, 352 and/or 376, a wide variety of other pressurizing means, equipment and/or systems may be employed to pressurize the injector vessels 324, 350 and/or 374, and/or a wide variety of modifications may be made to the cylinders 326, 352 and/or 376. The quantity of cylinders may be increased or decreased, and/or plunger mechanisms, piston mechanisms and/or other actuating mechanisms may be connected to, or used instead of, one or more of the cylinders 326, 352 and/or 376, to pressurize the injector vessels 324, 350 and/or 374. Also, one or more pumps may be used, in addition to, or instead of one or more of the cylinders 326, 352 and/or 376. Moreover, one or more of the cylinders 326, 352 and/or 376 may be removed from the injection system 300 and a pump such as, for example, the pump 304, may be used to pressurize one or more of the injector vessels 324, 350 and/or 374. It is understood that one or more additional valves, lines and/or other components and/or systems may be added to the injection system 300 to effect any modification.

In an exemplary embodiment, any hydraulic fluid or other fluid described above and present in the injection system 300 and/or 3000, and/or present in one or more components thereof such as, for example, one or more of the cylinders 326, 352 and/or 376, may be in a wide variety of fluidic forms such as, for example, oil, drilling fluid or mud, air and/or any combination thereof, and/or any type of conventional hydraulic fluid, and/or any other type of fluid, including any type of liquid or gas.

Any foregoing spatial references such as, for example, "upper," "lower," "above," "below," "rear," "between," "vertical," "angular," etc., are for the purpose of illustration only and do not limit the specific orientation or location of the structure described above.

In several exemplary embodiments, it is understood that one or more of the operational steps in each embodiment may be omitted. Moreover, in some instances, some features of the present disclosure may be employed without a corresponding use of the other features. It is further understood that one or more of the above-described embodiments and/or variations may be combined in whole or in part with any one or more of the other above-described embodiments and/or variations.

Figure 36:
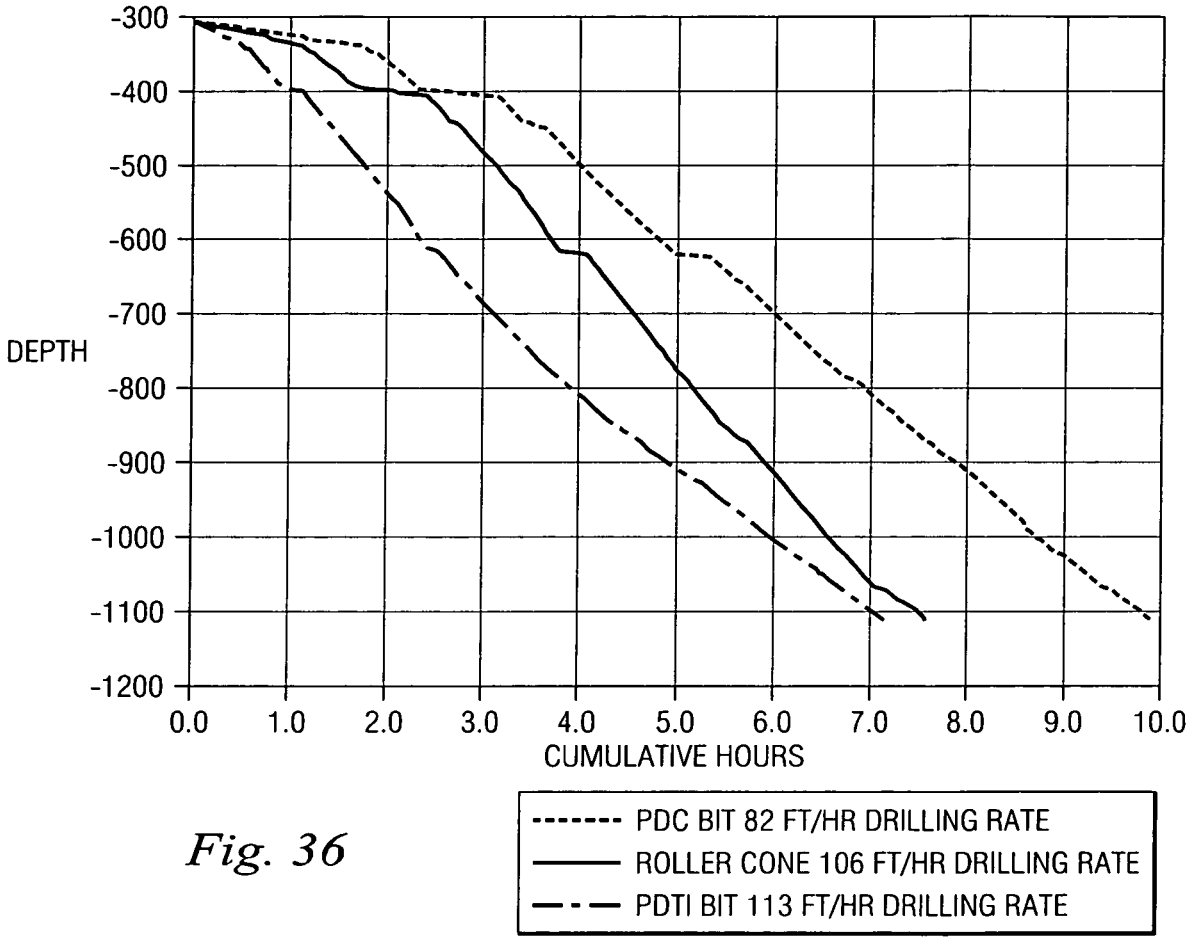
FIG. 36 is a graph depicting the performance of the excavation system according to one or more embodiments of the present invention as compared to two other systems.

FIG. 36 depicts a graph showing a comparison of the results of the impact excavation utilizing one or more of the above embodiments (labeled "PDTI in the drawing) as compared to excavations using two strictly mechanical drilling bits—a conventional PDC bit and a "Roller Cone" bit—while drilling through the same stratigraphic intervals. The drilling took place through a formation at the GTI (Gas Technology Institute of Chicago, Ill.) test site at Catoosa, Okla.

The PDC (Polycrystalline Diamond Compact) bit is a relatively fast conventional drilling bit in soft-to-medium formations but has a tendency to break or wear when encountering harder formations. The Roller Cone is a conventional bit involving two or more revolving cones having cutting elements embedded on each of the cones.

The overall graph of FIG. 36 details the performance of the three bits though 800 feet of the formation consisting of shales, sandstones, limestones, and other materials. For example, the upper portion of the curve (approximately 306 to 336 feet) depicts the drilling results in a hard limestone formation that has compressive strengths of up to 40,000 psi.

Note that the PDTI bit performance in this area was significantly better than that of the other two bits—the PDTI bit took only 0.42 hours to drill the 30 feet where the PDC bit took 1 hour and the roller cone took about 1.5 hours. The total time to drill the approximately 800 foot interval took a little over 7 hours with the PDTI bit, whereas the Roller cone bit took 7.5 hours and the PDC bit took almost 10 hours.

The graph demonstrates that the PDTI system has the ability to not only drill the very hard formations at higher rates, but can drill faster that the conventional bits through a wide variety of rock types.

The table below shows actual drilling data points that make up the PDTI bit drilling curve of FIG. 36. The data points shown are random points taken on various days and times. For example, the first series of data points represents about one minute of drilling data taken at 2:38 pm on Jul. 22, 2005, while the bit was running at 111 RPM, with 5.9 thousand pounds of bit weight ("WOB"), and with a total drill string and bit torque of 1,972 Ft Lbs. The bit was drilling at a total depth of 323.83 feet and its penetration rate for that minute was 136.8 Feet per Hour. The impactors were delivered at approximately 14 GPM (gallons per minute) and the impactors had a mean diameter of approximately 0.100" and were suspended in approximately 450 GPM of drilling mud.

| DATE | TIME | RPM | TORQUE Ft. Lbs. | WOB Lbs. | DEPTH Ft. | PENETRATION FT/MIN | PENETRATION FT/HR |
|---|---|---|---|---|---|---|---|
| Jul. 22, 2005 | 2:38 PM | 111 | 1.972 | 5.9 | 323.83 | 2.28 | 136.8 |
| Jul. 22, 2005 | 4:24 PM | 103 | 2.218 | 9.1 | 352.43 | 2.85 | 171.0 |
| Jul. 25, 2005 | 9:36 AM | 101 | 2.385 | 9.5 | 406.54 | 3.71 | 222.6 |
| Jul. 25, 2005 | 10:17 AM | 99 | 2.658 | 10.9 | 441.88 | 3.37 | 202.2 |
| Jul. 25, 2005 | 11:29 AM | 96 | 2.646 | 10.1 | 478.23 | 2.94 | 176.4 |
| Jul. 25, 2005 | 4:41 PM | 97 | 2.768 | 12.2 | 524.44 | 2.31 | 138.6 |
| Jul. 25, 2005 | 4:54 PM | 96 | 2.870 | 10.6 | 556.82 | 3.48 | 208.8 |

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims. In the claims, means-plus-function clauses are intended to cover the structures described herein as performing the recited function and not only structural equivalents, but also equivalent structures.

What is claimed is:

1. A method comprising:

charging at least a first vessel with a circulation fluid and a plurality of crush resistant metallic impactors during at least a portion of a first time period; pressurizing at least a second vessel during at least a portion of the first time period; and permitting at least a third vessel to inject a suspension of circulation fluid and a plurality of crush resistant metallic impactors into a flow region during at least a portion of the first time period;

permitting circulation fluid to flow through the flow region at a first pressure; wherein pressurizing the at least a second vessel during at least a portion of the first time period comprises: pressurizing the at least a second vessel during at least a portion of the first time period to a second pressure that is greater than the first pressure; and permitting the at least a third vessel to inject a suspension of circulation fluid and a plurality of crush resistant metallic impactors into the flow region during at least a portion of the first time period comprises: permitting the at least a third vessel to inject a suspension of circulation fluid and a plurality of crush resistant metallic impactors into the flow region during at least a portion of the first time period so that the suspension of circulation fluid and a plurality of crush resistant metallic impactors is injected into the flow region at a third pressure that is greater than the first pressure.

2. The method of claim 1 wherein the third pressure is substantially equal to the second pressure.

3. The method of claim 1 wherein the third pressure is less than the second pressure.

4. The method of claim 1 wherein the third pressure is greater than the second pressure.

5. The method of claim 1 further comprising: accelerating the velocity of the suspension of circulation fluid and a plurality of crush resistant metallic impactors; and discharging the suspension of circulation fluid and a plurality of crush resistant metallic impactors through interior regions of a pipe string and into a wellbore to fracture and structurally alter a portion of a subterranean formation), thereby excavating the subterranean formation.

6. A system comprising:

means for charging at least a first vessel with a circulation fluid and a plurality of crush resistant metallic impactors during at least a portion of a first time period; means for pressurizing at least a second vessel during at least a portion of the first time period; and means for permitting at least a third vessel to inject a suspension of circulation fluid and a plurality of crush resistant metallic impactors into a flow region during at least a portion of the first time period;

means for permitting circulation fluid to flow through the flow region at a first pressure; wherein the means for pressurizing the at least a second vessel during at least a portion of the first time period comprises: means for pressurizing the at least a second vessel during at least a portion of the first time period to a second pressure that is greater than the first pressure; and the means for permitting the at least a third vessel to inject a suspension of circulation fluid and a plurality of crush resistant metallic impactors into the flow region during at least a portion of the first time period comprises: means for permitting the at least a third vessel to inject a suspension of circulation fluid and a plurality of crush resistant metallic impactors into the flow region during at least a portion of the first time period so that the suspension of circulation fluid and a plurality of crush resistant metallic impactors is injected into the flow region at a third pressure that is greater than the first pressure.

7. The system of claim 6 wherein the third pressure is substantially equal to the second pressure.

8. The system of claim 6 wherein the third pressure is less than the second pressure.

9. The system of claim 6 wherein the third pressure is greater than the second pressure.

10. The system of claim 6 further comprising: a drill string positioned within a wellbore; and a means for accelerating the velocity of and discharging the suspension of circulation fluid and a plurality of crush resistant metallic impactors through interior regions of the pipe string and into the wellbore; wherein a portion of a subterranean formation is fractured and structurally altered, thereby excavating the subterranean formation in response to the discharge of the suspension of circulation fluid and a plurality of crush resistant metallic impactors.

11. A method of injecting a suspension of circulation fluid and a plurality of crush resistant metallic impactors into a flow region having a first pressure, the method comprising:

charging a vessel with a circulation fluid and a plurality of crush resistant metallic impactors to form a suspension of circulation fluid and a plurality of crush resistant metallic impactors in the vessel;

pressurizing the vessel to a second pressure that is greater than the first pressure;

permitting the vessel to inject the suspension of circulation fluid and the plurality of crush resistant metallic impactors into the flow region from a line at a third pressure greater than the first pressure to thereby accelerate the flow of the suspension of circulation fluid and the plurality of crush resistant metallic impactors into the flow region; and discharging the flow of the suspension of circulation fluid and the plurality of crush resistant metallic impactors through interior regions of a pipe string and into a wellbore to fracture and structurally alter a portion of a subterranean formation, thereby excavating the subterranean formation;

permitting a second vessel to inject a suspension of circulation fluid and a plurality of crush resistant metallic impactors into the flow region from a line at the third pressure during at least a portion of charging the first-mentioned vessel with a circulation fluid and a plurality of crush resistant metallic impactors to form a suspension of circulation fluid and the plurality of crush resistant metallic impactors in the first-mentioned vessel; and pressurizing a third vessel to the second pressure during at least a portion of charging the first-mentioned vessel with a circulation fluid and a plurality of crush resistant metallic impactors to form a suspension of circulation fluid and the plurality of crush resistant metallic impactors in the first-mentioned vessel; and charging the second vessel with a circulation fluid and a plurality of crush resistant metallic impactors during at least a portion of pressurizing the first-mentioned vessel to a second pressure that is greater than the first pressure; and permitting the third vessel to inject a suspension of circulation fluid and a plurality of crush resistant metallic impactors into the flow region from a line at the third pressure during at least a portion of pressurizing the first-mentioned vessel to a second pressure that is greater than the first pressure.

12. The method of claim 11 further comprising: pressurizing the second vessel to the second pressure during at least a portion of permitting the first-mentioned vessel to inject the suspension of circulation fluid and the plurality of crush resistant metallic impactors into the flow region from a line at a third pressure that is greater than the first pressure; and charging the third vessel with a circulation fluid and a plurality of crush resistant metallic impactors during at least a portion of permitting the first-mentioned vessel to inject the suspension of circulation fluid and the plurality of crush resistant metallic impactors into the flow region at a third pressure that is greater than the first pressure.

13. The method of claim 12 wherein a constant flow of a suspension of circulation fluid and a plurality of crush resistant metallic impactors is produced in the flow region in response to: permitting the first-mentioned vessel to inject the suspension of circulation fluid and the plurality of crush resistant metallic impactors into the flow region from a line at a third pressure that is greater than the first pressure, permitting the second vessel to inject a suspension of circulation fluid and a plurality of crush resistant metallic impactors into the flow region at the third pressure during at least a portion of charging the first-mentioned vessel with a circulation fluid and a plurality of crush resistant metallic impactors to form a suspension of circulation fluid and the plurality of crush resistant metallic impactors in the first-mentioned vessel, and permitting the third vessel to inject a suspension of circulation fluid and a plurality of crush resistant metallic impactors into the flow region at the third pressure during at least a portion of pressurizing the first-mentioned vessel to a second pressure that is greater than the first pressure.

14. The method of claim 13 further comprising: accelerating the velocity of the constant flow of a suspension of circulation fluid and a plurality of crush resistant metallic impactors; and discharging the constant flow of a suspension of circulation fluid and a plurality of crush resistant metallic impactors through interior regions of a drill string and into a wellbore to fracture and structurally alter a portion of a subterranean formation, thereby excavating the subterranean formation.

15. A system for injecting a suspension of circulation fluid and a plurality of crush resistant metallic impactors into a flow region having a first pressure, the system comprising:

means for charging a vessel with a circulation fluid and a plurality of crush resistant metallic impactors to form a suspension of circulation fluid and a plurality of crush resistant metallic impactors in the vessel;

means for pressurizing the vessel to a second pressure that is greater than the first pressure;

means for permitting the vessel to inject the suspension of circulation fluid and the plurality of crush resistant metallic impactors from a line at a third pressure into the flow region, the third pressure being greater than the first pressure;

means for permitting a second vessel to inject a suspension of circulation fluid and a plurality of crush resistant metallic impactors into the flow region at the third pressure during at least a portion of charging the first-mentioned vessel with a circulation fluid and a plurality of crush resistant metallic impactors to form a suspension of circulation fluid and the plurality of crush resistant metallic impactors in the first-mentioned vessel; and means for pressurizing a third vessel to the second pressure during at least a portion of charging the first-mentioned vessel with a circulation fluid and a plurality of crush resistant metallic impactors to form a suspension of circulation fluid and the plurality of crush resistant metallic impactors in the first-mentioned vessel.

16. The system of claim 15 further comprising: means for charging the second vessel with a circulation fluid and a plurality of crush resistant metallic impactors during at least a portion of pressurizing the first-mentioned vessel to a second pressure that is greater than the first pressure; and means for permitting the third vessel to inject a suspension of circulation fluid and a plurality of crush resistant metallic impactors into the flow region at the third pressure during at least a portion of pressurizing the first-mentioned vessel to a second pressure that is greater than the first pressure.

17. The system of claim 16 further comprising: means for pressurizing the second vessel to the second pressure during at least a portion of permitting the first-mentioned vessel to inject the suspension of circulation fluid and the plurality of crush resistant metallic impactors into the flow region at a third pressure that is greater than the first pressure; and means for charging the third vessel with a circulation fluid and a plurality of crush resistant metallic impactors during at least a portion of permitting the first-mentioned vessel to inject the suspension of circulation fluid and the plurality of crush resistant metallic impactors into the flow region at the third pressure that is greater than the first pressure.

18. The system of claim 17 wherein a constant flow of a suspension of circulation fluid and a plurality of crush resistant metallic impactors is produced in the flow region in response to: permitting the first-mentioned vessel to inject the suspension of circulation fluid and the plurality of crush resistant metallic impactors into the flow region at the third pressure that is greater than the first pressure, permitting the second vessel to inject a suspension of circulation fluid and a plurality of crush resistant metallic impactors into the flow region at the third pressure during at least a portion of charging the first-mentioned vessel with a circulation fluid and a plurality of crush resistant metallic impactors to form a suspension of circulation fluid and the plurality of crush resistant metallic impactors in the first mentioned vessel, and permitting the third vessel to inject a suspension of circulation fluid and a plurality of crush resistant metallic impactors into the flow region at the third pressure during at least a portion of pressurizing the first-mentioned vessel to a second pressure that is greater than the first pressure.

19. The system of claim 18 further comprising: a drill string positioned within a wellbore; and a means for accelerating the velocity of and discharging the constant flow of a suspension of circulation fluid and a plurality of crush resistant metallic impactors through interior regions of the drill string and into the wellbore; wherein a portion of a subterranean formation is fractured and structurally altered, thereby excavating the subterranean formation in response to the discharge of the constant flow of a suspension of circulation fluid and a plurality of crush resistant metallic impactors.

* * * * *